US011807829B2

(12) United States Patent
Vinson et al.

(10) Patent No.: US 11,807,829 B2
(45) **Date of Patent: *Nov. 7, 2023**

(54) DETERGENT COMPOSITIONS CONTAINING A BRANCHED SURFACTANT

(71) Applicant: The Procter & Gamble Company, Cincinnati, OH (US)

(72) Inventors: Phillip Kyle Vinson, Fairfield, OH (US); Vincent John Becks, Liberty Township, OH (US); Rebecca Ann Langevin, Norwood, OH (US); Mu Wang, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/337,493

(22) Filed: Jun. 3, 2021

(65) Prior Publication Data

US 2022/0064569 A1 Mar. 3, 2022

Related U.S. Application Data

(60) Provisional application No. 63/035,124, filed on Jun. 5, 2020.

(51) Int. Cl.

| | |
|---|---|
| ***C11D 1/83*** | (2006.01) |
| ***C11D 17/04*** | (2006.01) |
| ***C11D 11/00*** | (2006.01) |
| ***C11D 1/37*** | (2006.01) |
| ***C11D 1/831*** | (2006.01) |
| ***C11D 1/94*** | (2006.01) |
| ***C11D 3/37*** | (2006.01) |
| *C11D 1/14* | (2006.01) |
| *C11D 1/22* | (2006.01) |
| *C11D 1/29* | (2006.01) |
| *C11D 1/72* | (2006.01) |
| *C11D 1/75* | (2006.01) |

(52) U.S. Cl.

CPC ..... *C11D 1/37* (2013.01); *C11D 1/83* (2013.01); *C11D 1/831* (2013.01); *C11D 1/94* (2013.01); *C11D 3/3753* (2013.01); *C11D 11/0017* (2013.01); *C11D 17/043* (2013.01); *C11D 17/044* (2013.01); *C11D 1/146* (2013.01); *C11D 1/22* (2013.01); *C11D 1/29* (2013.01); *C11D 1/72* (2013.01); *C11D 1/75* (2013.01)

(58) Field of Classification Search

CPC ..... C11D 1/83; C11D 11/0017

See application file for complete search history.

(56) References Cited

U.S. PATENT DOCUMENTS

| | | | | |
|---|---|---|---|---|
| 3,480,556 | A | 11/1969 | Witt et al. | |
| 6,060,443 | A * | 5/2000 | Cripe | C07C 303/24 510/424 |
| 6,228,829 | B1 * | 5/2001 | Vinson | C11D 17/06 510/357 |
| 10,441,519 | B2 | 10/2019 | Zhao et al. | |
| 2002/0022583 | A1 | 2/2002 | Buzzaccarini et al. | |
| 2003/0216278 | A1 | 11/2003 | Depoot et al. | |
| 2016/0068784 | A1 * | 3/2016 | Vinson | C11D 3/38636 510/357 |
| 2016/0068785 | A1 * | 3/2016 | Vinson | C11D 1/146 510/340 |
| 2017/0175058 | A1 | 6/2017 | Depoot | |
| 2017/0253839 | A1 * | 9/2017 | Scheibel | C11D 11/0017 |
| 2018/0110697 | A1 | 4/2018 | Smith, III | |
| 2021/0380902 | A1 * | 12/2021 | Vinson | C11D 17/043 |
| 2022/0064569 | A1 * | 3/2022 | Vinson | C11D 1/94 |

FOREIGN PATENT DOCUMENTS

| | | | | |
|---|---|---|---|---|
| EP | 0439316 | A2 * | 7/1991 | |
| EP | 0439316 | A2 | 7/1991 | |
| WO | WO-2016040248 | A2 * | 3/2016 | C11D 1/143 |
| WO | 2019055256 | A1 | 3/2019 | |

OTHER PUBLICATIONS

All Office Actions; U.S. Appl. No. 17/834,068, filed Jun. 7, 2022.
U.S. Unpublished U.S. Appl. No. 17/834,068, filed Jun. 7, 2022, to Olubolaji Akintelure et al.
PCT Search Report and Written Opinion for PCT/US2021/035604 dated Sep. 9, 2021,15 pages.
All Office Actions; U.S. Appl. No. 17/339,004, filed Jun. 4, 2021.

* cited by examiner

*Primary Examiner* — Nicole M. Buie-Hatcher
*Assistant Examiner* — M. Reza Asdjodi

(57) ABSTRACT

The present invention relates generally to detergent compositions and, more specifically, to detergent compositions containing a branched surfactant.

23 Claims, No Drawings

DETERGENT COMPOSITIONS CONTAINING A BRANCHED SURFACTANT

TECHNICAL FIELD

The present invention relates generally to detergent compositions and, more specifically, to detergent compositions containing a branched surfactant.

BACKGROUND

Due to the increasing popularity of easy-care fabrics made of synthetic fibers as well as the ever increasing energy costs and growing ecological concerns of detergent users, the once popular warm and hot water washes have now taken a back seat to washing fabrics in cold water (30° C. and below). Many commercially available laundry detergents are even advertised as being suitable for washing fabrics at 15° C. or even 9° C. To achieve satisfactory washing results at such low temperatures, results comparable to those obtained with hot water washes, the demands on low-temperature detergents are especially high.

Branched surfactants are known to be particularly effective under cold water washing conditions. For example, surfactants having branching towards the center of the carbon chain of the hydrophobe, known as mid-chain branched surfactants, are known for cold-water cleaning benefits. 2-alkyl branched or "beta branched" primary alkyl sulfates (also referred to as 2-alkyl primary alcohol sulfates) are also known. 2-alkyl branched primary alkyl alkoxy sulfates have branching at the C2 position (C1 is the carbon atom covalently attached to the alkoxylated sulfate moiety). 2-alkyl branched alkyl sulfates and 2-alkyl branched alkyl alkoxy sulfates are generally derived from 2-alkyl branched alcohols (as hydrophobes). 2-alkyl branched alcohols, e.g., 2-alkyl-1-alkanols or 2-alkyl primary alcohols, which are derived from the oxo process, are commercially available from Sasol, as ISALCHEM®. 2-alkyl branched alcohols (and the 2-alkyl branched alkyl sulfates derived from them) are positional isomers, where the location of the hydroxymethyl group (consisting of a methylene bridge (—$CH_2$— unit) connected to a hydroxy (—OH) group) on the carbon chain varies. Thus, a 2-alkyl branched alcohol is generally composed of a mixture of positional isomers. Also, commercially available 2-alkyl branched alcohols include some fraction of linear alcohols. For example, Sasol's ISALCHEM® alcohols are prepared from Sasol's oxo-alcohols (LIAL® Alcohols) by a fractionation process that yields greater than or equal to 90% 2-alkyl branched material, with the remainder being linear material. 2-alkyl branched alcohols are also available in various chain lengths. 2-alkyl primary alcohol sulfates having alkyl chain length distributions from twelve to twenty carbons are known. ISALCHEM® alcohols in the range of C9-C17 (single cuts and blends), including ISALCHEM® 145 ($C_{14}$-$C_{15}$-alcohols) and ISALCHEM® 167 ($C_{16}$-$C_{17}$-alcohols), are commercially available. Alcohol ethoxylates based on ISALCHEM® 123 are available under the tradename COSMACOL® AE-3.

There is a continuing need for a branched surfactant that can improve cleaning performance at low wash temperatures, e.g., at 30° C. or even lower, at a reasonable cost and without interfering with the production and the quality of the laundry detergents in any way including a negative impact on stability and viscosity. Surprisingly, it has been found that the detergent compositions which contain 2-alkyl primary alcohol alkoxy sulfates having predominantly C15 alkyl chain length distributions with specific fractions of certain positional isomers, provide increased stain removal (particularly in cold water) and improved product stability.

SUMMARY

The present invention attempts to solve one more of the needs by providing a detergent composition comprising from about 0.1% to about 99% by weight of the composition of a first surfactant, where the first surfactant consists essentially of a mixture of surfactant isomers of Formula I and surfactants of Formula II:

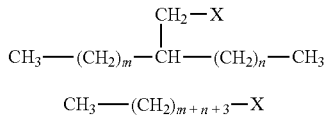

(I)

$$CH_3—(CH_2)_m—CH(CH_2—X)—(CH_2)_n—CH_3$$

(II)

$$CH_3—(CH_2)_{m+n+3}—X$$

$6 \leq m \leq 11$;
$0 \leq n \leq 5$;

wherein from about 50% to about 100% by weight of the first surfactant are isomers having m+n=11; wherein between about 25% to about 50% of the mixture of surfactant isomers of Formula I have n=0; wherein from about 0.001% to about 25% by weight of the first surfactant are surfactants of Formula II; and wherein X is a hydrophilic moiety. The detergent compositions may further comprise one or more adjunct cleaning additives.

The present invention further relates to methods of pretreating or treating a soiled fabric comprising contacting the soiled fabric with the detergent compositions of the invention.

DETAILED DESCRIPTION

Features and benefits of the present invention will become apparent from the following description, which includes examples intended to give a broad representation of the invention. Various modifications will be apparent to those skilled in the art from this description and from practice of the invention. The scope is not intended to be limited to the particular forms disclosed and the invention covers all modifications, equivalents, and alternatives falling within the spirit and scope of the invention as defined by the claims.

As used herein, the articles including "the," "a" and "an" when used in a claim or in the specification, are understood to mean one or more of what is claimed or described.

As used herein, the terms "include," "includes" and "including" are meant to be non-limiting.

As used herein, the term "gallon" refers to a "US gallon."

The term "substantially free of" or "substantially free from" as used herein refers to either the complete absence of an ingredient or a minimal amount thereof merely as impurity or unintended byproduct of another ingredient. A composition that is "substantially free" of/from a component means that the composition comprises less than about 0.5%, 0.25%, 0.1%, 0.05%, or 0.01%, or even 0%, by weight of the composition, of the component.

As used herein, the term "soiled material" is used non-specifically and may refer to any type of flexible material consisting of a network of natural or artificial fibers, including natural, artificial, and synthetic fibers, such as, but not limited to, cotton, linen, wool, polyester, nylon, silk, acrylic, and the like, as well as various blends and combinations.

Soiled material may further refer to any type of hard surface, including natural, artificial, or synthetic surfaces, such as, but not limited to, tile, granite, grout, glass, composite, vinyl, hardwood, metal, cooking surfaces, plastic, and the like, as well as blends and combinations.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All cited patents and other documents are, in relevant part, incorporated by reference as if fully restated herein. The citation of any patent or other document is not an admission that the cited patent or other document is prior art with respect to the present invention.

In this description, all concentrations and ratios are on a weight basis of the detergent composition unless otherwise specified.

Detergent Composition

As used herein the phrase "detergent composition" or "cleaning composition" includes compositions and formulations designed for cleaning soiled material. Such compositions include but are not limited to, laundry cleaning compositions and detergents, fabric softening compositions, fabric enhancing compositions, fabric freshening compositions, laundry prewash, laundry pretreat, laundry additives, spray products, dry cleaning agent or composition, laundry rinse additive, wash additive, post-rinse fabric treatment, ironing aid, dish washing compositions, hard surface cleaning compositions, unit dose formulation, delayed delivery formulation, detergent contained on or in a porous substrate or nonwoven sheet, and other suitable forms that may be apparent to one skilled in the art in view of the teachings herein. Such compositions may be used as a pre-laundering treatment, a post-laundering treatment, or may be added during the rinse or wash cycle of the laundering operation. The detergent compositions may have a form selected from liquid, powder, single-phase or multi-phase unit dose, pouch, tablet, gel, paste, bar, or flake.

Surfactant

The detergent compositions of the invention may comprise one or more surfactants.

In particular, the detergent compositions of the invention contain 2-alkyl primary alkyl alcohol sulfates and 2-alkyl primary alkyl alcohol ethoxy sulfates having specific alkyl chain length distributions, which provide increased stain removal (particularly in cold water). 2-alkyl branched alcohols (and the 2-alkyl branched alkyl sulfates and 2-alkyl branched alkyl ethoxy sulfates and other surfactants derived from them) are positional isomers, where the location of the hydroxymethyl group (consisting of a methylene bridge (—$CH_2$— unit) connected to a hydroxy (—OH) group) on the carbon chain varies. Thus, a 2-alkyl branched alkyl alcohol is generally composed of a mixture of positional isomers. Furthermore, it is well known that fatty alcohols, such as 2-alkyl branched alcohols, and surfactants are characterized by chain length distributions. In other words, fatty alcohols and surfactants are generally made up of a blend of molecules having different alkyl chain lengths (though it is possible to obtain single chain-length cuts). Notably, the 2-alkyl primary alcohols described herein, which may have specific alkyl chain length distributions and/or specific fractions of certain positional isomers, cannot be obtained by simply blending commercially available materials. Specifically, the distribution of from about 50% to about 100% by weight surfactants having m+n=11 is not achievable by blending commercially available materials.

The detergent composition comprising from about 0.1% to about 99% by weight of the composition of a first surfactant, wherein said first surfactant consists essentially of a mixture of surfactant isomers of Formula I and surfactants of Formula II:

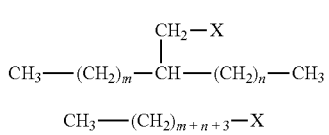

(I)

$$CH_3-(CH_2)_m-CH(CH_2-X)-(CH_2)_n-CH_3$$

(II)

$$CH_3-(CH_2)_{m+n+3}-X$$

$6 \le m \le 11$;
$0 \le n \le 5$;

wherein from about 50% to about 100% by weight of the first surfactant are isomers having m+n=11; wherein from about 25% to about 50% of the mixture of surfactant isomers of Formula I have n=0; wherein from about 0.001% to about 25% by weight of the first surfactant are surfactants of Formula II; and wherein X is a hydrophilic moiety.

X can be, for example, neutralized with sodium hydroxide, potassium hydroxide, magnesium hydroxide, lithium hydroxide, calcium hydroxide, ammonium hydroxide, monoethanolamine, diethanolamine, triethanolamine, monoisopropanolamine, diamine, polyamine, primary amine, secondary amine, tertiary amine, amine containing surfactant, or a combination thereof.

X may be selected from sulfates, alkoxylated alkyl sulfates, sulfonates, amine oxides, polyalkoxylates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated/polyhydroxylated oxypropyl quats, imidazolines, 2-ylsuccinates, sulfonated alkyl esters, sulfonated fatty acids, and mixtures thereof.

The first surfactant may have between about 15% to about 40% of the mixture of surfactant isomers of Formula I have n=1, such as, for example between about 20% to about 40%, between about 25% to about 35%, or between about 30% to about 40%. The first surfactant may have between about 60% to about 90% of the mixture of surfactant isomers of Formula I have n<3, such as, for example between about 65% and 85%, between about 70% and 90%, or between about 80% and 90%. The detergent composition may have between about 90% to about 100% of the first surfactant where the isomers have m+n=11, such as, for example between about 95% and 100%.

The first surfactant may have from about 15% to about 40% by weight of the first surfactant mixture are isomers of Formula I with n=1 and from about 5% to about 20% by weight of the first surfactant mixture are isomers of Formula I with n=2. The first surfactant may have no isomers of Formula I with n equal to or greater than 6. The first surfactant may have up to about 40% of the mixture of surfactant isomers of Formula I with n>2. The first surfactant may have up to about 25% of the mixture of surfactant isomers of Formula I have n>2. The first surfactant may have up to about 20% by weight of the Formula II isomer.

The detergent composition may further comprise further an adjunct cleaning additive. The adjunct cleaning additive may be a builder, an organic polymeric compound, an enzyme, an enzyme stabilizer, one or more solvents a bleach system, a brightener, a hueing agent, a chelating agent, a suds suppressor, a conditioning agent, a humectant, a perfume, a filler or carrier, an alkalinity system, a pH control system, and a buffer, and mixtures thereof.

The detergent composition may further comprise from about 0.1% to about 99% by weight of the composition of a second surfactant, wherein said second surfactant consists essentially of a mixture of surfactant isomers of Formula III and surfactants of Formula IV:

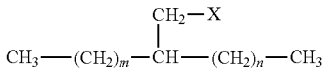

(III)

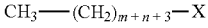

(IV)

$6 \leq m \leq 9$;
$0 \leq n \leq 5$;

wherein from about 50% to about 100% by weight of the first surfactant are isomers having m+n=9; wherein from about 0.001% to about 25% by weight of the first surfactant are surfactants of Formula IV; and wherein X is a hydrophilic moiety. X can be, for example, neutralized with sodium hydroxide, potassium hydroxide, magnesium hydroxide, lithium hydroxide, calcium hydroxide, ammonium hydroxide, monoethanolamine, diethanolamine, triethanolamine, monoisopropanolamine, diamine, polyamine, primary amine, secondary amine, tertiary amine, amine containing surfactant, or a combination thereof. X may be selected from sulfates, alkoxylated alkyl sulfates, sulfonates, amine oxides, polyalkoxylates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated/polyhydroxylated oxypropyl quats, imidazolines, 2-yl-succinates, sulfonated alkyl esters, sulfonated fatty acids, and mixtures thereof.

Between about 25% to about 50% of the mixture of second surfactant isomers of Formula III may have n=0, such as, for example between 30% and 45%, between 35% and 45%, or between 40% and 50%. Between about 15% to about 40% of the mixture of second surfactant isomers of Formula III may have n=1, such as, for example, between 20% and 40%, between 25% and 35%, or between 30% and 40%. Between about 50% to about 90% of the mixture of second surfactant isomers of Formula III may have n<3, such as, for example between 55% and 90%, between 60% and 80%, or between 70% and 90%. Between about 90% to about 100% of the second surfactant may comprise isomers having m+n=9, such as, for example between 95% and 100%.

The second surfactant may have from about 25% to about 50% by weight of the second surfactant mixture are isomers of Formula III with n=0, from about 15% to about 40% by weight of the second surfactant mixture are isomers of Formula III with n=1, and from about 5% to about 20% by weight of the second surfactant mixture are isomers of Formula III with n=2. Up to about 40% of the mixture of surfactant isomers of Formula III may have n>2. Up to about 35% of the mixture of surfactant isomers of Formula III may have n>2. The second surfactant mixture of surfactants may comprise up to about 20% by weight of the Formula IV isomer.

The detergent composition may comprise a surfactant system comprising between about 30 to about 99% of the first surfactant and between about 0.5% to about 40% of the second surfactant, preferably 0.5 to 20% of the second surfactant, more preferably 0.5 to 12.5% of the second surfactant. The detergent composition may comprise a surfactant system comprising between about 60% to about 99% of the first surfactant and up to about 25% of the second surfactant. The detergent composition may comprise the second surfactant and the first surfactant at a ratio between 0.5:10 to 4:10, such as, for example, 1:10, 2:10, or 3:10.

The detergent composition may further comprise a third surfactant selected from the group consisting of an anionic surfactant, a cationic surfactant, a nonionic surfactant, an amphoteric surfactant, a zwitterionic surfactant, or mixtures thereof; or wherein said detergent composition comprises an anionic surfactant selected from alkyl benzene sulfonates, alkoxylated alkyl sulfates, alkyl sulfates, and mixtures thereof.

The detergent composition may be in a form selected from the group consisting of a granular detergent, a bar-form detergent, a liquid laundry detergent, a gel detergent, a single-phase or multi-phase unit dose detergent, a detergent contained in a single-phase or multi-phase or multi-compartment water soluble pouch, a liquid hand dishwashing composition, a laundry pretreat product, a multi-compartment non-dissolvable package, a detergent contained on or in a porous substrate or nonwoven sheet, an automatic dish-washing detergent, a hard surface cleaner, a fabric softener composition, and mixtures thereof.

The detergent composition may be incorporated into a fibrous product. The detergent composition may be incorporated into the fibers of a fibrous product, particles within a fibrous product, or a combination thereof.

The detergent composition may have from about 0.1% to about 100% of the carbon content of the first surfactant, the second surfactant, or a combination thereof that is derived from renewable sources.

The detergent composition may be used in a method of pretreating or treating a soiled fabric comprising contacting the soiled fabric with the detergent composition.

The detergent compositions may comprise an additional surfactant (e.g., a third surfactant, a fourth surfactant) selected from the group consisting of anionic surfactants, nonionic surfactants, cationic surfactants, zwitterionic surfactants, amphoteric surfactants, ampholytic surfactants, and mixtures thereof. The additional surfactant may be a detersive surfactant, which those of ordinary skill in the art will understand to encompass any surfactant or mixture of surfactants that provide cleaning, stain removing, or laundering benefit to soiled material.

The detergent compositions may contain from about 0.01% to about 5% by weight of the detergent composition of an alcohol composition. The detergent compositions may contain from about 0.5% to about 3.0% by weight of the detergent composition of an alcohol composition. At such concentrations, the alcohol compositions may provide a suds suppressing benefit to the detergent composition.

The detergent compositions may contain from about 0.01% to about 0.5% by weight of the detergent composition of an alcohol composition. At such concentrations, the alcohol compositions may be impurities.

Suitable Alkyl Sulfate Anionic Surfactants can be Made Using the Following Process.

A two-step process can be used to produce branched aldehyde products from linear alpha olefin feedstocks, from which the alkyl sulfate anionic surfactants as described herein can be derived. The two-step process uses a rhodium organophosphorus catalyst for both a first process step and a second step. The first step is an isomerization reaction step and the second process step is a hydroformylation reaction step. The branched aldehydes can undergo a further hydrogenation step to produce branched alcohols.

The isomerization and hydroformylation reactions disclosed herein can be catalyzed by a rhodium organophosphorus catalyst which can be at least one of: (1) an organometallic complex of rhodium and one type of an organophosphorus ligand; (2) or an organometallic complex of rhodium and more than one type of an organophosphorus ligand.

The organophosphorous ligand can be a phosphine. In a nonlimiting example of a phosphine ligand, the phosphine ligand can be triphenylphosphine. The organophosphorous ligand can also be a phosphite. In a nonlimiting example of a phosphite ligand, the phosphite ligand can be tris (2,4-di-t-butylphenyl) phosphite. A mixture of organophosphorous ligands of different types can also be used, such as a mixture of a phosphine and a phosphite. In a nonlimiting example of a mixture of organophosphorous ligands, the organophosphorous ligands can be a mixture of triphenylphosphine and tris (2,4-di-t-butylphenyl) phosphite. The reaction system can contain an inert high-boiling solvent, for example a polyalphaolefin. The first catalyst can be formed when the molar ratio of phosphorous to rhodium is in a range of 1:1 to 1000:1, or 5:1 to 50:1, or 15:1 to 25:1. The rhodium concentration can be in a range of 1 ppm to 1000 ppm, or 10 ppm to 200 ppm, or 25 ppm to 75 ppm. The CO to H2 molar ratio can be in a range of 10:1 to 1:10, or 2:1 to 1:2, or 1.3:1 to 1:1.3.

During the isomerization reaction, the first step can be a reaction isomerizing a linear alpha olefin in the presence of Carbon Monoxide (CO) and Hydrogen (H2) at a first pressure. The isomerizing can be catalyzed by the rhodium organophosphorus catalyst which can be at least one of: (1) an organometallic complex of rhodium and one type of an organophosphorus ligand; (2) or an organometallic complex of rhodium and more than one type of an organophosphorus ligand. The isomerization reactions can produce an isomerized olefin comprising linear internal olefins of the same or different types.

The isomerization step can be performed at a temperature in a range of 30° C. to 500° C., or 50° C. to 150° C., or 70° C. to 100° C. The isomerization step can be performed at a gauge pressure in a range of 0.1 bar (0.01 MPa above atmospheric) to 10 bar (1 MPa above atmospheric), or 0.5 bar (0.05 MPa above atmospheric) to 5 bar (0.5 MPa above atmospheric), or 1 bar (0.1 MPa above atmospheric) to 2 bar (0.2 MPa above atmospheric).

The isomerizing step can produce a reaction product comprising a 20 wt. % or greater isomerized olefin, or a 40 wt. % or greater isomerized olefin, or a 60 wt. % or greater isomerized olefin, or a 90 wt. % or greater isomerized olefin.

During the hydroformylation reaction step, the isomerized olefin is hydroformylated in the presence of CO and H2 at a second pressure higher than the first pressure to produce a branched aldehyde. The hydroformylation reaction can be catalyzed by the rhodium organophosphorus catalyst which can be at least one of: (1) an organometallic complex of rhodium and one type of an organophosphorus ligand; (2) or an organometallic complex of rhodium and more than one type of an organophosphorus ligand. The resultant branched aldehyde is a 2-alkyl branched aldehyde. When the linear alpha olefin is 1-dodecene, the resultant branched aldehyde is a branched C13 aldehyde. When the linear alpha olefin is 1-tetradecene, the resultant branched aldehyde is a branched C15 aldehyde.

The hydroformylating step can be performed at a temperature in a range of 30° C. to 500° C., or 50° C. to 150° C., or 70° C. to 100° C. The hydroformylating step can be performed at a gauge pressure in a range of 5 bar (0.5 MPa above atmospheric) to 400 bar (40 MPa above atmospheric), or 10 bar (1.0 MPa above atmospheric) to 100 bar (10 MPa above atmospheric), or 15 bar (1.5 MPa above atmospheric) to 20 bar (2 MPa above atmospheric).

The hydroformylating step can produce a reaction product comprising a 25 wt. % or greater branched aldehyde, or a 40 wt. % or greater branched aldehyde, or a 60 wt. % or greater branched aldehyde, or a 90 wt. % or greater branched aldehyde.

The products of the hydroformylation reaction can be distilled. The process can have the step of separating the branched aldehyde products resulting from hydroformylation as an overhead product from the first catalyst stream via a distillation process. The distillation step can be performed at a temperature in a range of 100° C. to 200° C., or 125° C. to 175° C. The distillation step can be performed under vacuum at a pressure of less than 500 millibar absolute (0.05 MPa), or less than 100 millibar absolute (0.01 MPa), or less than 30 millibar absolute (0.003 MPa), The process can also have the steps of: hydrogenating the branched aldehyde product in the presence of a hydrogenation catalyst to produce a branched alcohols product composition. The hydrogenating catalyst can be a base metal catalyst, a supported nickel catalyst, a supported cobalt catalyst, a Raney® (W. R. Grace & Co., 7500 Grace Drive, Columbia, Md. 21044) nickel catalyst or a precious metal catalyst. The hydrogenating step can be performed at a temperature in a range of 30° C. to 500° C., or 50° C. to 200° C., or 100° C. to 150° C. The hydrogenating step can be performed at a gauge pressure in a range of 5 bar (0.5 MPa above atmospheric) to 400 bar (40 MPa above atmospheric), or 10 bar (1 MPa above atmospheric) to 100 bar (10 MPa above atmospheric), or 30 bar (3 MPa above atmospheric) to 50 bar (5 MPa above atmospheric).

The hydrogenating step can produce a reaction product comprising 25 wt % or greater branched alcohols, or 40 wt % or greater branched alcohols, or 60 wt % or greater branched alcohols, or 90 wt. % or greater branched alcohols.

Alkyl sulfates are typically prepared by the reaction of fatty alcohols with sulfur trioxide ($SO_3$) or its derivatives or by the reaction of unsaturated compounds with sulfuric acid. Processes using sulfur trioxide in particular have gained prominence for fabricating alkyl sulfate anionic surfactants for use in detergent compositions.

Suitable derivatives of Sulfur trioxide include sulfur trioxide complexes such as chlorosulfonic acid, sulfuric acid, or sulfamic acid. Sulfur trioxide is preferred since it tends to result in more pure products. The sulfation reaction typically takes place in a continuous process using a cascade, falling film or tube bundle reactor, with the sulfur trioxide being applied in an equimolar or small excess, usually in a temperature range of 20° C. to 60° C., with the reaction temperature being determined at least partially by the solidification point of the fatty alcohol in the reaction. The reaction typically results in the acid form of the alkyl sulfate anionic surfactant which is typically neutralised in a subsequent step, using an alkali such as sodium hydroxide, potassium hydroxide, magnesium hydroxide lithium hydroxide, calcium hydroxide, ammonium hydroxide, monoethanolamine, diethanolamine, triethanolamine, monoisopropanolamine, diamines, polyamines, primary amines, secondary amines, tertiary amines, amine containing surfactants, and mixtures thereof.

Also, it is well known that the process of sulfating fatty alcohols to yield alkyl sulfate anionic surfactants also yields various impurities. The exact nature of these impurities depends on the conditions of sulfation and neutralization. Generally, however, the impurities of the sulfation process include one or more inorganic salts, unreacted fatty alcohol, and olefins ("The Effect of Reaction By-Products on the Viscosities of Sodium Lauryl Sulfate Solutions," Journal of the American Oil Chemists' Society, Vol. 55, No. 12, p. 909-913 (1978), C. F. Putnik and S. E. McGuire). The level of non alkyl sulfate impurities in the alkyl sulfate anionic surfactant of the present invention can be less than 6% by weight, preferably less than 4% by weight, and most preferably less than 2% by weight of the alkyl sulfate anionic surfactant.

For alkyl alkoxy sulfates, the fatty alcohol is first alkoxylated before sulfation. Alkoxylation is a process that reacts lower molecular weight epoxides (oxiranes), such as ethylene oxide, propylene oxide, and butylene oxide with the fatty alcohol. These epoxides are capable of reacting with the fatty alcohol using various base or acid catalysts. In base catalyzed alkoxylation, an alcoholate anion, formed initially by reaction with a catalyst (alkali metal, alkali metal oxide, carbonate, hydroxide, or alkoxide), nucleophilically attacks the epoxide.

Traditional alkaline catalysts for alkoxylation include potassium hydroxide and sodium hydroxide, which give rise to a somewhat broader distribution of alkoxylates. Other catalysts have been developed for alkoxylation that provide a more narrow distribution of alkoxylate oligomers. Suitable examples of narrow range alkoxylation catalysts include many alkaline earth (Mg, Ca, Ba, Sr, etc.) derived catalysts, Lewis acid catalysts, such as Zirconium dodecanoxide sulfate, and certain boron halide catalysts. A specific average degree of alkoxylation may be achieved by selecting the starting quantities of fatty alcohol and ethylene oxide or by blending together varying amounts of alkoxylated surfactants differing from one another in average degree of alkoxylation.

Impurities

The process of making the 2-alkyl primary alcohol-derived surfactants of the invention may produce various impurities and/or contaminants at different steps of the process.

The C14 olefin and C12 olefin sources used in the hydroformylation to make the starting C15 aldehydes and C13 aldehydes and subsequent alcohols and corresponding surfactants of use in the present invention may have low levels of impurities that lead to impurities in the starting C15 alcohols and C13 alcohol and therefore also in the C15 alkyl sulfate and C13 alkyl sulfate. While not intending to be limited by theory, such impurities present in the C14 olefin and C12 olefin feeds can include vinylidene olefins, branched olefins, paraffins, aromatic components, and low levels of olefins having chain-lengths other than the intended 14 carbons or 12 carbons. Branched and vinylidene olefins are typically at or below 5% in C14 and C12 alpha olefin sources. Impurities in the resulting C15 alcohols and C13 alcohols can include low levels of linear and branched alcohols in the range of C10 to C17 alcohols, especially C11 and C15 alcohols in the C13 alcohol, and especially C13 and C17 alcohols in the C15 alcohol, typically less than 5% by weight of the mixture, preferably less than 1%; low levels of branching in positions other than the 2-alkyl position resulting from branched and vinylidene olefins are typically less than about 5% by weight of the alcohol mixture, preferably less than 2%; paraffins and olefins, typically less than 1% by weight of the alcohol mixture, preferably less than about 0.5%; low levels of aldehydes with a carbonyl value typically below 500 mg/kg, preferably less than about 200 mg/kg. These impurities in the alcohol can result in low levels of paraffin, linear and branched alkyl sulfates having total carbon numbers other than C15 or C13, and alkyl sulfates with branching in positions other than the 2-alkyl location, wherein these branches can vary in length, but are typically linear alkyl chains having from 1 to 6 carbons. The step of hydroformylation may also yield impurities, such as linear and branched paraffins, residual olefin from incomplete hydroformylation, as well as esters, formates, and heavy-ends (dimers, trimers). Impurities that are not reduced to alcohol in the hydrogenation step may be removed during the final purification of the alcohol by distillation.

Also, it is well known that the process of sulfating fatty alcohols to yield alkyl sulfate surfactants also yields various impurities. The exact nature of these impurities depends on the conditions of sulfation and neutralization. Generally, however, the impurities of the sulfation process include one or more inorganic salts, unreacted fatty alcohol, and olefins ("The Effect of Reaction By-Products on the Viscosities of Sodium Lauryl Sulfate Solutions," *Journal of the American Oil Chemists' Society*, Vol. 55, No. 12, p. 909-913 (1978), C. F. Putnik and S. E. McGuire).

Alkoxylation impurities may include dialkyl ethers, polyalkylene glycol dialkyl ethers, olefins, and polyalkylene glycols. Impurities can also include the catalysts or components of the catalysts that are used in various steps.

SYNTHESIS EXAMPLES

The following examples are representative and non-limiting.

Alcohol Compositions—Using the above-described process (Rh hydroformylation, hydrogenation), the alcohol compositions described in Examples 1 and 2 are obtained and analyzed by gas chromatography with flame ionization detection (GC/FID). The samples are prepared as a 1% (w/v) dichloromethane solution and injected into a capillary GC Column: DB-1 HT 15 m×0.25 mm ID, 0.1 μm film thickness, using an oven temperature program [initial temperature 80° C. (1 min), ramp 10° C./min to 220° C., ramp 30° C./min to 350° C. (1 min)] for a total run time of 19 minutes. Additional GC parameters include Column Flow: 1.4 ml/min ($H_2$), Injection Temperature: 300° C., Sample Amount: 1 μL, Split Ratio: 1/400, FID Temperature: 350°

C., $H_2$ Flow: 40 mL/min, Air Flow: 400 mL/min, and Makeup Gas Flow: 25 mL/min.

Example 1: Preparation of a Branched C13 Alcohol Product

A C12 linear alpha olefin feedstock (1-Dodecene) was obtained from the Chevron Phillips Chemical Company LP, as identified by product name AlphaPlus® 1-Dodecene (Chevron Phillips Chemical Company LP, P.O. Box 4910, The Woodlands, Tex. 77387-4910, US, phone (800) 231-3260). The homogeneous rhodium organophosphorus catalyst used in this example is prepared in a high pressure, stainless steel stirred autoclave. To the autoclave was added 0.027 wt. % Rh(CO)2ACAC ((Acetylacetonato)dicarbonylrhodium(I)), 1.36 wt. % tris (2,4,-di-t-butylphenyl) phosphite ligand and 98.62 wt. % Synfluid® PAO 4 cSt (Chevron Phillips Chemical Company LP, P.O. Box 4910, The Woodlands, Tex. 77387-4910, phone (800) 231-3260) inert solvent. The mixture was heated at 80° C. in the presence of a CO/H2 atmosphere and 2 bar(g) pressure for four hours to produce the active rhodium catalyst solution (109 ppm rhodium, P:Rh molar ratio=20). The 1-Dodecene linear alpha olefin was added to the rhodium catalyst solution in the autoclave producing a starting reaction mixture with a rhodium concentration of 35 ppm. The alpha olefin feed was then isomerized at 80° C. in the presence of a CO/H2 atmosphere and 1 bar(g) pressure for 10 hours. The isomerized olefin was then hydroformylated at 70° C. in the presence of a CO/H2 atmosphere and 20 bar(g) pressure for 8 hours. The molar ratio of CO to H2 in both the isomerization step and the hydroformylation step was equal to 1:1.15. The resulting hydroformylation reaction product was flash distilled at 140-150° C. and 25 millibar to recover the rhodium catalyst solution as a bottoms product and recover a branched C13 Aldehyde overheads product with a composition comprising:

| | Weight % |
|---|---|
| 1-Tridecanal | 13.9% |
| 2-Methyl-dodecanal | 28.3% |
| 2-Ethyl-undecanal | 15.2% |
| 2-Propyl-decanal | 14.5% |
| 2-Butyl-nonanal | 13.6% |
| 2-Pentyl-octanal | 12.6% |
| TOTAL | 98.0% |

The weight % branching in the branched C13 aldehyde product was 86.2%.

The branched C13 aldehyde product was hydrogenated in a high pressure, Inconel 625 stirred autoclave at 150 C and 20 bar(g) hydrogen pressure. The hydrogenation catalyst used was a Raney® Nickel 3111 (W. R. Grace & Co., 7500 Grace Drive, Columbia, Md. 21044, US, phone 1-410-531-4000) catalyst used at a 0.25 wt. % loading. The aldehyde was hydrogenated for 10 hours and the resultant reaction mixture was filtered to produce a branched C13 alcohol product comprising:

| | Weight % |
|---|---|
| 1-Tridecanol | 13.36 wt % |
| 2-Methyl-dodecanol | 28.95 wt % |
| 2-Ethyl-undecanol | 16.25 wt % |

-continued

| | Weight % |
|---|---|
| 2-Propyl-decanol | 13.92 wt % |
| 2-Butyl-nonanol | 13.46 wt % |
| 2-Pentyl-octanol | 13.02 wt % |
| Other | 1.04 wt % |

The weight % 2-alkyl branching in the branched C13 alcohol product was 85.6%.

Example 2: Preparation of a Branched C15 Alcohol Product

The recovered rhodium catalyst stream from Example 1 was charged to a high pressure, stainless steel stirred autoclave and a C14 linear alpha olefin feedstock (1-Tetradecene) from the Chevron Phillips Chemical Company LP, (AlphaPlus® 1-Tetradecene by Chevron Phillips Chemical Company LP, P.O. Box 4910, The Woodlands, Tex. 77387-4910, phone (800) 231-3260) was added. The resulting mixture had a rhodium concentration of approximately 30 ppm. The 1-tetradecene linear alpha olefin was then isomerized at 80° C. in the presence of a CO/H2 atmosphere and 1 bar(g) pressure for 12 hours. The isomerized olefin was then hydroformylated at 70° C. in the presence of a CO/H2 atmosphere and 20 bar(g) pressure for 8 hours. The resulting reaction product was flash distilled at 150-160° C. and 25 millibar to recover the rhodium catalyst solution as a bottoms product and recover a branched C15 Aldehyde overheads product. The recovered rhodium catalyst solution was then used again to complete a second 1-tetradecene batch isomerization (4 hours) and hydroformylation (6 hours). The resulting C15 aldehyde products from the two batches were combined to give a branched C15 Aldehyde product comprising:

| | Weight % |
|---|---|
| 1-Pentadecanal | 12.1% |
| 2-Methyl-tetradecanal | 34.1% |
| 2-Ethyl-tridecanal | 21.9% |
| 2-Propyl-dodecanal | 14.0% |
| 2-Butyl-undecanal | 8.6% |
| 2-Pentyl-decanal + 2-hexyl-decanal | 9.0% |
| TOTAL | 99.6% |

The weight % branching in the branched C15 aldehyde product was 87.8%.

The branched C15 aldehyde product was hydrogenated in a high pressure, Inconel 625 stirred autoclave at 150 C and 20 bar(g) hydrogen pressure. The hydrogenation catalyst used was a Raney® Nickel 3111 (W. R. Grace & Co., 7500 Grace Drive, Columbia, Md. 21044, US, phone 1-410-531-4000) catalyst used at a 0.25 wt. % loading. The aldehyde was hydrogenated for 10 hours and the resultant reaction mixture was filtered to produce a branched C15 alcohol product comprising:

| | Weight % |
|---|---|
| 1-Pentadecanol | 13.7% |
| 2-Methyl-tetradecanol | 32.6% |

-continued

| | Weight % |
|---|---|
| 2-Ethyl-tridecanol | 21.7% |
| 2-Propyl-dodecanol | 12.4% |
| 2-Butyl-undecanol | 8.0% |
| 2-Pentyl-decanol + 2-hexyl-decanol | 9.0% |
| Other | 2.7% |

The weight % 2-alkyl branching in the branched C15 alcohols product was 83.6%.

Example 3. Synthesis of Narrow Branched Pentadecanol (C15) Sulfate Using a Falling Film Sulfation Reactor (Inventive Example 3)

The alcohol from Example 2 is sulfated in a falling film using a Chemithon single 15 mm×2 m tube reactor using SO3 generated from a sulfur burning gas plant operating at 5.5 lb/hr sulfur to produce 3.76% SO3 on a volume basis. Alcohol feed rate is 17.4 kg/hour and feed temperature was 83 F. Conversion of the alcohol to alcohol sulfate acid mix was achieved with 97% completeness. Neutralization with 50% sodium hydroxide is completed at ambient process temperature to 0.54% excess sodium hydroxide. 30 gallons of sodium neutralized C15 narrow branched Alcohol Sulfate paste. Analyses by standard Cationic SO3 titration method determines final average product activity to be 74.5%. The average unsulfated level is 2.65% w/w.

Example 4. Synthesis of Narrow Branched Tridecanol (C13) Sulfate Using a Falling Film Sulfation Reactor (Inventive Example 4)

The alcohol from Example 1 is sulfated in a falling film using a Chemithon single 15 mm×2 m tube reactor using SO3 generated from a sulfur burning gas plant operating at 5.5 lb/hr sulfur to produce 3.76% SO3 on a volume basis. Alcohol feed rate is 15.2 kg/hour and feed temperature is 81 F. Conversion of the alcohol to alcohol sulfate acid mix was achieved with 96.5% completeness. Neutralization with 50% sodium hydroxide is completed at ambient process temperature to 0.65% excess sodium hydroxide. 33 gallons of sodium neutralized C13 narrow branched Alcohol Sulfate paste. Analyses by standard Cationic SO3 titration method determines final average product activity to be 73.4%. The average unsulfated level is 2.10% w/w.

Alkyl Sulfates

TABLE 1

Alkyl chain distribution of C15 Alkyl Sulfates based on starting distribution of alcohol

| | Neodol ® 5 (ex Shell) | C15 Alcohol from U.S. Pat. No. 9,493,725 (ex Sasol) | Inventive Example 3 C15 Alkyl Sulfate made from Example 2 C15 Alcohol |
|---|---|---|---|
| Linear C15* | 79.3 | 8.6 | 13.7 |
| 2-Alkyl Branched C15 | 17.5 | 89.5 | 83.6 |
| Other* | 3.2 | 1.9 | 2.7 |
| 2-methyl* | 7.0 | 19.0 | 32.6 |
| 2-ethyl* | 2.8 | 12.0 | 21.7 |
| 2-propyl* | 1.9 | 12.7 | 12.4 |
| 2-butyl* | 2.0 | 14.6 | 8.0 |

TABLE 1-continued

Alkyl chain distribution of C15 Alkyl Sulfates based on starting distribution of alcohol

| | Neodol ® 5 (ex Shell) | C15 Alcohol from U.S. Pat. No. 9,493,725 (ex Sasol) | Inventive Example 3 C15 Alkyl Sulfate made from Example 2 C15 Alcohol |
|---|---|---|---|
| 2-pentyl + 2-hexyl* | 3.8 | 31.2 | 9.0 |
| 2-Alkyl Branch Distribution | | | |
| 2-methyl** | 39.9% | 21.2% | 38.9% |
| 2-ethyl** | 16.2% | 13.4% | 25.9% |
| 2-propyl** | 10.7% | 14.2% | 14.9% |
| 2-butyl ** | 11.3% | 16.3% | 9.5% |
| 2-pentyl + 2-hexyl** | 21.9% | 34.9% | 10.7% |

*by weight of starting alcohol
**by weight of 2-alkyl branched C15 alcohol

TABLE 2

Alkyl chain distribution of C13 Alkyl Sulfates based on starting distribution of alcohol

| | Neodol ® 3 (ex Shell) | Isalchem ® C13 Alcohol (ex Sasol) | Inventive Example 4 C13 Alkyl Sulfate made from Example 1 C13 Alcohol |
|---|---|---|---|
| Linear C13* | 78.3 | 5.3 | 13.4 |
| 2-Alkyl Branched C13* | 18.1 | 91.3 | 85.6 |
| Other* | 3.6 | 3.4 | 1.0 |
| 2-methyl* | 8.1 | 19.1 | 29.0 |
| 2-ethyl* | 2.8 | 15.7 | 16.3 |
| 2-propyl* | 2.4 | 16.9 | 13.9 |
| 2-butyl* | 2.4 | 16.1 | 13.5 |
| 2-pentyl* | 2.4 | 23.4 | 13.0 |
| 2-Alkyl Branch Distribution | | | |
| 2-methyl** | 44.7% | 21.0% | 33.8% |
| 2-ethyl** | 15.2% | 17.2% | 19.0% |
| 2-propyl** | 13.4% | 18.5% | 16.3% |
| 2-butyl** | 13.3% | 17.7% | 15.7% |
| 2-pentyl** | 13.5% | 25.6% | 15.2% |

*by weight of starting alcohol
**by weight of 2-alkyl branched C13 alcohol

Additional Surfactant

In addition to the first surfactant, the detergent compositions may comprise an additional surfactant, e.g., a second surfactant, a third surfactant. The detergent composition may comprise from about 1% to about 75%, by weight of the composition, of an additional surfactant, e.g., a second surfactant, a third surfactant. The detergent composition may comprise from about 2% to about 35%, by weight of the composition, of an additional surfactant, e.g., a second surfactant, a third surfactant. The detergent composition may comprise from about 5% to about 10%, by weight of the composition, of an additional surfactant, e.g., a second surfactant, a third surfactant. The additional surfactant may be selected from the group consisting of anionic surfactants, nonionic surfactants, cationic surfactants, zwitterionic surfactants, amphoteric surfactants, ampholytic surfactants, and mixtures thereof.

Laundry Care Ingredients

The detergent composition or laundry care composition may comprise other suitable adjuncts which, in some aspects, can be wholly or partially incorporated. Adjuncts may be selected according to the laundry care composition's intended function. The first composition may comprise an adjunct. In some aspects, in the case of multi-compartment unit dose articles, the adjuncts may be part of a non-first (e.g., second, third, fourth, etc.) composition encapsulated in compartments separate from the first composition. The non-first composition may be any suitable composition. The non-first composition may be in the form of a solid, a liquid, a dispersion, a gel, a paste or a mixture thereof. Where the unit dose comprises multiple compartments, the leuco colorant may be added to or present in one, two, or even all the compartments. In one embodiment, the leuco colorant is added to the larger compartment, leading to a lower concentration which may minimize any issues involved with potential contact staining. On the other hand, concentrating an anti-oxidant with a leuco colorant in a smaller volume compartment may lead to a higher local concentration of anti-oxidant which may provide enhanced stability. Therefore, as one skilled in the art would appreciate, the formulator can select the location and amount of the leuco colorant according to the desired properties of the unit dose.

Adjuncts

The laundry care composition may comprise a surfactant system having additional surfactants to the first surfactant, the second surfactant, or a combination of the first surfactant and second surfactant. The total combination of surfactants including the first surfactant, second surfactant, and any other surfactant comprises the surfactant system. The laundry care composition may comprise from about 1% to about 80%, or from 1% to about 60%, preferably from about 5% to about 50% more preferably from about 8% to about 40%, by weight of the laundry care composition, of a surfactant system.

Surfactant:

Suitable surfactants include anionic surfactants, non-ionic surfactant, cationic surfactants, zwitterionic surfactants and amphoteric surfactants and mixtures thereof. Suitable surfactants may be linear or branched, substituted or unsubstituted, and may be derived from petrochemical material or biomaterial. Preferred surfactant systems comprise both anionic and nonionic surfactant, preferably in weight ratios from 90:1 to 1:90. In some instances a weight ratio of anionic to nonionic surfactant of at least 1:1 is preferred. However, a ratio below 10:1 may be preferred. When present, the total surfactant level is preferably from 0.1% to 60%, from 1% to 50% or even from 5% to 40% by weight of the subject composition.

Anionic Surfactant:

Anionic surfactants include, but are not limited to, those surface-active compounds that contain an organic hydrophobic group containing generally 8 to 22 carbon atoms or generally 8 to 18 carbon atoms in their molecular structure and at least one water-solubilizing group preferably selected from sulfonate, sulfate, and carboxylate so as to form a water-soluble compound. Usually, the hydrophobic group will comprise a C8-C22 alkyl, or acyl group. Such surfactants are employed in the form of water-soluble salts and the salt-forming cation usually is selected from sodium, potassium, ammonium, magnesium and mono-, with the sodium cation being the usual one chosen.

Anionic surfactants of the present invention and adjunct anionic cosurfactants, may exist in an acid form, and said acid form may be neutralized to form a surfactant salt which is desirable for use in the present detergent compositions. Typical agents for neutralization include the metal counterion base such as hydroxides, e.g., NaOH or KOH. Further preferred agents for neutralizing anionic surfactants of the present invention and adjunct anionic surfactants or cosurfactants in their acid forms include ammonia, amines, oligoamines, or alkanolamines. Alkanolamines are preferred. Suitable non-limiting examples including monoethanolamine, diethanolamine, triethanolamine, and other linear or branched alkanolamines known in the art; for example, highly preferred alkanolamines include 2-amino-1-propanol, 1-aminopropanol, monoisopropanolamine, or 1-amino-3-propanol. Amine neutralization may be done to a full or partial extent, e.g. part of the anionic surfactant mix may be neutralized with sodium or potassium and part of the anionic surfactant mix may be neutralized with amines or alkanolamines.

Suitable sulphonate surfactants include methyl ester sulphonates, alpha olefin sulphonates, alkyl benzene sulphonates, especially alkyl benzene sulphonates, preferably C10-13 alkyl benzene sulphonate, more preferably C12 alkyl benzene sulfonate. Suitable alkyl benzene sulphonate (LAS) is obtainable, preferably obtained, by sulphonating commercially available linear alkyl benzene (LAB). Suitable LAB includes low 2-phenyl LAB, such as those supplied by Sasol under the tradename Isochem® or those supplied by Petresa under the tradename Petrelab®, other suitable LAB include high 2-phenyl LAB, such as those supplied by Sasol under the tradename Hyblene®. A suitable anionic surfactant is alkyl benzene sulphonate that is obtained by DETAL catalyzed process, DETAL-PLUS catalyzed process, although other synthesis routes, such as HF, and other alkylation catalysts such as zeolites ZSM-4, ZSM-12, ZSM-20, ZSM-35, ZSM-48, ZSM-50, MCM-22, TMA offretite, TEA mordenite, mordenite, REY and zeolite Beta may also be suitable. In one aspect a magnesium salt of LAS is used.

Preferably, the composition may contain from about 0.5% to about 30%, by weight of the laundry detergent composition, of an HLAS surfactant selected from alkyl benzene sulfonic acids, alkali metal or amine salts of C10-16 alkyl benzene sulfonic acids, wherein the HLAS surfactant comprises greater than 50% C12, preferably greater than 60% C12, preferably greater than 70% C12, more preferably greater than 75% C12.

Suitable sulphate surfactants include alkyl sulphate, preferably $C_{8-18}$ alkyl sulphate, or predominantly $C_{12}$ alkyl sulphate.

A preferred sulphate surfactant is alkyl alkoxylated sulphate, preferably a $C_{8-18}$ alkyl alkoxylated sulphate, preferably a $C_{8-18}$ alkyl ethoxylated sulphate, preferably the alkyl alkoxylated sulphate has an average degree of alkoxylation of from 0.5 to 20, preferably from 0.5 to 10, preferably the alkyl alkoxylated sulphate is a $C_{8-18}$ alkyl ethoxylated sulphate having an average degree of ethoxylation of from 0.5 to 10, preferably from 0.5 to 5, more preferably from 0.5 to 3 or from about 1.5 to 3 or from about 1.8 to 2.5. The alkyl alkoxylated sulfate may have a broad alkoxy distribution or a peaked alkoxy distribution. The alkyl portion of the AES may include, on average, from 13.7 to about 16 or from 13.9 to 14.6 carbons atoms. At least about 50% or at least about 60% of the AES molecule may include having an alkyl portion having 14 or more carbon atoms, preferable from 14 to 18, or from 14 to 17, or from 14 to 16, or from 14 to 15 carbon atoms.

The alkyl sulphate, alkyl alkoxylated sulphate and alkyl benzene sulphonates may be linear or branched, including 2-alkyl substituted or mid chain branched type, substituted or un-substituted, and may be derived from petrochemical material or biomaterial. Preferably, the branching group is an alkyl. Typically, the alkyl is selected from methyl, ethyl, propyl, butyl, pentyl, cyclic alkyl groups and mixtures thereof. Single or multiple alkyl branches could be present on the main hydrocarbyl chain of the starting alcohol(s) used to produce the sulfated anionic surfactant used in the detergent of the invention. Most preferably the branched sulfated anionic surfactant is selected from alkyl sulfates, alkyl ethoxy sulfates, and mixtures thereof.

Alkyl sulfates and alkyl alkoxy sulfates are commercially available with a variety of chain lengths, ethoxylation and branching degrees. Commercially available sulfates include those based on Neodol alcohols ex the Shell company; Lial, Isalchem, Safol, Alfol®, Nacol®, Nafol®, Isofol®, and Marlipal® ex the Sasol company; and natural alcohols ex The Procter & Gamble Chemicals company.

Other suitable anionic surfactants include alkyl ether carboxylates, comprising a C10-C26 linear or branched, preferably C10-C20 linear, most preferably C16-C18 linear alkyl alcohol and from 2 to 20, preferably 7 to 13, more preferably 8 to 12, most preferably 9.5 to 10.5 ethoxylates. The acid form or salt form, such as sodium or ammonium salt, may be used, and the alkyl chain may contain one cis or trans double bond. Alkyl ether carboxylic acids are available from Kao (Akypo®), Huntsman (Empicol®) and Clariant (Emulsogen®).

Other suitable anionic surfactants include the class of glycolipids, such as sophorolipids and rhamnolipids and amino acid based surfactants, e.g., acyl glycinates, acyl sarcosinates, acyl glutamates, and acyl taurates. The rhamnolipids may have a single rhamnose sugar ring or two rhamnose sugar rings.

Non-Ionic Surfactant:

Suitable non-ionic surfactants are selected from the group consisting of: $C_8$-$C_{18}$ alkyl ethoxylates, such as, NEODOL® non-ionic surfactants from Shell; $C_6$-$C_{12}$ alkyl phenol alkoxylates wherein preferably the alkoxylate units are ethyleneoxy units, propyleneoxy units or a mixture thereof; $C_{12}$-$C_{18}$ alcohol and $C_6$-$C_{12}$ alkyl phenol condensates with ethylene oxide/propylene oxide block polymers such as Pluronic® from BASF; alkylpolysaccharides, preferably alkylpolyglycosides and alkyl polypentosides; fatty acid methyl ester ethoxylates; polyhydroxy fatty acid amides; ether capped poly(oxyalkylated) alcohol surfactants; alkyl and alkenyl furan sulfonates and alkyl and alkenyl furan sulfates, and mixtures thereof.

Suitable non-ionic surfactants are alkylpolyglucoside and/or an alkyl alkoxylated alcohol.

Suitable non-ionic surfactants include alkyl alkoxylated alcohols, preferably $C_{8-18}$ alkyl alkoxylated alcohol, preferably a $C_{8-18}$ alkyl ethoxylated alcohol, preferably the alkyl alkoxylated alcohol has an average degree of alkoxylation of from 1 to 50, preferably from 1 to 30, or from 1 to 20, or from 1 to 10, preferably the alkyl alkoxylated alcohol is a $C_{8-18}$ alkyl ethoxylated alcohol having an average degree of ethoxylation of from 1 to 10, preferably from 1 to 7, more preferably from 1 to 5 and most preferably from 3 to 7. In one aspect, the alkyl alkoxylated alcohol is a $C_{12-15}$ alkyl ethoxylated alcohol having an average degree of ethoxylation of from 7 to 10. The alkyl alkoxylated alcohol can be linear or branched, and substituted or un-substituted. Suitable nonionic surfactants include those with the trade name Lutensol® from BASF. The alkyl alkoxylated sulfate may have a broad alkoxy distribution for example Alfonic 1214-9 Ethoxylate or a peaked alkoxy distribution for example Novel 1214-9 both commercially available from Sasol.

Cationic Surfactant:

Suitable cationic surfactants include alkyl pyridinium compounds, alkyl quaternary ammonium compounds, alkyl quaternary phosphonium compounds, alkyl ternary sulphonium compounds, and mixtures thereof.

Preferred cationic surfactants are quaternary ammonium compounds having the general formula:

$$(R)(R_1)(R_2)(R_3)N^+X^-$$

wherein, R is a linear or branched, substituted or unsubstituted $C_{6-18}$ alkyl or alkenyl moiety, $R_1$ and $R_2$ are independently selected from methyl or ethyl moieties, $R_3$ is a hydroxyl, hydroxymethyl or a hydroxyethyl moiety, X is an anion which provides charge neutrality, preferred anions include: halides, preferably chloride; sulphate; and sulphonate.

The fabric care compositions of the present invention may contain up to about 30%, alternatively from about 0.01% to about 20%, more alternatively from about 0.1% to about 20%, by weight of the composition, of a cationic surfactant. For the purposes of the present invention, cationic surfactants include those which can deliver fabric care benefits. Non-limiting examples of useful cationic surfactants include: fatty amines, imidazoline quat materials and quaternary ammonium surfactants, preferably N, N-bis (stearoyl-oxy-ethyl) N,N-dimethyl ammonium chloride, N,N-bis(tallowoyl-oxy-ethyl) N,N-dimethyl ammonium chloride, N,N-bis(stearoyl-oxy-ethyl)N-(2 hydroxyethyl)N-methyl ammonium methylsulfate; 1,2 di (stearoyl-oxy) 3 trimethyl ammoniumpropane chloride; dialkylenedimethylammonium salts such as dicanoladimethylammonium chloride, di(hard)tallowdimethylammonium chloride dicanoladimethylammonium methyl sulfate; 1-methyl-1-stearoylamidoethyl-2-stearoylimidazolinium methyl sulfate; 1-tallowylamidoethyl-2-tallowylimidazoline; N,N"-dialkyldiethylenetriamine; the reaction product of N-(2-hydroxyethyl)-1,2-ethylenediamine or N-(2-hydroxyisopropyl)-1,2-ethylenediamine with glycolic acid, esterified with fatty acid, where the fatty acid is (hydrogenated) tallow fatty acid, palm fatty acid, hydrogenated palm fatty acid, oleic acid, rapeseed fatty acid, hydrogenated rapeseed fatty acid; polyglycerol esters (PGEs), oily sugar derivatives, and wax emulsions and a mixture of the above.

It will be understood that combinations of softener actives disclosed above are suitable for use herein.

Amphoteric and Zwitterionic Surfactant:

Suitable amphoteric or zwitterionic surfactants include amine oxides, and/or betaines. Preferred amine oxides are alkyl dimethyl amine oxide or alkyl amido propyl dimethyl amine oxide, more preferably alkyl dimethyl amine oxide and especially coco dimethyl amino oxide. Amine oxide may have a linear or mid-branched alkyl moiety. Typical linear amine oxides include water-soluble amine oxides containing one R1 C8-18 alkyl moiety and 2 R2 and R3 moieties selected from the group consisting of C1-3 alkyl groups and C1-3 hydroxyalkyl groups. Preferably amine oxide is characterized by the formula R1-N(R2)(R3) wherein R1 is a C8-18 alkyl and R2 and R3 are selected from the group consisting of methyl, ethyl, propyl, isopropyl, 2-hydroxethyl, 2-hydroxypropyl and 3-hydroxypropyl. The linear amine oxide surfactants in particular may include linear C10-C18 alkyl dimethyl amine oxides and linear C8-C12 alkoxy ethyl dihydroxy ethyl amine oxides.

Other suitable surfactants include betaines, such as alkyl betaines, alkylamidobetaine, amidazoliniumbetaine, sulfobetaine (INCI Sultaines) as well as Phosphobetaines.

Leuco Colorant Diluent

Another class of ingredients in the leuco colorants composition may be a diluent and/or solvent. The purpose of the diluent and/or solvent is often, but not limited to, improving fluidity and/or reducing the viscosity of the leuco colorant. Although water is often the preferred diluent and/or solvent given its low cost and non-toxicity, other solvent may also be used as well. The preferred solvent is one having low cost and low hazards. Examples of suitable solvents include, but are not limited to, ethylene glycol, propylene glycol, glycerin, alkoxylated polymers such as polyethylene glycol, polypropylene glycol, copolymers of ethylene oxide and propylene oxide, Tween 20®, Tween 40®, Tween 80®, and the like, and combinations thereof. Among the polymers, the ethylene oxide and propylene oxide copolymers may be preferred. These polymers often feature a cloud point with water, which can help the product separated from the water to remove the undesirable water soluble impurities. Examples of ethylene oxide and propylene oxide copolymers include but not limited to the PLURONIC series polymers by BASF and TERGITOL™ series polymer and by Dow. When the leuco colorant composition is incorporated into the laundry care composition, these polymers may also act as a non-ionic surfactant.

The laundry care compositions described herein may also include one or more of the following non-limiting list of ingredients: fabric care benefit agent; detersive enzyme; deposition aid; rheology modifier; builder; chelant; bleach; bleaching agent; bleach precursor; bleach booster; bleach catalyst; perfume and/or perfume microcapsules; perfume loaded zeolite; starch encapsulated accord; polyglycerol esters; whitening agent; pearlescent agent; enzyme stabilizing systems; scavenging agents including fixing agents for anionic dyes, complexing agents for anionic surfactants, and mixtures thereof; optical brighteners or fluorescers; polymer including but not limited to soil release polymer and/or soil suspension polymer; dispersants; antifoam agents; non-aqueous solvent; fatty acid; suds suppressors, e.g., silicone suds suppressors; cationic starches; scum dispersants; substantive dyes; colorants; opacifier; antioxidant; hydrotropes such as toluenesulfonates, cumenesulfonates and naphthalenesulfonates; color speckles; colored beads, spheres or extrudates; clay softening agents; anti-bacterial agents. Additionally or alternatively, the compositions may comprise surfactants, quaternary ammonium compounds, and/or solvent systems. Quaternary ammonium compounds may be present in fabric enhancer compositions, such as fabric softeners, and comprise quaternary ammonium cations that are positively charged polyatomic ions of the structure $NR_4^+$, where R is an alkyl group or an aryl group.

Hueing Dye

The composition may comprise an additional fabric shading agent. Suitable fabric shading agents include dyes, dye-clay conjugates, and pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof. Preferred dyes include alkoxylated azothiophenes, Solvent Violet 13, Acid Violet 50 and Direct Violet 9.

Aesthetic Colorants.

The composition may comprise one or more aesthetic colorants. Suitable aesthetic colorants include dyes, dye-clay conjugates, pigments, and Liquitint® polymeric colorants (Milliken & Company, Spartanburg, South Carolina, USA). In one aspect, suitable dyes and pigments include small molecule dyes and polymeric dyes. The aesthetic colorant may include at least one chromophore constituent selected from the group consisting of acridines, anthraquinones, azines, azos, benzodifuranes, benzodifuranones, carotenoids, coumarins, cyanines, diazahemicyanines, diphenylmethanes, formazans, hemicyanines, indigoids, methanes, methines, naphthalimides, naphthoquinones, nitros, nitrosos, oxazines, phenothiazine, phthalocyanines (such as copper phthalocyanines), pyrazoles, pyrazolones, quinolones, stilbenes, styryls, triarylmethanes (such as triphenylmethanes), xanthenes, and mixtures thereof.

In one aspect of the invention, aesthetic colorants include Liquitint® Blue AH, Liquitint® Blue BB, Liquitint® Blue 275, Liquitint® Blue 297, Liquitint® Blue BB, Cyan 15, Liquitint® Green 101, Liquitint® Orange 272, Liquitint® Orange 255, Liquitint® Pink AM, Liquitint® Pink AMC, Liquitint® Pink ST, Liquitint® Violet 129, Liquitint® Violet LS, Liquitint® Violet 291, Liquitint® Yellow FT, Liquitint® Blue Buf, Liquitint® Pink AM, Liquitint® Pink PV, Acid Blue 80, Acid Blue 182, Acid Red 33, Acid Red 52, Acid Violet 48, Acid Violet 126, Acid Blue 9, Acid Blue 1, and mixtures thereof.

Encapsulates.

The composition may comprise an encapsulated material. In one aspect, an encapsulate comprising a core, a shell having an inner and outer surface, said shell encapsulating said core. The core may comprise any laundry care adjunct, though typically the core may comprise material selected from the group consisting of perfumes; brighteners; hueing dyes; insect repellants; silicones; waxes; flavors; vitamins; fabric softening agents; skin care agents in one aspect, paraffins; enzymes; anti-bacterial agents; bleaches; sensates; and mixtures thereof and said shell may comprise a material selected from the group consisting of polyethylenes; polyamides; polyvinylalcohols, optionally containing other co-monomers; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof.

Preferred encapsulates comprise perfume. Preferred encapsulates comprise a shell which may comprise melamine formaldehyde and/or cross linked melamine formaldehyde. Other preferred capsules comprise a polyacrylate based shell. Preferred encapsulates comprise a core material and a shell, said shell at least partially surrounding said core material, is disclosed. At least 75%, 85% or even 90% of said encapsulates may have a fracture strength of from 0.2 MPa to 10 MPa, and a benefit agent leakage of from 0% to 20%, or even less than 10% or 5% based on total initial encapsulated benefit agent. Preferred are those in which at least 75%, 85% or even 90% of said encapsulates may have (i) a particle size of from 1 microns to 80 microns, 5 microns to 60 microns, from 10 microns to 50 microns, or even from 15 microns to 40 microns, and/or (ii) at least 75%, 85% or even 90% of said encapsulates may have a particle wall thickness of from 30 nm to 250 nm, from 80 nm to 180 nm, or even from 100 nm to 160 nm. Formaldehyde scavengers may be employed with encapsulates, for example, in a capsule slurry and/or added to a composition before, during or after the encapsulates are added to such composition. Suitable capsules that can be made by following the teaching of USPA 2008/0305982 A1; and/or USPA 2009/0247449 A1. Alternatively, suitable capsules can be purchased from Appleton Papers Inc. of Appleton, Wis. USA.

In a preferred aspect the composition may comprise a deposition aid, preferably in addition to encapsulates. Preferred deposition aids are selected from the group consisting of cationic and nonionic polymers. Suitable polymers include cationic starches, cationic hydroxyethylcellulose, polyvinylformaldehyde, locust bean gum, mannans, xyloglucans, tamarind gum, polyethyleneterephthalate and polymers containing dimethylaminoethyl methacrylate, optionally with one or more monomers selected from the group comprising acrylic acid and acrylamide.

Perfume.

Preferred compositions of the invention comprise perfume. Typically the composition comprises a perfume that comprises one or more perfume raw materials, selected from the group as described in WO08/87497. However, any perfume useful in a laundry care composition may be used. A preferred method of incorporating perfume into the compositions of the invention is via an encapsulated perfume particle comprising either a water-soluble hydroxylic compound or melamine-formaldehyde or modified polyvinyl alcohol.

Malodor Reduction Materials

The cleaning compositions of the present disclosure may comprise malodour reduction materials. Such materials are capable of decreasing or even eliminating the perception of one or more malodors. These materials can be characterized by a calculated malodor reduction value ("MORV"), which is calculated according to the test method shown in WO2016/049389.

As used herein "MORV" is the calculated malodor reduction value for a subject material. A material's MORV indicates such material's ability to decrease or even eliminate the perception of one or more malodors.

The cleaning compositions of the present disclosure may comprise a sum total of from about 0.00025% to about 0.5%, preferably from about 0.0025% to about 0.1%, more preferably from about 0.005% to about 0.075%, most preferably from about 0.01% to about 0.05%, by weight of the composition, of 1 or more malodor reduction materials. The cleaning composition may comprise from about 1 to about 20 malodor reduction materials, more preferably 1 to about 15 malodor reduction materials, most preferably 1 to about 10 malodor reduction materials.

One, some, or each of the malodor reduction materials may have a MORV of at least 0.5, preferably from 0.5 to 10, more preferably from 1 to 10, most preferably from 1 to 5. One, some, or each of the malodor reduction materials may have a Universal MORV, defined as all of the MORV values of >0.5 for the malodors tested as described herein. The sum total of malodor reduction materials may have a Blocker Index of less than 3, more preferable less than about 2.5, even more preferably less than about 2, and still more preferably less than about 1, and most preferably about 0. The sum total of malodor reduction materials may have a Blocker Index average of from about 3 to about 0.001.

In the cleaning compositions of the present disclosure, the malodor reduction materials may have a Fragrance Fidelity Index of less than 3, preferably less than 2, more preferably less than 1 and most preferably about 0 and/or a Fragrance Fidelity Index average of 3 to about 0.001 Fragrance Fidelity Index. As the Fragrance Fidelity Index decreases, the malodor reduction material(s) provide less and less of a scent impact, while continuing to counteract malodors.

The cleaning compositions of the present disclosure may comprise a perfume. The weight ratio of parts of malodor reduction composition to parts of perfume may be from about 1:20,000 to about 3000:1, preferably from about 1:10,000 to about 1,000:1, more preferably from about 5,000:1 to about 500:1, and most preferably from about 1:15 to about 1:1. As the ratio of malodor reduction composition to parts of perfume is tightened, the malodor reduction material(s) provide less and less of a scent impact, while continuing to counteract malodors.

Polymers.

The composition may comprise one or more polymers. Examples are optionally modified carboxymethylcellulose, modified polyglucans, poly(vinyl-pyrrolidone), poly (ethylene glycol), poly(vinyl alcohol), poly(vinylpyridine-N-oxide), poly(vinylimidazole), polycarboxylates such as polyacrylates, maleic/acrylic acid copolymers and lauryl methacrylate/acrylic acid co-polymers.

The composition may comprise one or more amphiphilic cleaning polymers. Such polymers have balanced hydrophilic and hydrophobic properties such that they remove grease particles from fabrics and surfaces. Suitable amphiphilic alkoxylated grease cleaning polymers comprise a core structure and a plurality of alkoxylate groups attached to that core structure. These may comprise alkoxylated polyalkylenimines, especially ethoxylated polyethylene imines or polyethyleneimines having an inner polyethylene oxide block and an outer polypropylene oxide block. Typically, these may be incorporated into the compositions of the invention in amounts of from 0.005 to 10 wt %, generally from 0.5 to 8 wt %.

Zwitterionic Polyamine:

The composition may comprise a zwitterionic polyamine that is a modified hexamethylenediamine. The modification of the hexamethylenediamine includes: (1) one or two alkoxylation modifications per nitrogen atom of the hexamethylenediamine. The alkoxylation modification consisting of the replacement of a hydrogen atom on the nitrogen of the hexamethylenediamine by a (poly)alkoxylene chain having an average of about 1 to about 40 alkoxy moieties per modification, wherein the terminal alkoxy moiety of the alkoxylene chain is capped with hydrogen, a C1-C4 alkyl, sulfates, carbonates, or mixtures thereof; (2) a substitution of one C1-C4 alkyl moiety and one or two alkoxylation modifications per nitrogen atom of the hexamethylenediamine. The alkoxylation modification consisting of the replacement of a hydrogen atom by a (poly)alkoxylene chain having an average of about 1 to about 40 alkoxy moieties per modification wherein the terminal alkoxy moiety of the alkoxylene chain is capped with hydrogen, a C1-C4 alkyl or mixtures thereof; or (3) a combination thereof Amphiphilic Graft Copolymer:

Other suitable polymers include amphiphilic graft copolymers. Preferred amphiphilic graft co-polymer(s) comprise (i) polyethyelene glycol backbone; and (ii) and at least one pendant moiety selected from polyvinyl acetate, polyvinyl alcohol and mixtures thereof. An example of amphiphilic graft co-polymer is Sokalan HP22, supplied from BASF. Other suitable polymers include random graft copolymers, preferably a polyvinyl acetate grafted polyethylene oxide copolymer having a polyethylene oxide backbone and multiple polyvinyl acetate side chains. The molecular weight of the polyethylene oxide backbone is preferably about 6000 and the weight ratio of the polyethylene oxide to polyvinyl acetate is about 40 to 60 and less than or equal to 1 grafting point per 50 ethylene oxide units. Typically, these are incorporated into the compositions of the invention in amounts from 0.005 to 10 wt %, more usually from 0.05 to 8 wt %.

Soil Release Polymers:

The composition may comprise one or more soil release polymers. Examples include soil release polymers having a structure as defined by one of the following Formula (VI), (VII) or (VIII):

$$—[(OCHR^1—CHR^2)_a—O—OC—Ar—CO—]_d \quad (VI)$$

$$—[(OCHR^3—CHR^4)_b—O—OC\text{-}sAr—CO—]_e \quad (VII)$$

$$—[(OCHR^5—CHR^6)_c—OR^7]_f \quad (VIII)$$

wherein:

a, b and c are from 1 to 200;

d, e and f are from 1 to 50;

Ar is a 1,4-substituted phenylene;

sAr is 1,3-substituted phenylene substituted in position 5 with $SO_3Me$;

Me is Na, Li, K, Mg/2, Ca/2, Al/3, ammonium, mono-, di-, tri-, or tetraalkylammonium wherein the alkyl groups are $C_1$-$C_{18}$ alkyl or $C_2$-$C_{10}$ hydroxyalkyl, or mixtures thereof;

$R^1$, $R^2$, $R^3$, $R^4$, $R^5$ and $R^6$ are independently selected from H or $C_1$-$C_{18}$n- or iso-alkyl; and $R^7$ is a linear or branched $C_1$-$C_{18}$ alkyl, or a linear or branched $C_2$-$C_{30}$ alkenyl, or a cycloalkyl group with 5 to 9 carbon atoms, or a $C_8$-$C_{30}$ aryl group, or a $C_6$-$C_{30}$ arylalkyl group.

Suitable soil release polymers are polyester soil release polymers such as Repel-o-tex polymers, including Repel-o-tex SF, SF-2 and SRP6 supplied by Rhodia. Other suitable soil release polymers include Texcare polymers, including Texcare SRA100, SRA300, SRN100, SRN170, SRN240, SRN260, SRN300 and SRN325 supplied by Clariant. Other suitable soil release polymers are Marloquest polymers, such as Marloquest SL supplied by Sasol.

Known polymeric soil release agents, hereinafter "SRA" or "SRA's", can optionally be employed in the present detergent compositions. If utilized, SRA's will generally comprise from 0.01% to 10.0%, typically from 0.1% to 5%, preferably from 0.2% to 3.0% by weight, of the composition.

SRA's can include, for example, a variety of charged, e.g., anionic or even cationic (see U.S. Pat. No. 4,956,447), as well as noncharged monomer units and structures may be linear, branched or even star-shaped. Examples of SRAs are described in U.S. Pat. Nos. 4,968,451; 4,711,730; 4,721,580; 4,702,857; 4,877,896; 3,959,230; 3,893,929; 4,000,093; 5,415,807; 4,201,824; 4,240,918; 4,525,524; 4,201,824; 4,579,681; and 4,787,989; European Patent Application 0 219 048; 279,134 A; 457,205 A; and DE 2,335,044.

Carboxylate Polymer:

The composition may comprise a carboxylate polymer, such as a maleate/acrylate random copolymer or polyacrylate homopolymer. Suitable carboxylate polymers include: polyacrylate homopolymers having a molecular weight of from 4,000 Da to 9,000 Da; maleate/acrylate random copolymers having a molecular weight of from 50,000 Da to 100,000 Da, or from 60,000 Da to 80,000 Da.

Alternatively, these materials may comprise polyacrylates having one ethoxy side-chain per every 7-8 acrylate units. The side-chains are of the formula $—(CH_2CH_2O)_m(CH_2)_nCH_3$ wherein m is 2-3 and n is 6-12. The side-chains are ester-linked to the polyacrylate "backbone" to provide a "comb" polymer type structure. The molecular weight can vary, but is typically in the range of about 2000 to about 50,000. Such alkoxylated polycarboxylates can comprise from about 0.05% to about 10%, by weight, of the compositions herein.

Such carboxylate based polymers can advantageously be utilized at levels from about 0.1% to about 7%, by weight, in the compositions herein. Suitable polymeric dispersing agents include carboxylate polymer such as a maleate/acrylate random copolymer or polyacrylate homopolymer. Preferably the carboxylate polymer is a polyacrylate homopolymer having a molecular weight of from 4,000 Daltons to 9,000 Daltons, or maleate/acrylate copolymer with a molecular weight 60,000 Daltons to 80,000 Daltons. Polymeric polycarboxylates and polyethylene glycols, can also be used. Polyalkylene glycol-based graft polymer may prepared from the polyalkylene glycol-based compound and the monomer material, wherein the monomer material includes the carboxyl group-containing monomer and the optional additional monomer(s). Optional additional monomers not classified as a carboxyl group-containing monomer include sulfonic acid group-containing monomers, amino group-containing monomers, allylamine monomers, quaternized allylamine monomers, N vinyl monomers, hydroxyl group-containing monomers, vinylaryl monomers, isobutylene monomers, vinyl acetate monomers, salts of any of these, derivatives of any of these, and mixtures thereof.

Alkoxylated Polyamine-Based Polymers:

The composition may comprise alkoxylated polyamines. Such materials include but are not limited to ethoxylated polyethyleneimine, ethoxylated hexamethylene diamine, and sulfated versions thereof. Polypropoxylated derivatives are also included. A wide variety of amines and polyaklyeneimines can be alkoxylated to various degrees, and optionally further modified to provide the abovementioned benefits. A useful example is 600 g/mol polyethyleneimine core ethoxylated to 20 EO groups per NH. A preferred ethoxylated polyethyleneimine is PE-20 available from BASF Useful alkoxylated polyamine based polymers include the alkoxylated polyethylene imine type where said alkoxylated polyalkyleneimine has a polyalkyleneimine core with one or more side chains bonded to at least one nitrogen atom in the polyalkyleneimine core, wherein said alkoxylated polyalkyleneimine has an empirical formula (I) of $(PEI)_a$-$(EO)_b$—$R_1$, wherein a is the average number-average molecular weight ($MW_{PEI}$) of the polyalkyleneimine core of the alkoxylated polyalkyleneimine and is in the range of from 100 to 100,000 Daltons, wherein b is the average degree of ethoxylation in said one or more side chains of the alkoxylated polyalkyleneimine and is in the range of from 5 to 40, and wherein $R_1$ is independently selected from the group consisting of hydrogen, $C_1$-$C_4$ alkyls, and combinations thereof.

Other suitable alkoxylated polyalkyleneimine include those wherein said alkoxylated polyalkyleneimine has a polyalkyleneimine core with one or more side chains bonded to at least one nitrogen atom in the polyalkyleneimine core, wherein the alkoxylated polyalkyleneimine has an empirical formula (II) of $(PEI)_o$-$(EO)_m(PO)_n$—$R_2$ or $(PEI)_o$-$(PO)_n(EO)_m$—$R_2$, wherein o is the average number-average molecular weight ($MW_{PEI}$) of the polyalkyleneimine core of the alkoxylated polyalkyleneimine and is in the range of from 100 to 100,000 Daltons, wherein m is the average degree of ethoxylation in said one or more side chains of the alkoxylated polyalkyleneimine which ranges from 10 to 50, wherein n is the average degree of propoxylation in said one or more side chains of the alkoxylated polyalkyleneimine which ranges from 1 to 50, and wherein $R_2$ is independently selected from the group consisting of hydrogen, $C_1$-$C_4$ alkyls, and combinations thereof.

Cellulosic Polymer:

Cellulosic polymers may be used according to the invention. Suitable cellulosic polymers are selected from alkyl cellulose, alkyl alkoxyalkyl cellulose, carboxyalkyl cellulose, alkyl carboxyalkyl cellulose, sulphoalkyl cellulose, more preferably selected from carboxymethyl cellulose, methyl cellulose, methyl hydroxyethyl cellulose, methyl carboxymethyl cellulose, and mixtures thereof. Suitable carboxymethyl celluloses have a degree of carboxymethyl substitution from 0.5 to 0.9 and a molecular weight from 100,000 Da to 300,000 Da. Suitable carboxymethyl celluloses have a degree of substitution greater than 0.65 and a degree of blockiness greater than 0.45, e.g. as described in WO09/154933.

The consumer products of the present invention may also include one or more cellulosic polymers including those selected from alkyl cellulose, alkylalkoxyalkyl cellulose, carboxyalkyl cellulose, alkyl carboxyalkyl cellulose. In one aspect, the cellulosic polymers are selected from the group comprising carboxymethyl cellulose, methyl cellulose, methyl hydroxyethyl cellulose, methyl carboxymethyl cellulose, and mixtures thereof. In one aspect, the carboxymethyl cellulose has a degree of carboxymethyl substitution from 0.5 to 0.9 and a molecular weight from 100,000 Da to 300,000 Da. Examples of carboxymethylcellulose polymers are Carboxymethyl cellulose commercially sold by CPKelko as Finnfix® GDA, hydrophobically modified carboxymethyl cellulose, for example the alkyl ketene dimer derivative of carboxymethylcellulose sold commercially by CPKelco as Finnfix®SH1, or the blocky carboxymethylcellulose sold commercially by CPKelco as Finnfix®V.

Cationic Polymers:

Cationic polymers may also be used according to the invention. Suitable cationic polymers will have cationic charge densities of at least 0.5 meq/gm, in another embodiment at least 0.9 meq/gm, in another embodiment at least 1.2 meq/gm, in yet another embodiment at least 1.5 meq/gm, but in one embodiment also less than 7 meq/gm, and in another embodiment less than 5 meq/gm, at the pH of intended use of the composition, which pH will generally range from pH 3 to pH 9, in one embodiment between pH 4 and pH 8. Herein, "cationic charge density" of a polymer refers to the ratio of the number of positive charges on the polymer to the molecular weight of the polymer. The average molecular weight of such suitable cationic polymers will generally be between 10,000 and 10 million, in one embodiment between 50,000 and 5 million, and in another embodiment between 100,000 and 3 million.

Suitable cationic polymers for use in the compositions of the present invention contain cationic nitrogen-containing moieties such as quaternary ammonium or cationic protonated amino moieties. Any anionic counterions can be used in association with the cationic polymers so long as the polymers remain soluble in water, in the composition, or in a coacervate phase of the composition, and so long as the counterions are physically and chemically compatible with the essential components of the composition or do not otherwise unduly impair product performance, stability or aesthetics. Nonlimiting examples of such counterions include halides (e.g., chloride, fluoride, bromide, iodide), sulfate and methylsulfate.

Nonlimiting examples of such polymers are described in the CTFA Cosmetic Ingredient Dictionary, 3rd edition, edited by Estrin, Crosley, and Haynes, (The Cosmetic, Toiletry, and Fragrance Association, Inc., Washington, D.C. (1982)).

Especially useful cationic polymers which may be used according to the invention include wherein said cationic polymer comprises a polymer selected from the group consisting of cationic celluloses, cationic guars, poly(acrylamide-co-diallyldimethylammonium chloride), poly(acrylamide-co-di allyldimethylammonium chloride-co-acrylic acid), poly(acrylamide-co-methacryloamidopropyl-pentamethyl-1,3-propylene-2-ol-ammonium dichloride), poly(acrylamide-co-N,N-dimethylaminoethyl acrylate) and its quaternized derivatives, poly(acrylamide-co-N,N-dimethylaminoethyl methacrylate) and its quaternized derivatives, poly(acrylamide-methacrylamidopropyltrimethyl ammonium chloride), poly(acrylamide-methacrylamidopropyltrimethyl ammonium chloride-co-acrylic acid), poly(diallyldimethyl ammonium chloride), poly(diallyldimethylammonium chloride-co-acrylic acid), poly(ethyl methacrylate-co-oleyl methacrylate-co-di ethylaminoethyl methacrylate) and its quaternized derivatives, poly(ethyl methacrylate-co-dimethylaminoethyl methacrylate) and its quaternized derivatives, poly(hydroxpropylacrylate-co-methacrylamidopropyltrimethylammonium chloride) and its quaternized derivatives, poly(hydroxyethylacrylate-co-dimethyl aminoethyl methacrylate) and its quaternized derivatives, poly(methylacrylamide-co-dimethylaminoethyl acrylate) and its quaternized derivatives, poly(methacrylate-co-methacrylamidopropyltrimethyl ammonium chloride), poly (vinylformamide-co-acrylic acid-co-diallyldimethylammonium chloride), poly(vinylformamide-co-diallyldimethylammonium chloride), poly (vinylpyrrolidone-co-acrylamide-co-vinyl imidazole) and its quaternized derivatives, poly(vinylpyrrolidone-co-dimethylaminoethyl methacrylate) and its quaternized derivatives, poly(vinylpyrrolidone-co-methacrylamide-co-vinyl imidazole) and its quaternized derivatives, poly(vinylpyrrolidone-co-vinyl imidazole) and its quaternized derivatives, polyethyleneimine and including its quaternized derivatives, and mixtures thereof.

Other suitable cationic polymers for use in the composition include polysaccharide polymers, cationic guar gum derivatives, quaternary nitrogen-containing cellulose ethers, synthetic polymers, copolymers of etherified cellulose, guar and starch. When used, the cationic polymers herein are either soluble in the composition or are soluble in a complex coacervate phase in the composition formed by the cationic polymer and the anionic, amphoteric and/or zwitterionic surfactant component described hereinbefore. Complex coacervates of the cationic polymer can also be formed with other charged materials in the composition.

Suitable cationic polymers are described in U.S. Pat. Nos. 3,962,418; 3,958,581; and U.S. Publication No. 2007/0207109A1.

Dye Transfer Inhibitor (DTI).

The composition may comprise one or more dye transfer inhibiting agents. In one embodiment of the invention the inventors have surprisingly found that compositions comprising polymeric dye transfer inhibiting agents in addition to the specified dye give improved performance. This is surprising because these polymers prevent dye deposition. Suitable dye transfer inhibitors include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof. Suitable examples include PVP-K15, PVP-K30, ChromaBond S-400, ChromaBond S-403E and Chromabond S-100 from Ashland Aqualon, and Sokalan HP165, Sokalan HP50, Sokalan HP53, Sokalan HP59, Sokalan® HP 56K, Sokalan® HP 66 from BASF. The dye control agent may be selected from (i) a sulfonated phenol/formaldehyde polymer; (ii) a urea derivative; (iii) polymers of ethylenically unsaturated monomers, where the polymers are molecularly imprinted with dye; (iv) fibers consisting of water-insoluble polyamide, wherein the fibers have an average diameter of not more than about 2 μm; (v) a polymer obtainable from polymerizing benzoxazine monomer compounds; and (vi) combinations thereof. Other suitable DTIs are as described in WO2012/004134. When present in a subject composition, the dye transfer inhibiting agents may be present at levels from about 0.0001% to about 10%, from about 0.01% to about 5% or even from about 0.1% to about 3% by weight of the composition.

Other Water Soluble Polymers:

Examples of water soluble polymers include but are not limited to polyvinyl alcohols (PVA), modified PVAs; polyvinyl pyrrolidone; PVA copolymers such as PVA/polyvinyl pyrrolidone and PVA/polyvinyl amine; partially hydrolyzed polyvinyl acetate; polyalkylene oxides such as polyethylene oxide; polyethylene glycols; acrylamide; acrylic acid; cellulose, alkyl cellulosics such as methyl cellulose, ethyl cellulose and propyl cellulose; cellulose ethers; cellulose esters; cellulose amides; polyvinyl acetates; polycarboxylic acids and salts; polyaminoacids or peptides; polyamides; polyacrylamide; copolymers of maleic/acrylic acids; polysaccharides including starch, modified starch; gelatin; alginates; xyloglucans, other hemicellulosic polysaccharides including xylan, glucuronoxylan, arabinoxylan, mannan, glucomannan and galactoglucomannan; and natural gums such as pectin, xanthan, and carrageenan, locus bean, arabic, tragacanth; and combinations thereof Oligoamines:

Non-limiting examples of amines include, but are not limited to, etheramines, cyclic amines, polyamines, oligoamines (e.g., triamines, diamines, pentamines, tetraamines), or combinations thereof. The compositions described herein may comprise an amine selected from the group consisting of oligoamines, etheramines, cyclic amines, and combinations thereof. In some aspects, the amine is not an alkanolamine. In some aspects, the amine is not a polyalkyleneimine.

Examples of suitable oligoamines include Preferably the composition comprises oligoamines. Suitable oligoamines according to the present disclosure may include diethylenetriamine (DETA), 4-methyl diethylenetriamine (4-MeDETA), dipropylenetriamine (DPTA), 5-methyl dipropylenetriamine (5-MeDPTA), triethylenetetraamine (TETA), 4-methyl triethylenetetraamine (4-MeTETA), 4,7-dimethyl triethylenetetraamine (4,7-Me2TETA), 1,1,4,7,7-pentamethyl diethylenetriamine (M5-DETA), tripropylenetetraamine (TPTA), tetraethylenepentaamine (TEPA), tetrapropylenepentaamine (TPPA), pentaethylenehexaamine (PEHA), pentapropylenehexaamine (PPHA), hexaethyleneheptaamine (HEHA), hexapropyleneheptaamine (HPHA), N,N'-Bis(3-aminopropyl)ethylenediamine, 1,1,4,7,7-pentamethyl diethylenetriamine (M5-DETA), dipropylenetriamine (DPTA) or mixtures thereof most preferably diethylenetriamine (DETA). DETA may be preferred due to its low molecular weight and/or relatively low cost to produce.

The oligoamines of the present disclosure may have a molecular weight of between about 100 to about 1200 Da, or from about 100 to about 900 Da, or from about 100 to about 600 Da, or from about 100 to about 400 Da, preferably between about 100 Da and about 250 Da, most preferably between about 100 Da and about 175 Da, or even between about 100 Da and about 150 Da. For purposes of the present disclosure, the molecular weight is determined using the free base form of the oligoamine.

Etheramines:

The cleaning compositions described herein may contain an etheramine. The cleaning compositions may contain from about 0.1% to about 10%, or from about 0.2% to about 5%, or from about 0.5% to about 4%, by weight of the composition, of an etheramine.

The etheramines of the present disclosure may have a weight average molecular weight of less than about grams/mole 1000 grams/mole, or from about 100 to about 800 grams/mole, or from about 200 to about 450 grams/mole, or from about 290 to about 1000 grams/mole, or from about 290 to about 900 grams/mole, or from about 300 to about 700 grams/mole, or from about 300 to about 450 grams/mole. The etheramines of the present invention may have a weight average molecular weight of from about 150, or from about 200, or from about 350, or from about 500 grams/mole, to about 1000, or to about 900, or to about 800 grams/mole.

Alkoxylated Phenol Compound:

The cleaning compositions of the present disclosure may include an alkoxylated phenol compound. The alkoxylated phenol compound may be selected from the group consisting of an alkoxylated polyaryl phenol compound, an alkoxylated polyalkyl phenol compound, an alkoxylated monoalkyl phenol, and mixtures thereof. The alkoxylated phenol compound may be an alkoxylated polyaryl phenol compound. The alkoxylated phenol compound may be an alkoxylated polyalkyl phenol compound.

The alkoxylated phenol compound may be present in the cleaning composition at a level of from about 0.2% to about 10%, or from about 0.5% to about 5%, by weight of the cleaning composition.

The alkoxylated phenol compound may have a weight average molecular weight between 280 and 2880.

Enzymes.

Preferably the composition comprises one or more enzymes. Preferred enzymes provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, mannanases, pectate lyases, keratinases, reductases, oxidases, phenoloxidases, lipoxygenases, ligninases, pullulanases, tannases, pentosanases, malanases, ß-glucanases, arabinosidases, hyaluronidase, chondroitinase, laccase, and amylases, or mixtures thereof. A typical combination is an enzyme cocktail that may comprise, for example, a protease and lipase in conjunction with amylase. When present in the composition, the aforementioned additional enzymes may be present at levels from about 0.00001% to about 2%, from about 0.0001% to about 1% or even from about 0.001% to about 0.5% enzyme protein by weight of the composition.

Protease

The composition of the invention can comprise a protease in addition to the protease of the invention. A mixture of two or more proteases can contribute to an enhanced cleaning across a broader temperature, cycle duration, and/or substrate range, and provide superior shine benefits, especially when used in conjunction with an anti-redeposition agent and/or a sulfonated polymer.

Suitable proteases for use in combination with the variant proteases of the invention include metalloproteases and serine proteases, including neutral or alkaline microbial serine proteases, such as subtilisins (EC 3.4.21.62). Suitable proteases include those of animal, vegetable or microbial origin. In one aspect, such suitable protease may be of microbial origin. The suitable proteases include chemically or genetically modified mutants of the aforementioned suitable proteases. In one aspect, the suitable protease may be a serine protease, such as an alkaline microbial protease or/and a trypsin-type protease. Examples of suitable neutral or alkaline proteases include:

(a) subtilisins (EC 3.4.21.62), especially those derived from *Bacillus*, such as *Bacillus* sp., *B. lentus, B. alkalophilus, B. subtilis, B. amyloliquefaciens, B. pumilus, B. gibsonii*, and *B. akibaii* described in WO2004067737, WO2015091989, WO2015091990, WO2015024739, WO2015143360, U.S. Pat. No. 6,312,936 B1, U.S. Pat. Nos. 5,679,630, 4,760,025, DE102006022216A1, DE102006022224A1, WO2015089447, WO2015089441, WO2016066756, WO2016066757, WO2016069557, WO2016069563, WO2016069569 and WO2016174234. Specifically, mutations S9R, A15T, V66A, A188P, V1991, Q239R, N255D (savinase numbering system).

(b) trypsin-type or chymotrypsin-type proteases, such as trypsin (e.g., of porcine or bovine origin), including the *Fusarium* protease described in WO 89/06270 and the chymotrypsin proteases derived from Cellumonas described in WO 05/052161 and WO 05/052146.

(c) metalloproteases, especially those derived from *Bacillus amyloliquefaciens* decribed in WO07/044993A2; from *Bacillus, Brevibacillus, Thermoactinomyces, Geobacillus, Paenibacillus*, Lysinibacillus or *Streptomyces* spp. Described in WO2014194032, WO2014194054 and WO2014194117; from Kribella alluminosa described in WO2015193488; and from *Streptomyces* and Lysobacter described in WO2016075078.

(d) protease having at least 90% identity to the subtilase from *Bacillus* sp. TY145, NCIMB 40339, described in WO92/17577 (Novozymes A/S), including the variants of this *Bacillus* sp TY145 subtilase described in WO2015024739, and WO2016066757.

Especially preferred additional proteases for the detergent of the invention are polypeptides as illustrated in WO00/37627, which is incorporated herein by reference.

Suitable commercially available additional protease enzymes include those sold under the trade names Alcalase®, Savinase®, Primase®, Durazym®, Polarzyme®, Kannase®, Liquanase®, Liquanase Ultra®, Savinase Ultra®, Ovozyme®, Neutrase®, Everlase®, Coronase®, Blaze®, Blaze Ultra® and Esperase® by Novozymes A/S (Denmark); those sold under the tradename Maxatase®, Maxacal®, Maxapem®, Properase®, Purafect®, Purafect Prime®, Purafect Ox®, FN3®, FN4®, Excellase®, Ultimase® and Purafect OXP® by Dupont; those sold under the tradename Opticlean® and Optimase® by Solvay Enzymes; and those available from Henkel/Kemira, namely BLAP, BLAP R and BLAP F49; and KAP from Kao.

Especially preferred for use herein in combination with the variant protease of the invention are commercial proteases selected from the group consisting of Properase®, Blaze®, Ultimase®, Everlase®, Savinase®, Excellase®, Blaze Ultra®, BLAP and BLAP variants.

Preferred levels of protease in the product of the invention include from about 0.05 to about 10, more preferably from about 0.5 to about 7 and especially from about 1 to about 6 mg of active protease/g of composition.

Amylases

Preferably the composition of the invention may comprise an amylase. Suitable alpha-amylases include those of bacterial or fungal origin. Chemically or genetically modified mutants (variants) are included. A preferred alkaline alpha-amylase is derived from a strain of *Bacillus*, such as *Bacillus licheniformis, Bacillus amyloliquefaciens, Bacillus stearothermophilus, Bacillus subtilis*, or other *Bacillus* sp., such as *Bacillus* sp. NCBI 12289, NCBI 12512, NCBI 12513, DSM 9375 (U.S. Pat. No. 7,153,818) DSM 12368, DSMZ no. 12649, KSM AP1378 (WO 97/00324), KSM K36 or KSM K38 (EP 1,022,334). Preferred amylases include:

(a) variants described in U.S. Pat. No. 5,856,164 and WO99/23211, WO 96/23873, WO00/60060, WO06/002643 and WO2017/192657, (b) variants described in WO2011/100410 and WO2013/003659.

(c) variants in U.S. Pat. No. 6,093,562.

(d) variants described in WO 09/149130.

(e) variants described in WO10/115021.

(f) variants in WO2016091688.

(g) variants described in WO2014099523.

(h) variants in WO2009149271.

(j) variants described in WO2016180748.

(k) variants described in WO2018060216.

Preferably the amylase is an engineered enzyme, wherein one or more of the amino acids prone to bleach oxidation have been substituted by an amino acid less prone to oxidation. In particular it is preferred that methionine residues are substituted with any other amino acid. In particular it is preferred that the methionine most prone to oxidation is substituted.

Suitable commercially available alpha-amylases include DURAMYL®, LIQUEZYME®, TERMAMYL®, TERMAMYL ULTRA®, NATALASE®, SUPRAMYL®, STAINZYME®, STAINZYME PLUS®, FUNGAMYL®, ATLANTIC®, ACHIEVE ALPHA®, AMPLIFY® PRIME, INTENSA® and BAN® (Novozymes A/S, Bagsvaerd, Denmark), KEMZYM® AT 9000 Biozym Biotech Trading GmbH Wehlistrasse 27b A-1200 Wien Austria, RAPIDASE®, PURASTAR®, ENZYSIZE®, OPTISIZE HT PLUS®, POWERASE®, PREFERENZ S® series (including PREFERENZ S1000® and PREFERENZ 52000® and PURASTAR OXAM® (DuPont, Palo Alto, Calif.) and KAM® (Kao, 14-10 Nihonbashi Kayabacho, 1-chome, Chuo-ku Tokyo 103-8210, Japan).

Preferably, the product of the invention comprises at least 0.01 mg, preferably from about 0.05 to about 10, more preferably from about 0.1 to about 6, especially from about 0.2 to about 5 mg of active amylase/g of composition.

Preferably, the protease and/or amylase of the composition of the invention are in the form of granulates, the granulates comprise more than 29% of sodium sulfate by weight of the granulate and/or the sodium sulfate and the active enzyme (protease and/or amylase) are in a weight ratio of between 3:1 and 100:1 or preferably between 4:1 and 30:1 or more preferably between 5:1 and 20:1.

Lipase

The enzyme system preferably further comprises a lipase. The presence of oils and/or grease can further increase the resiliency of stains comprising mannans and other polysaccharides. As such, the presence of lipase in the enzyme package can further improve the removal of such stains. Suitable lipases include those of bacterial, fungal or synthetic origin, and variants thereof. Chemically modified or protein engineered mutants are also suitable. Examples of suitable lipases include lipases from *Humicola* (synonym *Thermomyces*), e.g., from *H. lanuginosa* (*T. lanuginosus*).

The lipase may be a "first cycle lipase", e.g. such as those described in WO06/090335 and WO 13/116261. In one aspect, the lipase is a first-wash lipase, preferably a variant of the wild-type lipase from *Thermomyces lanuginosus* comprising T231R and/or N233R mutations. Preferred lipases include those sold under the tradenames Lipex®, Lipolex® and Lipoclean® by Novozymes, Bagsvaerd, Denmark.

Other suitable lipases include: Liprl 139, e.g. as described in WO2013/171241; TfuLip2, e.g. as described in WO2011/084412 and WO2013/033318; *Pseudomonas stutzeri* lipase, e.g. as described in WO2018228880; *Microbulbifer thermotolerans* lipase, e.g. as described in WO2018228881; *Sulfobacillus acidocaldarius* lipase, e.g. as described in EP3299457; LIP062 lipase e.g. as described in WO2018209026; PinLip lipase e.g. as described in WO2017036901 and *Absidia* sp. lipase e.g. as described in WO2017005798.

Suitable lipases are commercially available from Novozymes, for example as Lipex Evity 100 L, Lipex Evity 200 L (both liquid raw materials) and Lipex Evity 105T (a granulate). These lipases have different structures to the products Lipex 100 L, Lipex 100T and Lipex Evity 100T which are outside the scope of the invention.

Cellulases

The consumer products can comprise cellulases of bacterial or fungal origin. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum* disclosed in U.S. Pat. Nos. 4,435,307, 5,648,263, 5,691,178, 5,776,757 and 5,691,178. Suitable cellulases include the alkaline or neutral cellulases having colour care benefits. Commercially available cellulases include CELLUZYME®, CAREZYME® and CAREZYME PREMIUM (Novozymes A/S), CLAZINASE®, and PURADAX HA® (Genencor International Inc.), and KAC-500(B)® (Kao Corporation).

Preferred cellulases include:

a) Variants in WO2017084560.

b) Variants in WO2017106676.

The bacterial cleaning cellulase may be a glycosyl hydrolase having enzymatic activity towards amorphous cellulose substrates, wherein the glycosyl hydrolase is selected from GH families 5, 7, 12, 16, 44 or 74. Suitable glycosyl hydrolases may also be selected from the group consisting of: GH family 44 glycosyl hydrolases from *Paenibacillus* polyxyma (wild-type) such as XYG1006 described in U.S. Pat. No. 7,361,736 or are variants thereof. GH family 12 glycosyl hydrolases from *Bacillus licheniformis* (wild-type) described in U.S. Pat. No. 6,268,197 or are variants thereof; GH family 5 glycosyl hydrolases from *Bacillus agaradhaerens* (wild type) or variants thereof; GH family 5 glycosyl hydrolases from *Paenibacillus* (wild type) such as XYG1034 and XYG 1022 described in U.S. Pat. No. 6,630,340 or variants thereof; GH family 74 glycosyl hydrolases from Jonesia sp. (wild type) such as XYG1020 described in WO 2002/077242 or variants thereof; and GH family 74 glycosyl hydrolases from *Trichoderma Reesei* (wild type), or variants thereof. Suitable bacterial cleaning cellulases are sold under the tradenames Celluclean® and Whitezyme® (Novozymes A/S, Bagsvaerd, Denmark).

In one aspect, the composition may comprise a fungal cleaning cellulase belonging to glycosyl hydrolase family 45 having a molecular weight of from 17 kDa to 30 kDa, for example the endoglucanases sold under the tradename Biotouch® NCD, DCC, DCL and FLX1 (AB Enzymes, Darmstadt, Germany). Additionally, preferred cellulases include the ones covered in WO2016066896.

Mannanase

As used herein, the term "mannanase" or "galactomannanase" denotes a mannanase enzyme defined according to that known in the art as mannan endo-1,4-beta-mannosidase and having the alternative names beta-mannanase and endo-1,4-mannanase and catalysing hydrolysis of 1,4-beta-D-mannosidic linkages in mannans, galactomannans, glucomannans, and galactoglucomannans. Mannanases are classified according to the Enzyme Nomenclature as EC 3.2.1.78.

Suitable examples are described in WO2015040159.

Additional preferred mannanases include those sold under the tradenames Mannaway® (all from Novozymes A/S, Bagsvaerd, Denmark), and Purabrite®, Effectenz®, Preferenz® (Genencor International Inc., Palo Alto, Calif.) and Biotouch® (AB Enzymes, Darmstadt, Germany)

Pectate Lyases.

Other preferred enzymes include pectate lyases sold under the tradenames Pectawash®, Pectaway®, Xpect®.

Nuclease Enzyme

The composition may comprise a nuclease enzyme. The nuclease enzyme is an enzyme capable of cleaving the phosphodiester bonds between the nucleotide sub-units of nucleic acids.

The nuclease enzyme herein is preferably a deoxyribonuclease or ribonuclease enzyme or a functional fragment thereof. By functional fragment or part is meant the portion of the nuclease enzyme that catalyzes the cleavage of phosphodiester linkages in the DNA backbone and so is a region of said nuclease protein that retains catalytic activity. Thus it includes truncated, but functional versions, of the enzyme and/or variants and/or derivatives and/or homologues whose functionality is maintained.

Preferably the nuclease enzyme is a deoxyribonuclease, preferably selected from any of the classes E.C. 3.1.21.x, where x=1, 2, 3, 4, 5, 6, 7, 8 or 9, E.C. 3.1.22.y where y=1, 2, 4 or 5, E.C. 3.1.30.z where z=1 or 2, E.C. 3.1.31.1 and mixtures thereof. All Nuclease enzymes may include superoxide dismutase in minor amounts.

Galactanase

The enzyme system may comprise an extracellular polymer-degrading enzyme that includes an endo-beta-1,6-galactanase enzyme. The term "endo-beta-1,6-galactanase" or "a polypeptide having endo-beta-1,6-galactanase activity" means a endo-beta-1,6-galactanase activity (EC 3.2.1.164) from the glycoside hydrolase family 30 that catalyzes the hydrolytic cleavage of 1,6-3-D-galactooligosaccharides with a degree of polymerization (DP) higher than 3, and their acidic derivatives with 4-O-methylglucosyluronate or glucosyluronate groups at the non-reducing terminals. For purposes of the present disclosure, endo-beta-1,6-galactanase activity is determined according to the procedure described in WO 2015185689 in Assay I. Suitable examples from class EC 3.2.1.164 are described in WO 2015185689.

Other Enzymes

The enzyme system can comprise other enzymes. Suitable enzymes provide cleaning performance and/or fabric care benefits. Examples of other suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, pentosanases, malanases, ß-glucanases, arabinosidases, hyaluronidase, chondroitinase, laccase, and known amylases, or combinations thereof. A preferred enzyme system further comprises a cocktail of conventional detersive enzymes such as protease, lipase, cutinase and/or cellulase in conjunction with amylase. Detersive enzymes are described in greater detail in U.S. Pat. No. 6,579,839.

Xanthan Endoglucanase & Xanthan Lyase

The term xanthan endoglucanase denotes an enzyme exhibiting endo-beta-1,4-glucanase activity that is capable of catalysing hydrolysis of the 1,4-linked β-D-glucose polymeric backbone of xanthan gum in conjunction with a suitable xanthan lyase enzyme. The xanthan endoglucanase in accordance with the invention has endo-beta-1,4-glucanase activity.

The term "xanthan lyase" denotes an enzyme that cleaves the β-D-mannosyl-β-D-1,4-glucuronosyl bond of xanthan and have been described in the literature. Xanthan lyases are classified according to the Enzyme Nomenclature as EC 4.2.2.12, and are known to be produced by many xanthan-degrading bacteria including *Bacillus, Corynebacterium* and *Paenibacillus* species. The xanthan lyase in accordance with the invention has xanthan lyase activity.

Bleaching Agents.

It may be preferred for the composition to comprise one or more bleaching agents. Suitable bleaching agents other than bleaching catalysts include photobleaches, bleach activators, hydrogen peroxide, sources of hydrogen peroxide, pre-formed peracids and mixtures thereof. In general, when a bleaching agent is used, the compositions of the present invention may comprise from about 0.1% to about 50% or even from about 0.1% to about 25% bleaching agent or mixtures of bleaching agents by weight of the subject composition. Examples of suitable bleaching agents include:

(1) photobleaches for example sulfonated zinc phthalocyanine sulfonated aluminium phthalocyanines, xanthene dyes, thioxanthones, and mixtures thereof;

(2) pre-formed peracids: Suitable preformed peracids include, but are not limited to compounds selected from the group consisting of pre-formed peroxyacids or salts thereof typically a percarboxylic acids and salts, percarbonic acids and salts, perimidic acids and salts, peroxymonosulfuric acids and salts, for example, Oxone®, and mixtures thereof.

Particularly preferred peroxyacids are phthalimido-peroxy-alkanoic acids, in particular ε-phthalimido peroxy hexanoic acid (PAP). Preferably, the peroxyacid or salt thereof has a melting point in the range of from 30° C. to 60° C.

(3) sources of hydrogen peroxide, for example, inorganic perhydrate salts, including alkali metal salts such as sodium salts of perborate (usually mono- or tetrahydrate), percarbonate, persulphate, perphosphate, persilicate salts and mixtures thereof. When employed, inorganic perhydrate salts are typically present in amounts of from 0.05 to 40 wt %, or 1 to 30 wt % of the overall fabric and home care product and are typically incorporated into such fabric and home care products as a crystalline solid that may be coated. Suitable coatings include, inorganic salts such as alkali metal silicate, carbonate or borate salts or mixtures thereof, or organic materials such as water-soluble or dispersible polymers, waxes, oils or fatty soaps; and (4) bleach activators having R—(C═O)-L wherein R is an alkyl group, optionally branched, having, when the bleach activator is hydrophobic, from 6 to 14 carbon atoms, or from 8 to 12 carbon atoms and, when the bleach activator is hydrophilic, less than 6 carbon atoms or even less than 4 carbon atoms; and L is leaving group. Examples of suitable leaving groups are benzoic acid and derivatives thereof—especially benzene sulphonate. Suitable bleach activators include dodecanoyl oxybenzene sulphonate, decanoyl oxybenzene sulphonate, decanoyl oxybenzoic acid or salts thereof, 3,5,5-trimethyl hexanoyloxybenzene sulphonate, tetraacetyl ethylene diamine (TAED) and nonanoyloxybenzene sulphonate (NOBS).

(5) Bleach Catalysts. The compositions of the present invention may also include one or more bleach catalysts capable of accepting an oxygen atom from a peroxyacid and/or salt thereof, and transferring the oxygen atom to an oxidizeable substrate. Suitable bleach catalysts include, but are not limited to: iminium cations and polyions; iminium zwitterions; modified amines; modified amine oxides; N-sulphonyl imines; N-phosphonyl imines; N-acyl imines; thiadiazole dioxides; perfluoroimines; cyclic sugar ketones and alpha amino-ketones and mixtures thereof. One particularly preferred catalyst is acyl hydrazone type such as 4-(2-(2-((2-hydroxyphenylmethyl)methylene)-hydrazinyl)-2-oxoethyl)-4-methylchloride.

(6) The composition may preferably comprise catalytic metal complexes. One preferred type of metal-containing bleach catalyst is a catalyst system comprising a transition metal cation of defined bleach catalytic activity, such as copper, iron, titanium, ruthenium, tungsten, molybdenum, or manganese cations.

If desired, the compositions herein can be catalyzed by means of a manganese compound. Such compounds and levels of use are well known in the art and include, for example, the manganese-based catalysts disclosed in U.S. Pat. No. 5,576,282. In some embodiments, an additional source of oxidant in the composition is not present, molecular oxygen from air providing the oxidative source.

Cobalt bleach catalysts useful herein are known, and are described, for example, in U.S. Pat. Nos. 5,597,936; 5,595,967.

Builders.

Preferably the composition may comprise one or more builders or a builder system. When a builder is used, the composition of the invention will typically comprise at least 1%, from 2% to 60% builder. It may be preferred that the composition comprises low levels of phosphate salt and/or zeolite, for example from 1 to 10 or 5 wt %. The composition may even be substantially free of strong builder; substantially free of strong builder means "no deliberately added" zeolite and/or phosphate. Typical zeolite builders include zeolite A, zeolite P and zeolite MAP. A typical phosphate builder is sodium tri-polyphosphate.

Organic Acid

The detergent comprises one or more organic acids selected from the group consisting of acetic acid, adipic acid, aspartic acid, carboxymethyloxymalonic acid, carboxymethyloxysuccinic acid, citric acid, formic acid, glutaric acid, hydroxyethyliminodiacetic acid, iminodiacetic acid, lactic acid, maleic acid, malic acid, malonic acid, oxydiacetic acid, oxydisuccinic acid, succinic acid, sulfamic acid, tartaric acid, tartaric-disuccinic acid, tartaric-monosuccinic acid, or mixtures thereof. Preferably, the detergent composition may comprise an organic acid selected from the group consisting of acetic acid, lactic acid, and citric acid.

Chelating Agent.

Preferably the composition comprises chelating agents and/or crystal growth inhibitor. Suitable molecules include copper, iron and/or manganese chelating agents and mixtures thereof. Suitable molecules include hydroxamic acids, aminocarboxylates, aminophosphonates, succinates, salts thereof, and mixtures thereof. Non-limiting examples of suitable chelants for use herein include ethylenediaminetetracetates, N-(hydroxyethyl)ethylenediaminetriacetates, nitrilotriacetates, ethylenediamine tetraproprionates, triethylenetetraaminehexacetates, diethylenetriamine-pentaacetates, ethanol diglycines, ethylenediaminetetrakis (methylenephosphonates), diethylenetriamine penta(methylene phosphonic acid) (DTPMP), ethylenediamine disuccinate (EDDS), hydroxyethanedimethylenephosphonic acid (HEDP), methylglycinediacetic acid (MGDA), diethylenetriaminepentaacetic acid (DTPA), N,N-Dicarboxymethyl glutamic acid (GLDA) and salts thereof, and mixtures thereof. Other nonlimiting examples of chelants of use in the present invention are found in U.S. Pat. Nos. 7,445,644, 7,585,376 and 2009/0176684A1. Other suitable chelating agents for use herein are the commercial DEQUEST series, and chelants from Monsanto, DuPont, and Nalco, Inc. Yet other suitable chelants include the pyridinyl N Oxide type.

Fluorescent Brightener:

Commercial fluorescent brighteners suitable for the present disclosure can be classified into subgroups, including but not limited to: derivatives of stilbene, pyrazoline, coumarin, benzoxazoles, carboxylic acid, methinecyanines, dibenzothiophene-5,5-dioxide, azoles, 5- and 6-membered-ring heterocycles, and other miscellaneous agents.

The fluorescent brightener may be selected from the group consisting of disodium 4,4'-bis{[4-anilino-6-morpholino-s-triazin-2-yl]-amino}-2,2'-stilbenedisulfonate (brightener 15, commercially available under the tradename Tinopal AMS-GX by BASF), disodium 4,4'-bis{[4-anilino-6-(N-2-bis-hydroxyethyl)-s-triazine-2-yl]-amino}-2,2'-stilbenedisulonate (commercially available under the tradename Tinopal UNPA-GX by BASF), disodium 4,4'-bis{[4-anilino-6-(N-2-hydroxyethyl-N-methylamino)-s-triazine-2-yl]-amino}-2,2'-stilbenedisulfonate (commercially available under the tradename Tinopal 5BM-GX by BASF). More preferably, the fluorescent brightener is disodium 4,4'-bis{[4-anilino-6-morpholino-s-triazin-2-yl]-amino}-2,2'-stilbenedisulfonate or 2,2'-([1,1'-Biphenyl]-4,4'-diyldi-2,1-ethenediyl)bis-benzenesulfonic acid disodium salt. The brighteners may be added in particulate form or as a premix with a suitable solvent, for example nonionic surfactant, propanediol.

Enzyme Stabilizers.

The composition may preferably comprise enzyme stabilizers. Any conventional enzyme stabilizer may be used, for example by the presence of water-soluble sources of calcium and/or magnesium ions in the finished fabric and home care products that provide such ions to the enzymes. In case of aqueous compositions comprising protease, a reversible protease inhibitor, such as a boron compound including borate, or preferably 4-formyl phenylboronic acid, phenylboronic acid and derivatives thereof, or compounds such as calcium formate, sodium formate and 1,2-propane diol can be added to further improve stability.

Solvents:

The solvent system in the present compositions can be a solvent system containing water alone or mixtures of organic solvents either without or preferably with water. The compositions may optionally comprise an organic solvent. Suitable organic solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. Preferred organic solvents include 1,2-propanediol, 2,3 butane diol, ethanol, glycerol, ethoxylated glycerol, dipropylene glycol, methyl propane diol and mixtures thereof 2 ethyl hexanol, 3,5,5, trimethyl-1 hexanol, and 2 propyl heptanol. Solvents may be a polyethylene or polypropylene glycol ether of glycerin. Other lower alcohols, C1-C4 alkanolamines such as monoethanolamine and triethanolamine, can also be used. Solvent systems can be absent, for example from anhydrous solid embodiments of the invention, but more typically are present at levels in the range of from about 0.1% to about 98%, preferably at least about 1% to about 50%, more usually from about 5% to about 25%, alternatively from about 1% to about 10% by weight of the liquid detergent composition of said organic solvent. These organic solvents may be used in conjunction with water, or they may be used without water Structured Liquids:

In some embodiments of the invention, the composition is in the form of a structured liquid. Such structured liquids can either be internally structured, whereby the structure is formed by primary ingredients (e.g. surfactant material) and/or externally structured by providing a three dimensional matrix structure using secondary ingredients (e.g. polymers, clay and/or silicate material), for use e.g. as thickeners. The composition may comprise a structurant, preferably from 0.01 wt % to 5 wt %, from 0.1 wt % to 2.0 wt % structurant. Examples of suitable structurants are given in US2006/0205631A1, US2005/0203213A1, U.S. Pat. Nos. 7,294,611, 6,855,680. The structurant is typically selected from the group consisting of diglycerides and triglycerides, ethylene glycol distearate, microcrystalline cellulose, cellulose-based materials, microfiber cellulose, hydrophobically modified alkali-swellable emulsions such as Polygel W30 (3VSigma), biopolymers, xanthan gum, gellan gum, hydrogenated castor oil, derivatives of hydrogenated castor oil such as non-ethoxylated derivatives thereof and mixtures thereof, in particular, those selected from the group of hydrogenated castor oil, derivatives of hydrogenated castor oil, microfibullar cellulose, hydroxyfunctional crystalline materials, long chain fatty alcohols, 12-hydroxystearic acids, clays and mixtures thereof. One preferred structurant is described in U.S. Pat. No. 6,855,680 which defines suitable hydroxyfunctional crystalline materials in detail. Preferred is hydrogenated castor oil. Some structurants have a thread-like structuring system having a range of aspect ratios. Another preferred structurant is based on cellulose and may be derived from a number of sources including biomass, wood pulp, citrus fibers and the like.

Conditioning Agents:

Suitable conditioning agents include high melting point fatty compounds. The high melting point fatty compound useful herein has a melting point of 25° C. or higher and is selected from the group consisting of fatty alcohols, fatty acids, fatty alcohol derivatives, fatty acid derivatives, and mixtures thereof. Suitable conditioning agents also include nonionic polymers and conditioning oils, such as hydrocarbon oils, polyolefins, and fatty esters.

Suitable conditioning agents include those conditioning agents characterized generally as silicones (e.g., silicone oils, polyoils, cationic silicones, silicone gums, high refractive silicones, and silicone resins), organic conditioning oils (e.g., hydrocarbon oils, polyolefins, and fatty esters) or combinations thereof, or those conditioning agents which otherwise form liquid, dispersed particles in the aqueous surfactant matrix herein. The compositions of the present invention may also comprise from about 0.05% to about 3% of at least one organic conditioning oil as the conditioning agent, either alone or in combination with other conditioning agents, such as the silicones (described herein). Suitable conditioning oils include hydrocarbon oils, polyolefins, and fatty esters.

Probiotics:

The composition may comprise probiotics, such as those described in WO2009/043709.

Suds Boosters:

The composition may preferably comprise suds boosters if high sudsing is desired. Suitable examples are the $C_{10}$-$C_{16}$ alkanolamides or $C_{10}$-$C_{14}$ alkyl sulphates, which are preferably incorporated at 1%-10% levels. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, water-soluble magnesium and/or calcium salts such as $MgCl_2$, $MgSO_4$, $CaCl_2$, $CaSO_4$ and the like, can be added at levels of, typically, 0.1%-2%, to provide additional suds and to enhance grease removal performance.

Suds Suppressor:

Compounds for reducing or suppressing the formation of suds can be incorporated into the water-soluble unit dose articles. Suds suppression can be of particular importance in the so-called "high concentration cleaning process" and in front-loading style washing machines. Examples of suds supressors include monocarboxylic fatty acid and soluble salts therein, high molecular weight hydrocarbons such as paraffin, fatty acid esters (e.g., fatty acid triglycerides), fatty acid esters of monovalent alcohols, aliphatic C18-C40 ketones (e.g., stearone), N-alkylated amino triazines, waxy hydrocarbons preferably having a melting point below about 100° C., silicone suds suppressors, and secondary alcohols. Preferred fatty acid blends may be mixtures enriched or Fatty acid mixtures enriched with 2-alkyl fatty acid, preferably 2-methyl octanoic acid.

Additional suitable antifoams are those derived from phenylpropylmethyl substituted polysiloxanes.

The detergent composition may comprise a suds suppressor selected from organomodified silicone polymers with aryl or alkylaryl substituents combined with silicone resin and a primary filler, which is modified silica. The detergent compositions may comprise from about 0.001% to about 4.0%, by weight of the composition, of such a suds suppressor.

The detergent composition comprises a suds suppressor selected from: a) mixtures of from about 80 to about 92% ethylmethyl, methyl(2-phenylpropyl) siloxane; from about 5 to about 14% MQ resin in octyl stearate; and from about 3 to about 7% modified silica; b) mixtures of from about 78 to about 92% ethylmethyl, methyl(2-phenylpropyl) siloxane; from about 3 to about 10% MQ resin in octyl stearate; from about 4 to about 12% modified silica; or c) mixtures thereof, where the percentages are by weight of the anti-foam.

Pearlescent Agent:

Non-limiting examples of pearlescent agents include: mica; titanium dioxide coated mica; bismuth oxychloride; fish scales; mono and diesters of alkylene glycol. The pearlescent agent may be ethyleneglycoldistearate (EGDS).

Opacifier:

In one embodiment, the composition might also comprise an opacifier. As the term is used herein, an "opacifier" is a substance added to a material in order to make the ensuing system opaque. In one preferred embodiment, the opacifier is Acusol, which is available from Dow Chemicals. Acusol opacifiers are provided in liquid form at a certain % solids level. As supplied, the pH of Acusol opacifiers ranges from 2.0 to 5.0 and particle sizes range from 0.17 to 0.45 um. In one preferred embodiment, Acusol OP303B and 301 can be used.

In yet another embodiment, the opacifier may be an inorganic opacifier. Preferably, the inorganic opacifier can be $TiO_2$, ZnO, talc, $CaCO_3$, and combination thereof. The composite opacifier-microsphere material is readily formed with a preselected specific gravity, so that there is little tendency for the material to separate.

Hydrotrope:

The composition may optionally comprise a hydrotrope in an effective amount, i.e. from about 0% to 15%, or about 1% to 10%, or about 3% to about 6%, so that compositions are compatible in water. Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, as disclosed in U.S. Pat. No. 3,915,903.

Anti-Oxidant:

The composition may optionally contain an anti-oxidant present in the composition from about 0.001 to about 2% by weight. Preferably the antioxidant is present at a concentration in the range 0.01 to 0.08% by weight. Mixtures of anti-oxidants may be used.

Anti-oxidants are substances as described in Kirk-Othmer (Vol. 3, page 424) and In Ullmann's Encyclopedia (Vol. 3, page 91).

One class of anti-oxidants used in the present invention is alkylated phenols, having the general formula:

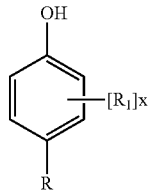

wherein R is $C_1$-$C_{22}$ linear or branched alkyl, preferably methyl or branched $C_3$-$C_6$ alkyl, $C_1$-$C_6$ alkoxy, preferably methoxy; $R_1$ is a $C_3$-$C_6$ branched alkyl, preferably tert-butyl; x is 1 or 2. Hindered phenolic compounds are a preferred type of alkylated phenols having this formula. Examples of such hindered phenol antioxidants may include, but are not limited to: 2,6-bis(1-methylpropyl)phenol; 2,6-bis(1,1-dimethylethyl)-4-methyl-phenol (also known as hydroxy butylated toluene, "BHT"); 2-(1,1-dimethylethyl)-1,4-benzenediol; 2,4-bis(1,1-dimethylethyl)-phenol; 2,6-bis(1,1-dimethylethyl)-phenol; 3,5-bis(1,1-dimethylethyl)-4-hydroxybenzene propanoic acid, methyl ester; 2-(1,1-dimethylethyl)-4-methylphenol; 2-(1,1-dimethylethyl)-4,6-dimethyl-phenol; 3,5-bis(1,1-dimethylethyl)-4-hydroxybenzenepropanoic acid, 1,1'-[2,2-bis[[3-[3,5-bis(1,1-dimethylethyl)-4-hydroxyphenyl]-1-oxopropoxy] methyl]-1,3-propanediyl] ester; 3,5-bis(1,1-dimethylethyl)-4-hydroxybenzenepropanoic acid, octadecyl ester; 2,2'-methylenebis[6-(1,1-dimethylethyl)-4-methylphenol; 2-(1,1-dimethylethyl)-phenol; 2,4,6-tris(1,1-dimethylethyl)-phenol; 4,4'-methylenebis[2,6-bis(1,1-dimethylethyl)-phenol; 4,4',4"-[(2,4,6-trimethyl-1,3,5-benzenetriyl)tris (methylene)]tris[2,6-bis(1,1-dimethylethyl)-phenol]; N,N'-

1,6-hexanediylbis[3,5-bis(1,1-dimethylethyl)-4-hydroxybenzenepropanamide; 3,5-bis(1,1-dimethylethyl)-4-hydroxy benzoic acid, hexadecyl ester; P[[3,5-bis(1,1-dimethylethyl)-4-hydroxyphenyl]methylphosphonic acid, diethyl ester; 1,3,5-tris[[3,5-bis(1,1-dimethylethyl)-4-hydroxyphenyl]methyl]-1,3,5-Triazine-2,4,6(1H,3H,5H)-tri one; 3,5-bis(1,1-5 dimethylethyl)-4-hydroxybenzenepropanoic acid, 2-[3-[3,5-bis(1,1-dimethylethyl)-4-hydroxyphenyl]-1-oxopropyl]hydrazide; 3-(1,1-dimethyl ethyl)-4-hydroxy-5-methylbenzenepropanoic acid, 1,1'-[1,2-ethanediylbis(oxy-2,1-ethanediyl)] ester; 4-[(dimethylamino)methyl]-2,6-bis(1,1-dimethylethyl)phenol; [4,6-bis(octylthio)-1,3,5-triazin-2-yl]amino]-2,6-bis(1,1-dimethylethyl)phenol; 3,5-bis(1,1-dimethylethyl)-4-hydroxy benzene propanoic acid, 1,1'-(thiodi-2,1-ethanediyl) ester; 3,5-bis(1,1-dimethylethyl)-4-hydroxybenzoic acid, 2,4-bis(1,1-dimethylethyl)phenyl ester; 3,5-bis(1,1-dimethylethyl)-4-hydroxybenzenepropanoic acid, 1,1'-(1,6-hexanediyl)ester; 3-(1,1-dimethylethyl)-4-hydroxy-5-methylbenzenepropanoic acid, 1,1'-[2,4,8,10-tetraoxaspiro[5.5] undecane-3,9-diylbis(2,2-dimethyl-2,1-ethanediyl)] ester; 3-(1,1-dimethylethyl)-b-[3-(1,1-dimethylethyl)-4-hydroxy phenyl]-4-hydroxy-b-methylbenzenepropanoic acid, 1,1'-(1,2-ethanediyl) ester; 2-[[3,5-bis(1,1-dimethylethyl)-4-hydroxyphenyl]methyl]-2-butylpropanedioic acid, 1,3-bis(1,2,2,6,6-pentamethyl-4-piperidinyl) ester; 3,5-bis(1,1-dimethylethyl)-4-hydroxybenzenepropanoic acid, 1-[2-[3-[3,5-bis(1,1-dimethylethyl)-4-hydroxyphenyl]-1-oxopropoxy] ethyl]-2,2,6,6-tetramethyl-4-piperidinyl ester; 3,4-dihydro-2,5,7,8-tetramethyl-2-[(4R,8R)-4,8,12-trimethyltridecyl]-(2R)-2H-1-benzopyran-6-ol; 2,6-dimethylphenol; 2,3,5-trimethyl-1,4-benzenediol; 2,4,6-trimethylphenol; 2,3,6-trimethylphenol; 4,4'-(1-methylethylidene)-bis[2,6-dimethylphenol]; 1,3,5-tris[[4-(1,1-dimethylethyl)-3-hydroxy-2,6-dimethylphenyl]methyl]-1,3,5-triazine-2,4,6(1H,3H,5H)-trione; 4,4'-methylenebis[2,6-dimethylphenol]; and mixtures thereof.

Preferably, the hindered phenol antioxidant comprises at least one phenolic —OH group having at least one C3-C6 branched alkyl at a position ortho to said at least one phenolic —OH group. More preferably, the hindered phenol antioxidant is an ester of 3,5-bis(1,1-dimethylethyl)-4-hydroxy-benzenepropanoic acid, and most preferably a C1-C22 linear alkyl ester of 3,5-bis(1,1-dimethylethyl)-4-hydroxy-benzenepropanoic acid. Commercially available C1-C22 linear alkyl esters of 3,5-bis(1,1-dimethylethyl)-4-hydroxy-benzenepropanoic acid include RALOX® from Raschig USA (Texas, USA), which is a methyl ester of 3,5-bis(1,1-dimethylethyl)-4-hydroxy-benzenepropanoic acid, and TINOGARD® TS from BASF (Ludwigshafen, Germany), which is an octadecyl ester of 3,5-bis(1,1-dimethylethyl)-4-hydroxy-benzenepropanoic acid.

Furthermore, the anti-oxidant used in the composition may be selected from the group consisting of α-, β-, γ-, δ-tocopherol, ethoxyquin, 2,2,4-trimethyl-1,2-dihydroquinoline, 2,6-di-tert-butyl hydroquinone, tert-butyl hydroxyanisole, lignosulphonic acid and salts thereof, and mixtures thereof. It is noted that ethoxyquin (1,2-dihydro-6-ethoxy-2,2,4-trimethylquinoline) is marketed under the name Raluquin™ by the company Raschig™.

Other types of anti-oxidants that may be used in the composition are 6-hydroxy-2,5,7,8-tetramethylchroman-2-carboxylic acid (Trolox™) and 1,2-benzisothiazoline-3-one (Proxel GXL™).

A further class of anti-oxidants which may be suitable for use in the composition is a benzofuran or benzopyran derivative having the formula:

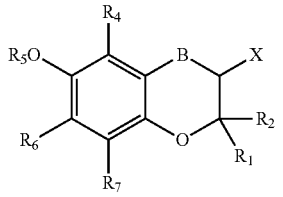

wherein $R_1$ and $R_2$ are each independently alkyl or $R_1$ and $R_2$ can be taken together to form a $C_5$-$C_6$ cyclic hydrocarbyl moiety; B is absent or $CH_2$; $R_4$ is $C_1$-$C_6$ alkyl; $R_5$ is hydrogen or —C(O)$R_3$ wherein $R_3$ is hydrogen or $C_1$-$C_{19}$ alkyl; $R_6$ is $C_1$-$C_6$ alkyl; $R_7$ is hydrogen or $C_1$-$C_6$ alkyl; X is —$CH_2OH$, or —$CH_2A$ wherein A is a nitrogen comprising unit, phenyl, or substituted phenyl. Preferred nitrogen comprising A units include amino, pyrrolidino, piperidino, morpholino, piperazino, and mixtures thereof). The cleaning compositions of the present disclosure may comprise tannins selected from the group consisting of gallotannins, ellagitannins, complex tannins, condensed tannins, and combinations thereof.

Hygiene Agent:

The compositions of the present invention may also comprise components to deliver hygiene and/or malodour benefits such as one or more of zinc ricinoleate, thymol, quaternary ammonium salts such as Bardac®, polyethylenimines (such as Lupasol® from BASF) and zinc complexes thereof, silver and silver compounds, especially those designed to slowly release Ag+ or nano-silver dispersions.

The cleaning compositions of the present invention may also contain antimicrobial agents. Cationic active ingredients may include but are not limited to n-alkyl dimethyl benzyl ammonium chloride, alkyl dimethyl ethyl benzyl ammonium chloride, dialkyl dimethyl quaternary ammonium compounds such as didecyl dimethyl ammonium chloride, N,N-didecyl-N-methyl-poly(oxyethyl) ammonium propionate, dioctyl didecyl ammonium chloride, also including quaternary species such as benzethonium chloride, alkyl pyridinium chlorides, and quaternary ammonium compounds with inorganic or organic counter ions such as bromine, carbonate or other moieties including dialkyl dimethyl ammonium carbonates, as well as antimicrobial amines such as Chlorhexidine Gluconate, PHMB (Polyhexamethylene biguanide), salt of a biguanide, a substituted biguanide derivative, an organic salt of a quaternary ammonium containing compound or an inorganic salt of a quaternary ammonium containing compound or mixtures thereof. More Preferably, the anti-microbial agent is selected from the group consisting of 4-4'-dichloro-2-hydroxy diphenyl ether ("Diclosan"), 2,4,4'-trichloro-2'-hydroxy diphenyl ether ("Triclosan"), and a combination thereof. Most preferably, the anti-microbial agent is 4-4'-dichloro-2-hydroxy diphenyl ether, commercially available from BASF, under the trademark name Tinosan®HP100.

Packaging.

Any conventional packaging may be used, and the packaging may be fully or partially transparent so that the consumer can see the color of the laundry care composition which may be provided or contributed to by the color of the dyes essential to the invention. UV absorbing compounds may be included in some or all of the packaging.

When in the form of a liquid, the laundry care compositions of the invention may be aqueous (typically above 2 wt % or even above 5 or 10 wt % total water, up to 90 or up to 80 wt % or 70 wt % total water) or non-aqueous (typically below 2 wt % total water content). Typically the compositions of the invention will be in the form of an aqueous solution or uniform dispersion or suspension of surfactant, shading dye, and certain optional other ingredients, some of which may normally be in solid form, that have been combined with the normally liquid components of the composition, such as the liquid alcohol ethoxylate nonionic, the aqueous liquid carrier, and any other normally liquid optional ingredients. Such a solution, dispersion or suspension will be acceptably phase stable. When in the form of a liquid, the laundry care compositions of the invention preferably have viscosity from 1 to 1500 centipoises (1-1500 mPa*s), more preferably from 100 to 1000 centipoises (100-1000 mPa*s), and most preferably from 200 to 500 centipoises (200-500 mPa*s) at 20 s−1 and 21° C. Viscosity can be determined by conventional methods. Viscosity may be measured using an AR 550 rheometer from TA instruments using a plate steel spindle at 40 mm diameter and a gap size of 500 μm. The high shear viscosity at 20 s−1 and low shear viscosity at 0.05-1 can be obtained from a logarithmic shear rate sweep from 0.1-1 to 25-1 in 3 minutes time at 21° C. The preferred rheology described therein may be achieved using internal existing structuring with detergent ingredients or by employing an external rheology modifier. More preferably the laundry care compositions, such as detergent liquid compositions have a high shear rate viscosity of from about 100 centipoise to 1500 centipoise, more preferably from 100 to 1000 cps. Unit Dose laundry care compositions, such as detergent liquid compositions have high shear rate viscosity of from 400 to 1000 cps. Laundry care compositions such as laundry softening compositions typically have high shear rate viscosity of from 10 to 1000, more preferably from 10 to 800 cps, most preferably from 10 to 500 cps. Hand dishwashing compositions have high shear rate viscosity of from 300 to 4000 cps, more preferably 300 to 1000 cps.

The liquid compositions, preferably the laundry care composition herein can be prepared by combining the components thereof in any convenient order and by mixing, e.g., agitating, the resulting component combination to form a phase stable liquid laundry care composition. In a process for preparing such compositions, a liquid matrix is formed containing at least a major proportion, or even substantially all, of the liquid components, e.g., nonionic surfactant, the non-surface-active liquid carriers and other optional liquid components, with the liquid components being thoroughly admixed by imparting shear agitation to this liquid combination. For example, rapid stirring with a mechanical stirrer may usefully be employed. While shear agitation is maintained, substantially all of any anionic surfactants and the solid form ingredients can be added. Agitation of the mixture is continued, and if necessary, can be increased at this point to form a solution or a uniform dispersion of insoluble solid phase particulates within the liquid phase. After some or all of the solid-form materials have been added to this agitated mixture, particles of any enzyme material to be included, e.g., enzyme prills, are incorporated. As a variation of the composition preparation procedure hereinbefore described, one or more of the solid components may be added to the agitated mixture as a solution or slurry of particles premixed with a minor portion of one or more of the liquid components. After addition of all of the composition components, agitation of the mixture is continued for a period of time sufficient to form compositions having the requisite viscosity and phase stability characteristics. Frequently this will involve agitation for a period of from about 30 to 60 minutes.

Pouches.

In a preferred embodiment of the invention, the composition is provided in the form of a unitized dose, either tablet form or preferably in the form of a liquid/solid (optionally granules)/gel/paste held within a water-soluble film in what is known as a pouch or pod. The composition may be a laundry detergent composition, an automatic dishwashing composition, a hard surface cleaning composition, or a combination thereof. The composition can be encapsulated in a single or multi-compartment pouch. Multi-compartment pouches are described in more detail in EP-A-2133410. When the composition is present in a multi-compartment pouch, the composition of the invention may be in one or two or more compartments, thus the dye may be present in one or more compartments, optionally all compartments. Non-shading dyes or pigments or other aesthetics may also be used in one or more compartments. In one embodiment the composition is present in a single compartment of a multi-compartment pouch.

Preferred film materials are polymeric materials. The film material can be obtained, for example, by casting, blow-molding, extrusion or blown extrusion of the polymeric material, as known in the art. Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000. Mixtures of polymers can also be used as the pouch material. This can be beneficial to control the mechanical and/or dissolution properties of the compartments or pouch, depending on the application thereof and the required needs. Suitable mixtures include for example mixtures wherein one polymer has a higher water-solubility than another polymer, and/or one polymer has a higher mechanical strength than another polymer. Also suitable are mixtures of polymers having different weight average molecular weights, for example a mixture of PVA or a copolymer thereof of a weight average molecular weight of about 10,000-40,000, preferably around 20,000, and of PVA or copolymer thereof, with a weight average molecular weight of about 100,000 to 300,000, preferably around 150,000. Also, suitable herein are polymer blend compositions, for example comprising hydrolytically degradable and water-soluble polymer blends such as polylactide and polyvinyl alcohol, obtained by mixing polylactide and polyvinyl alcohol, typically comprising about 1-35% by weight polylactide and about 65% to 99% by weight polyvinyl alcohol. Preferred for use herein are polymers which are from about 60% to about 98% hydrolysed, preferably about 80% to about 90% hydrolysed, to improve the dissolution characteristics of the material.

Naturally, different film material and/or films of different thickness may be employed in making the compartments of the present invention. A benefit in selecting different films is that the resulting compartments may exhibit different solubility or release characteristics.

Most preferred film materials are PVA films known under the MonoSol trade reference M8630, M8900, H8779 and those described in U.S. Pat. Nos. 6,166,117 and 6,787,512 and PVA films of corresponding solubility and deformability characteristics.

The film material herein can also comprise one or more additive ingredients. For example, it can be beneficial to add plasticizers, for example glycerol, ethylene glycol, diethyleneglycol, propylene glycol, sorbitol and mixtures thereof. Other additives include functional detergent additives to be delivered to the wash water, for example organic polymeric dispersants, etc.

Solid Form:

As noted previously, the laundry care compositions may be in a solid form. Suitable solid forms include tablets and particulate forms, for example, granular particles, flakes or sheets. Various techniques for forming detergent compositions in such solid forms are well known in the art and may be used herein.

Fibrous Water-Soluble Unit Dose Article:

As used herein, the phrases "water-soluble unit dose article," "water-soluble fibrous structure", and "water-soluble fibrous element" mean that the unit dose article, fibrous structure, and fibrous element are miscible in water. In other words, the unit dose article, fibrous structure, or fibrous element is capable of forming a homogeneous solution with water at ambient conditions. "Ambient conditions" as used herein means 23° C.±1.0° C. and a relative humidity of 50%±2%. The water-soluble unit dose article may contain insoluble materials, which are dispersible in aqueous wash conditions to a suspension mean particle size that is less than about 20 microns, or less than about 50 microns.

The fibrous water-soluble unit dose article may include any of the disclosures found in U.S. patent application Ser. No. 15/880,594 filed on Jan. 26, 2018; U.S. patent application Ser. No. 15/880,599 filed Jan. 26, 2018; and U.S. patent application Ser. No. 15/880,604 filed Jan. 26, 2018; incorporated by reference in their entirety. Preferred water-soluble fibrous structure comprises particles having a ratio of Linear Alkylbenzene Sulfonate to Alkylethoxylated Sulfate or Alkyl Sulfate of greater than 1.

These fibrous water-soluble unit dose articles can be dissolved under various wash conditions, e.g., low temperature, low water and/or short wash cycles or cycles where consumers have been overloading the machine, especially with items having high water absorption capacities, while providing sufficient delivery of active agents for the intended effect on the target consumer substrates (with similar performance as today's liquid products). Furthermore, the water-soluble unit dose articles described herein can be produced in an economical manner by spinning fibers comprising active agents. The water-soluble unit dose articles described herein also have improved cleaning performance.

Method of Use. The compositions of this invention, prepared as hereinbefore described, can be used to form aqueous washing/treatment solutions for use in the laundering/treatment of fabrics. Generally, an effective amount of such compositions is added to water, for example in a conventional fabric automatic washing machine, to form such aqueous laundering solutions. The aqueous washing solution so formed is then contacted, typically under agitation, with the fabrics to be laundered/treated therewith. An effective amount of the liquid detergent compositions herein added to water to form aqueous laundering solutions can comprise amounts sufficient to form from about 500 to 7,000 ppm of composition in aqueous washing solution, or from about 1,000 to 3,000 ppm of the laundry care compositions herein will be provided in aqueous washing solution.

Typically, the wash liquor is formed by contacting the laundry care composition with wash water in such an amount so that the concentration of the laundry care composition in the wash liquor is from above 0 g/l to 5 g/l, or from 1 g/l, and to 4.5 g/l, or to 4.0 g/l, or to 3.5 g/l, or to 3.0 g/l, or to 2.5 g/l, or even to 2.0 g/l, or even to 1.5 g/l. The method of laundering fabric or textile may be carried out in a top-loading or front-loading automatic washing machine or can be used in a hand-wash laundry application. In these applications, the wash liquor formed and concentration of laundry detergent composition in the wash liquor is that of the main wash cycle. Any input of water during any optional rinsing step(s) is not included when determining the volume of the wash liquor.

The wash liquor may comprise 40 liters or less of water, or 30 liters or less, or 20 liters or less, or 10 liters or less, or 8 liters or less, or even 6 liters or less of water. The wash liquor may comprise from above 0 to 15 liters, or from 2 liters, and to 12 liters, or even to 8 liters of water. Typically, from 0.01 kg to 2 kg of fabric per liter of wash liquor is dosed into said wash liquor. Typically, from 0.01 kg, or from 0.05 kg, or from 0.07 kg, or from 0.10 kg, or from 0.15 kg, or from 0.20 kg, or from 0.25 kg fabric per liter of wash liquor is dosed into said wash liquor. Optionally, 50 g or less, or 45 g or less, or 40 g or less, or 35 g or less, or 30 g or less, or 25 g or less, or 20 g or less, or even 15 g or less, or even 10 g or less of the composition is contacted to water to form the wash liquor. Such compositions are typically employed at concentrations of from about 500 ppm to about 15,000 ppm in solution. When the wash solvent is water, the water temperature typically ranges from about 5° C. to about 90° C. and, when the situs comprises a fabric, the water to fabric ratio is typically from about 1:1 to about 30:1. Typically the wash liquor comprising the laundry care composition of the invention has a pH of from 3 to 11.5.

In one aspect, such method comprises the steps of optionally washing and/or rinsing said surface or fabric, contacting said surface or fabric with any composition disclosed in this specification then optionally washing and/or rinsing said surface or fabric is disclosed, with an optional drying step.

Drying of such surfaces or fabrics may be accomplished by any one of the common means employed either in domestic or industrial settings. The fabric may comprise any fabric capable of being laundered in normal consumer or institutional use conditions, and the invention is suitable for cellulosic substrates and in some aspects also suitable for synthetic textiles such as polyester and nylon and for treatment of mixed fabrics and/or fibers comprising synthetic and cellulosic fabrics and/or fibers. As examples of synthetic fabrics are polyester, nylon, these may be present in mixtures with cellulosic fibers, for example, polycotton fabrics. The solution typically has a pH of from 7 to 11, more usually 8 to 10.5. The compositions are typically employed at concentrations from 500 ppm to 5,000 ppm in solution. The water temperatures typically range from about 5° C. to about 90° C. The water to fabric ratio is typically from about 1:1 to about 30:1.

Another method includes contacting a nonwoven substrate, which is impregnated with the detergent composition, with a soiled material. As used herein, "nonwoven substrate" can comprise any conventionally fashioned nonwoven sheet or web having suitable basis weight, caliper (thickness), absorbency, and strength characteristics. Non-limiting examples of suitable commercially available nonwoven substrates include those marketed under the trade names SONTARA® by DuPont and POLY WEB® by James River Corp.

EXAMPLES

TABLE 3

Liquid Detergent Compositions

| Raw Material | Comparative Composition A % wt | Inventive Composition B % wt | Comparative Composition C % wt | Inventive Composition D % wt | Comparative Composition E % wt | Inventive Composition F % wt |
|---|---|---|---|---|---|---|
| NI C24 EO9 | 8.7 | 8.7 | 8.7 | 8.7 | 8.7 | 8.7 |
| NI C45 EO7 | 2.7 | 2.7 | 2.7 | 2.7 | 2.7 | 2.7 |
| C12/14 Amine Oxide | 1.0 | 1.0 | 1.0 | 1.0 | 1.0 | 1.0 |
| C11.8 HLAS | 11.8 | 11.8 | 11.8 | 11.8 | 11.8 | 11.8 |
| C13 Branched Alkyl Sulfate (Isalchem) | 10.3 | — | | | 5.1 | |
| C13 Branched Alkyl Sulfate (Inventive Example 4) | — | 10.3 | — | — | | 5.1 |
| C15 Branched Alkyl Sulfate (Isalchem) | — | — | 10.3 | — | 5.1 | |
| C15 Branched Alkyl Sulfate (Inventive Example 3) | — | — | — | 10.3 | | 5.1 |
| Citric acid | 2.3 | 2.3 | 2.3 | 2.3 | 2.3 | 2.3 |
| Chelating agent[1] | 0.65 | 0.65 | 0.65 | 0.65 | 0.65 | 0.65 |
| Mannanase | 0.0017 | 0.0017 | 0.0017 | 0.0017 | 0.0017 | 0.0017 |
| Pectawash | 0.00342 | 0.00342 | 0.00342 | 0.00342 | 0.00342 | 0.00342 |
| Amylase | 0.00766 | 0.00766 | 0.00766 | 0.00766 | 0.00766 | 0.00766 |
| Protease | 0.07706 | 0.07706 | 0.07706 | 0.07706 | 0.07706 | 0.07706 |
| Sodium Chloride | 0.023 | 0.023 | 0.023 | 0.023 | 0.023 | 0.023 |
| Sodium Tetraborate | 1.7 | 1.7 | 1.7 | 1.7 | 1.7 | 1.7 |
| Calcium Formate | 0.18 | 0.18 | 0.18 | 0.18 | 0.18 | 0.18 |
| Sodium Formate | 0.074 | 0.074 | 0.074 | 0.074 | 0.074 | 0.074 |
| Ethoxylated polyethyleneimine[2] | 1.7 | 1.7 | 1.7 | 1.7 | 1.7 | 1.7 |
| Ethoxylated-Propoxylated polyethyleneimine | 1.8 | 1.8 | 1.8 | 1.8 | 1.8 | 1.8 |
| Fluorescent Brightener[3] | 0.22 | 0.22 | 0.22 | 0.22 | 0.22 | 0.22 |
| Preservative 1[4] | 0.001 | 0.001 | 0.001 | 0.001 | 0.001 | 0.001 |
| Preservative 2[5] | 0.002 | 0.002 | 0.002 | 0.002 | 0.002 | 0.002 |
| Sorbitol | 0.071 | 0.071 | 0.071 | 0.071 | 0.071 | 0.071 |
| Ethanol | 1.9 | 1.9 | 1.9 | 1.9 | 1.9 | 1.9 |
| 1,2 Propylene Glycol | 5.5 | 5.5 | 5.5 | 5.5 | 5.5 | 5.5 |
| sodium cumene sulfonate | 1.7 | 1.7 | 1.7 | 1.7 | 1.7 | 1.7 |
| Monoethanolamine | 3.5 | 3.5 | 3.5 | 3.5 | 3.5 | 3.5 |
| Sodium Hydroxide | 0.016 | 0.016 | 0.016 | 0.016 | 0.016 | 0.016 |
| Suds suppressor 1[6] | 0.004 | 0.004 | 0.004 | 0.004 | 0.004 | 0.004 |
| Hydrogenated Castor oil | 0.082 | 0.082 | 0.082 | 0.082 | 0.082 | 0.082 |
| Suds suppressor 2[7] | 0.2 | 0.2 | 0.2 | 0.2 | 0.2 | 0.2 |
| Hueing dye[8] | 0.03 | 0.03 | 0.03 | 0.03 | 0.03 | 0.03 |
| Aesthetic dye | 0.01 | 0.01 | 0.01 | 0.01 | 0.01 | 0.01 |
| Fragrance | 1.3 | 1.3 | 1.3 | 1.3 | 1.3 | 1.3 |
| Water & Minors | Balance to 100% | Balance to 100% | Balance to 100% | Balance to 100% | Balance to 100% | Balance to 100% |

[1]Chelating agent is diethylenetriaminepentaacetic acid[2]PE-20 commercially available from BASF[3]Fluorescent Brightener is disodium 4,4'-bis{[4-anilino-6-morpholino-s-triazin-2-yl]-amino}-2,2'-stilbenedisulfonate preservative 2 is Phenoxyethanol

[4]preservative 1 is BIT commercially available from Lonza as Proxel

[5]preservative 2 is Phenoxyethanol

[6]Suds suppressor 1 is DC1520 commercially available from Dow Corning

[7]Suds suppressor 2 is AF-8017 commercially available from Dow

[8]Hueing dye is Liquitint Violet 200 commercially available from Milliken

Stain Removal

Technical stain swatches of CW120 cotton containing CFT ASTM Dust Sebum PCS94, CFT Discriminating Sebum PCS132, APD Grass CW120 GSRTGR001 were purchased from Advanced Product Design Co., Inc (Cincinnati, Ohio). The swatches were washed in a Whirlpool® front loader High Efficiency washing machine (standard 18-liter wash cycle), using 7 grains per gallon water hardness and washed at 77 degrees Fahrenheit. The total amount of liquid detergent used in the test was 43 grams.

Image analysis was used to compare each stain to an unstained fabric control. Software converted images taken into standard colorimetric values and compared these to standards based on the commonly used Macbeth Colour Rendition Chart, assigning each stain a colorimetric value (Stain Level). Eight replicates of each were prepared.

Stain removal from the swatches was measured as follows:

$$\text{Stain Removal Index } (SRI) = \frac{\Delta E_{initial} - E_{washed}}{\Delta E_{initial}} \times 100$$

$\Delta E_{initial}$=Stain level before washing $\Delta E_{washed}$=Stain level after washing Stain removal index scores for each stain were calculated and are listed in the table below:

TABLE 4

| SRI scores | | | | | | |
|---|---|---|---|---|---|---|
| | Comparative Composition A Delta SRI Vs A | Inventive Composition B Delta SRI Vs A | Comparative Composition C Delta SRI Vs C | Inventive Composition D Delta SRI Vs C | Comparative Composition E Delta SRI Vs E | Inventive Composition F Delta SRI VS E |
| CFT ASTM Dust Sebum PCS94 | 0 | +1.59 | 0 | +1.62 | 0 | +0.03 |
| CFT Discriminating Sebum PCS132 | 0 | +1.68 | 0 | +1.97 | 0 | 0.11 |
| APD Grass CW120 GSRTGR001 | 0 | +1.17 | 0 | +0.17 | 0 | 0.19 |

These results illustrate the surprising stain removal advantages on Sebum and Grass by the inventive compositions (as used in Composition B, D and F), as compared to Branched Alkyl Sulfates in conventional liquid detergent compositions A, C and E.

TABLE 5

| Wash Concentrations | | | | |
|---|---|---|---|---|
| Raw Material | Comparative Composition A Wash concentration (ppm) | Inventive Composition B Wash concentration (ppm) | Comparative Composition C Wash concentration (ppm) | Inventive Composition D Wash concentration (ppm) |
| C13 Branched Alkyl Sulfate (Isalchem) | | | 360 | |
| C13 Branched Alkyl Sulfate (Inventive Example 4) | | | | 360 |

TABLE 5-continued

| Wash Concentrations | | | | |
|---|---|---|---|---|
| C15 Branched Alkyl Sulfate (Isalchem) | 360 | | | |
| C15 Branched Alkyl Sulfate (Inventive Example 3) | | 360 | | |
| C11.8 HLAS | 140 | 140 | 140 | 140 |
| C45 alkyl ethoxylate (EO7) | 140 | 140 | 140 | 140 |
| Amine Oxide | 20 | 20 | 20 | 20 |
| Ethoxylated-Propoxylated polyethyl-eneimine | 30 | 30 | 30 | 30 |

| Raw Material | Comparative Composition E Wash concentration (ppm) | Inventive Composition F Wash concentration (ppm) | Comparative Composition G Wash concentration (ppm) | Inventive Composition H Wash concentration (ppm) |
|---|---|---|---|---|
| C13 Branched Alkyl Sulfate (Isalchem) | 45 | | 270 | |

TABLE 5-continued

| Wash Concentrations | | | | |
|---|---|---|---|---|
| C13 Branched Alkyl Sulfate (Inventive Example 4) | | 45 | | 270 |
| C15 Branched Alkyl Sulfate (Isalchem) | 315 | | 90 | |
| C15 Branched Alkyl Sulfate (Inventive Example 3) | | 315 | | 90 |
| C11.8 HLAS | 140 | 140 | 140 | 140 |
| C45 alkyl ethoxylate (EO7) | 140 | 140 | 140 | 140 |

TABLE 5-continued

| Wash Concentrations | | | | |
|---|---|---|---|---|
| Amine Oxide | 20 | 20 | 20 | 20 |
| Ethoxylated-Propoxylated polyethyl-eneimine | 30 | 30 | 30 | 30 |

Stain Removal Index Method

The method involves the use of a tergotometer to simulate the washing of fabrics in a washing machine. Test formulations were used to wash the test fabrics together with clean knitted cotton ballast and eleven 6 cm×6 cm SBL2004 soil squares (60 g). SBL2004 sheets were purchased from WFK Testgewebe GmbH and were cut into 6 cm×6 cm squares. The wash tests consisted of two internal and four external replicates for each stain type and treatments A-H described above.

Tergotometer pots containing 1 L of the test wash solution plus test fabrics, soil squares, and ballast at 25° C. and 7 US gpg were agitated at 208 rpm for 12 minutes and spun dry. Fabrics were then rinsed in 15° C. water at 7 US gpg at 167 rpm for 5 minutes and spun dry. After the rinse, fabrics were machine dried on High for 70 minutes before being analysed. Image analysis was used to compare each stain to an unstained fabric control. Software converted images taken into standard colorimetric values and compared these to standards based on the commonly used Macbeth Colour Rendition Chart, assigning each stain a colorimetric value (Stain Level). Eight replicates of each were prepared.

Stain removal from the swatches was measured as follows:

$$\text{Stain Removal Index } (SRI) = \frac{\Delta E_{initial} - E_{washed}}{\Delta E_{initial}} \times 100$$

$\Delta E_{initial}$=Stain level before washing $\Delta E_{washed}$=Stain level after washing Stain removal index scores for each stain were calculated and are listed in the table below.

TABLE 6

| SRI scores | | | | |
|---|---|---|---|---|
| | Comparative Composition A Delta SRI Vs A | Inventive Composition B Delta SRI Vs A | Comparative Composition C Delta SRI Vs C | Inventive Composition D Delta SRI Vs C |
| PCS132 Sebum | 0.0 | +3.8 | 0.0 | +0.9 |
| PCS94 Dust Sebum | 0.0 | +2.4 | 0.0 | +2.0 |
| | Comparative Composition E Delta SRI Vs E | Inventive Compositio n F Delta SRI Vs E | Comparative Composition G Delta SRI Vs G | Inventive Composition H Delta SRI Vs G |
| PCS132 Sebum | 0.0 | +4.6 | 0.0 | +1.4 |
| PCS94 Dust Sebum | 0.0 | +2.1 | 0.0 | +0.8 |

These results illustrate the surprising stain removal advantages on PCS132 Sebum and PCS94 Dust Sebum by the inventive compositions (as used in Composition B, D, F and H) as compared to Branched Alkyl Sulfates in conventional liquid detergent compositions A, C, E and G.

Suds Boosting

TABLE 7

| Composition Test Concentration | | | | | | |
|---|---|---|---|---|---|---|
| Raw Material | Comparative Composition A Test concentration (ppm) | Inventive Composition B Test concentration (ppm) | Comparative Composition C Test concentration (ppm) | Inventive Composition D Test concentration (ppm) | Comparative Composition E Test concentration (ppm) | Inventive Composition F Test concentration (ppm) |
| C13 Branched Alkyl Sulfate (Isalchem) | 359 | | | | 144 | |
| C13 Branched Alkyl Sulfate (Inventive Example 4) | | 359 | | | | 144 |
| C15 Branched Alkyl Sulfate (Isalchem) | | | 359 | | 215 | |
| C15 Branched Alkyl Sulfate (Inventive Example 3) | | | | 359 | | 215 |

The suds generation and suds mileage of test cleaning compositions herein is measured by employing a suds cylinder tester (SCT). The SCT has a set of 8 cylinders. Each cylinder is a Lexan plastic cylinder typically 30 cm long and 8.8 cm internal diameter, with an adhesive ruler affixed to the outside. Cylinders are together rotated at a rate of 20-22 revolutions per minute (rpm). This method is used to assay the performance of test cleaning compositions to obtain a reading on ability to generate suds as well as the robustness of the suds in the presence of test soil.

Dissolve 18.6 g of the test cleaning composition and 500 g of water with a water hardness of about 15 gpg, that has been heated to about 140 F to form a sample solution containing the test cleaning composition product at a surfactant concentration of about 360 ppm; Pour about 300 ml of the sample solution into the SCT cylinders, filling each cylinder with sample solution to the 5.5 cm adhesive ruler mark. The temperature of the sample solution cools over time. The target temperature of the sample solution once in the cylinder is between 107 F and 115 F. Put in the rubber stoppers and lock the cylinders in place. Rotate cylinders for 2 minutes. Lock in an upright position. Record initial suds height (i.e., height of the suds plus liquid sample solution). The height of suds generated is calculated by deducting the height of the liquid sample solution alone (5.5 cm) out of the total suds height. Continue rotating the cylinders, recording total suds height every 2 minutes for a total of 20 minutes. This data represents the Suds Generation of the test cleaning composition. Open the rubber stopper on each cylinder. Add 10.00 g test soil into each cylinder. Preparation of test soil is conducted as follows: Disperse 3.60 g of Oleic Acid (Acros Organics CAS #112-80-1) into 596.40 g of Crisco Canola Oil with an IKA RW20 overhead mixer with impeller blade until a homogenous mixture is achieved. Replace the rubber stoppers. Record the starting suds height, and rotate cylinders for 1 minute. Lock in an upright position. Record initial suds height (i.e., height of the suds plus liquid sample solution). The height of suds generated is calculated by deducting the height of the liquid sample solution alone (5.5 cm) out of the total suds height. Continue rotating the cylinders, recording total suds height every 1 minutes for a total of 15 minutes. This data represents the Suds Mileage of the test cleaning composition.

Data is graphed as suds generation or suds mileage (cm) vs time (min). Area under the curve (AUC) is calculated using suds generation or suds mileage vs time data and a trapezoidal rule calculation:

$$\int_a^b f(x)dx \approx \sum_{k=1}^{N} \frac{f(x_{k-1}) + f(x_k)}{2} \Delta x_k$$

Results are reported as area under the curve (AUC), indexed versus a relevant control. Data should be labeled as "AUC Suds Generation Index" or "AUC Suds Mileage Index." The higher the AUC Index, the better the results. Table 8 illustrates the surprising advantage in Suds Generation of Inventive compositions B, D and F over Comparative compositions A, C and E. Additionally, Inventive compositions B and F have surprising advantages for Suds Mileage over Comparative compositions A and E.

TABLE 8

Suds Generation Data

| | Comparative Composition A Delta AUC Vs A | Inventive Composition B Delta AUC Vs A | Comparative Composition C Delta AUC Vs C | Inventive Composition D Delta AUC Vs C | Comparative Composition E Delta AUC Vs E | Inventive Composition F Delta AUC Vs E |
|---|---|---|---|---|---|---|
| Suds Generation (AUC) | 0.0 | + 35.1 | 0.0 | +7.5 | 0.0 | +42.7 |
| Suds Mileage (AUC) | 0.0 | + 11.7 | 0.0 | −1.4 | 0.0 | +7.6 |

A composition's viscosity is measured according to the following procedure.

The rheological profile of a liquid detergent composition is assessed via so-called shear sweep flow continuous ramp method at ascending shear rates from an initial shear rate of 0.1 inverse seconds (1/s) to a final shear rate of 1200 inverse seconds (1/s) at a constant temperature of 20° C. The instrument for the measurement is a programmable Rheometer (i.e., TA instruments AR2000®) with Peltier plate, heating rate capacity of 20° C. per minute, minimum precision of 0.1° C., and standard temperature range of 0-200° C. This instrument uses a spindle and 40 mm 2° steel cone plate arrangement with truncation height of 1000 μm. A pre-shear conditioning step is performed at 10 l/s for 10 seconds, and the sample is allowed to equilibrate for 1 minute prior to performing the actual shear sweep test. Typical shear sweep phase duration is 3 minutes with data logged at 32 points per decade. Results may be reported at 0.2 and 20 inverse seconds and graphically via XY scatter chart with X axis having a logarithmic scale. In particular, results may be reported at 20 s−1 at 20° C.

TABLE 9

| Viscosity Data | | | | | | |
|---|---|---|---|---|---|---|
| | Comparative Composition A Delta AUC Vs A | Inventive Composition B Delta AUC Vs A | Comparative Composition C Delta AUC Vs C | Inventive Composition D Delta AUC Vs C | Comparative Composition E Delta AUC Vs E | Inventive Composition F Delta AUC Vs E |
| Viscosity at 20 s-1 cP | 0.0 | +35.5 | 0.0 | +52.5 | 0.0 | +58.5 |

Procedure:

The alkyl sulfate pastes were diluted using deionized water to the appropriate concentration and mixed with a vortex mixer in 20 mL vials. The samples were then placed at 40° C. and checked/remixed daily until they were fully transformed. The samples were cooled to room temperature and checked visually under cross-polarized light for birefringence.

Physical Stability of Sodium Alkyl Sulfates in Water

TABLE 10

| C15 Alkyl Sulfate Stability Data at Different Concentrations | | | | | |
|---|---|---|---|---|---|
| Surfactant* | 10% | 20% | 25% | 30% | 32.50% |
| C15 Alkyl Sulfate from (Inventive Example 3) | Isotropic/ Stable | Isotropic/ Stable | Isotropic/ Stable | Isotropic/ Stable | Isotropic/ Stable |
| C15 Alkyl Sulfate from C15 Alcohol from U.S. Pat. No. 9,493,725 | Isotropic/ Stable | Isotropic/ Stable | Isotropic/ Stable | Biphasic/ Unstable | Biphasic/ Unstable |

*Concentrations are wt % active in deionized water

The results show the surprising and unexpected stability of Branched C15 Alkyl Sulfates of the present disclosure over Branched C15 Alkyl Sulfate as disclosed in U.S. Pat. No. 9,493,725.

Paste Formulation Results:

Another point of differentiation in physical stability is evident when the alkyl sulfates of this invention are mixed with solvents such as propylene diol (pdiol) and ethanol. In this example, the surfactants are diluted to a target activity with water, pdiol (16% in the final mixture) and ethanol (3% in the final mixture). The C15 alkyl sulfate composition at 42% active based on material from U.S. Pat. No. 9,493,725 is unstable at room temperature and phase splits in less than 24 hours. The C15 alkyl sulfate composition based on material from Example 3 is stable at 43.6% active with the same solvent system.

TABLE 11

| Stability Data at 22 degrees Celsius | |
|---|---|
| Surfactant wt. % with solvent (16% pdiol, 3% ethanol, balance is deionized water)* | Stability at Room Temperature at about 22 C. |
| 43.6 wt % of the C15 Alkyl Sulfate (from Inventive Example 3) | Isotropic/ Stable |
| 42 wt % active C15 Alkyl Sulfate from C15 Alcohol from U.S. Pat. No. 9,493,725 | Biphasic/Unstable within 24 hours |

*the wt %'s shown are on a 100% active basis of surfactant

The results show the surprising and unexpected stability of Branched C15 Alkyl Sulfates of the present disclosure over Branched C15 Alkyl Sulfate as disclosed in U.S. Pat. No. 9,493,725.

Other Example Liquid Formulations to Include

TABLE 12

| Additional Liquid Detergent Formulations | | | | | | |
|---|---|---|---|---|---|---|
| Raw Material | Inventive Composition G % wt | Inventive Composition H % wt | Inventive Composition I % wt | Inventive Composition J % wt | Inventive Composition K % wt | Inventive Composition L % wt |
| C13 Branched Alkyl Sulfate (Inventive Example 4) | 5.0 | 1.0 | 4.0 | 1.0 | 3.0 | 1.5 |
| C15 Branched Alkyl Sulfate (Inventive Example 3) | 1.0 | 5.0 | 6.0 | 3.0 | 1.0 | 9.0 |
| Sodium Lauryl Sulfate | 3.0 | 5.3 | 3.0 | 0.0 | 0.0 | 0.0 |
| linear alkylbenzene sulfonate | 5.0 | 12.0 | 8.5 | 1.5 | 12.0 | 1.0 |
| AE3S Ethoxylated alkyl sulphate with an average degree of ethoxylation of 3 | 0.0 | 3.0 | 0.0 | 0.0 | 0.0 | 0.0 |
| C25AES Ethoxylated alkyl sulphate with an average degree of ethoxylation of 2.5 | 0.0 | 0.0 | 0.0 | 0.0 | 3.1 | 0.0 |

TABLE 12-continued

| Additional Liquid Detergent Formulations | | | | | | |
|---|---|---|---|---|---|---|
| amine oxide | 0.0 | 1.0 | 1.0 | 0.5 | 0.7 | 0.0 |
| C24 alkyl ethoxylate (EO7) | 5.0 | 12.0 | 12.0 | 13.0 | 7.0 | 0.0 |
| C24 alkyl ethoxylate (EO9) | 0.0 | 0.0 | 0.0 | 0.0 | 0.0 | 2.0 |
| citric acid | 1.8 | 2.0 | 6.8 | 0.7 | 3.7 | 8.4 |
| palm kernel fatty acid | 0.0 | 0.5 | 1.0 | 3.0 | 0.0 | 0.0 |
| topped kernel fatty acid | 0.0 | 0.0 | 0.0 | 0.0 | 2.9 | 0.0 |
| Mannanase | 0.0017 | 0.0017 | 0.0017 | 0.0017 | 0.0017 | 0.0017 |
| Pectawash | 0.00342 | 0.00342 | 0.00342 | 0.00342 | 0.00342 | 0.00342 |
| Amylase | 0.00766 | 0.00766 | 0.00766 | 0.00766 | 0.00766 | 0.00766 |
| Protease | 0.07706 | 0.07706 | 0.07706 | 0.07706 | 0.07706 | 0.07706 |
| Cellulase | 0.00 | 0.001 | 0.003 | 0.00 | 0.00 | 0.00 |
| Lipase | 0.012 | | | 0.012 | | 0.01 |
| Nuclease[3] | 0.006 | 0.010 | 0.01 | 0.00 | 0.00 | 0.01 |
| borax | 1.1 | 1.7 | 2.0 | 0.1 | 0.0 | 0.0 |
| MEA-Boric Acid Salt | 0.0 | 0.0 | 0.0 | 0.1 | 0.0 | 0.93% |
| calcium/sodium formate | 0.1 | 0.2 | 0.2 | 0.3 | 0.04 | 0.0 |
| Sodium sulfate | 0.0 | 0.0 | 0.0 | 0.2 | 0.0 | 0.0 |
| Sodium/Calcium Chloride | 0.00 | 0.00 | 0.00 | 0.02 | 0.02 | 2.0 |
| Ethoxylated polyethyleneimine[2] | 2.6 | 0.0 | 3.0 | 1.3 | 0.0 | 1.5 |
| Amphiphilic graft copolymer | 0.0 | 4.0 | 0.0 | 0.0 | 1.5 | 0.0 |
| Ethoxylated-Propoxylated polyethyleneimine | 3.0 | 0.0 | 2.0 | 0.0 | 0.0 | 1.5 |
| Zwitterionic polyamine | 0.0 | 1.0 | 0.0 | 0.0 | 0.5 | 0.0 |
| Polyglucans | 3.0 | 0.0 | 3.0 | 0.0 | 0.0 | 0.0 |
| Conditioning agent | 0.0 | 0.0 | 0.0 | 0.0 | 0.0 | 0.2 |
| SRN260 | 1.0 | 1.5 | 2.0 | 1.0 | 0.0 | 0.0 |
| DTPA | 0.02 | 0.0 | 0.0 | 0.3 | 0.0 | 0.0 |
| EDDS | 0.00 | 0.1 | 0.5 | 0.0 | 0.0 | 0.0 |
| GLDA | 0.80 | 0.4 | 0.4 | 0.0 | 0.0 | 0.3 |
| MGDA | 0.50 | 0.2 | 0.2 | 0.0 | 0.0 | 0.0 |
| diethylene triamine penta(methyl phosphonic) acid (DTPMP) | 0.0 | 0.0 | 0.1 | 0.0 | 1.5 | 0.0 |
| Fluorescent Brightener[8] | 0.2 | 0.4 | 0.2 | 0.04 | 0.07 | 0.1 |
| Ethanol | 1.2 | 1.7 | 1.7 | 0.0 | 0.7 | 1.7 |
| propylene glycol | 0.4 | 0.7 | 2.0 | 0.30 | 5.5 | 1.7 |
| Sorbitol | 0.0 | 0.0 | 0.0 | 0.0 | 0.01 | 0.0 |
| monoethanolamine | 3.4 | 5.8 | 3.3 | 0.0 | 0.2 | 0.42 |
| DETA | 0.05 | 0.1 | 0.1 | 0.0 | 0.08 | 0.0 |
| Antioxidant 1 | 0.2 | 0.1 | 0.4 | 0.0 | 0.1 | 0.0 |
| Antioxidant 2 | 0.0 | 0.1 | 0.0 | 0.1 | 0.1 | 0.0 |
| Hygiene Agent | 0.0 | 0.0 | 0.0 | 0.1 | 0.0 | 0.0 |
| NaOH | 2.5 | 3.6 | 1.1 | 0.0 | 4.7 | 0.2 |
| NaCS | 0.1 | 0.2 | 1.6 | 3.0 | 3.5 | 0.0 |
| Hydrogenated Castor Oil | 0.8 | 1.2 | 0.25 | 0.12 | 0.2 | 0.1 |
| aesthetic dye | 0.05 | 0.10 | 0.01 | 0.06 | 0.01 | 0.0 |
| Leuco dye | 0.2 | 0.1 | 0.1 | 0.00 | 0.01 | 0.01 |
| Perfume | 0.5 | 0.4 | 1.0 | 0.5 | 2.0 | 1.2 |
| Perfume microcapsules | 0.2 | 0.5 | 0.6 | 0.6 | 0.05 | 0.05 |
| silicone antifoam[7] | 0.1 | 0.3 | 0.2 | 0.0 | 0.01 | 0.1 |
| Conditioning Agent | 0.0 | 0.0 | 0.0 | 0.0 | 0.0 | 0.01 |

TABLE 12-continued

| Additional Liquid Detergent Formulations | | | | | | |
|---|---|---|---|---|---|---|
| phenyloxyethanol | 0.0 | 0.0 | 0.0 | 0.0 | 0.01 | 0.01 |
| Hueing dye | 0.05 | 0.20 | 0.00 | 0.05 | 0.1 | 0.0 |
| water & miscellaneous | balance | balance | balance | balance | balance | Balance pH about 2 |

[1]C12-15EO2.5S AlkylethoxySulfate where the alkyl portion of AES includes from about 13.9 to 14.6 carbon atoms
[2]PE-20 commercially available from BASF
[3]Nuclease enzyme is as claimed in co-pendingEuropean application 19219568.3
[4]Antioxidant 1 is 3,5-bis(1,1-dimethylethyl)-4-hydroxybenzenepropanoic acid, methyl ester [6386-38-5]
[5]Antioxidant 2 is Tinogard TS commercially available from BASF
[6]Hygiene Agent is agent is Tinosan HP 100 commercially available from BASF
[7]Dow Corning supplied antifoam blend 80-92% ethylmethyl, methyl(2-phenyl propyl)siloxane; 5-14% MQ Resin in octyl stearate a 3-7% modified silica.
[8]Fluorescent Brightener is disodium 4,4'-bis{[4-anilino-6-morpholino-s-triazin-2-yl]-amino}-2,2'-stilbenedisulfonate or 2,2'-([1,1'-Biphenyl]-4,4'-diyldi-2,1-ethenediyl)bis-benzenesulfonic acid disodium salt.

| Raw Material | Inventive Composition M % wt | Inventive Composition N % wt | Inventive Composition O % wt | Inventive Composition P % wt | Inventive Composition Q % wt | Inventive Composition R % wt |
|---|---|---|---|---|---|---|
| C13 Branched Alkyl Sulfate (Inventive Example 4) | 2.0 | 4.7 | 0.0 | 1.0 | 2.0 | |
| C15 Branched Alkyl Sulfate (Inventive Example 3) | | 6.5 | 11.2 | 5.7 | 9.0 | 4.0 |
| Sodium Lauryl Sulfate | | | | 6.7 | 1.0 | 2.0 |
| linear alkylbenzene sulfonate | 3.8 | | | 17.0 | 1.0 | 4.0 |
| amine oxide | 1.0 | | | 1.0 | 1.0 | |
| C45 alkyl ethoxylate (E07) | | | | 1.2 | | |
| C24 alkyl ethoxylate (E09) | 10.0 | 3.5 | 3.5 | | | |
| C24 E09 peaked ethoxymer[1] | | | | | 8.0 | 3.0 |
| citric acid | 14.0 | 1.8 | 1.8 | 2.9 | 2.3 | |
| palm kernel fatty acid | | 1.1 | 1.1 | 0.3 | 1.1 | 1.1 |
| topped kernel fatty acid | | | | 1.0 | | |
| Octanoic acid | 0.1 | 0.2 | 0.2 | 0.3 | 0.1 | 0.5 |
| Mannanase | 0.0017 | 0.0017 | 0.0017 | 0.0017 | 0.0017 | 0.0017 |
| Pectawash | 0.00342 | 0.00342 | 0.00342 | 0.00342 | 0.00342 | 0.00342 |
| Amylase | 0.00766 | 0.00766 | 0.00766 | 0.00766 | 0.00766 | 0.00766 |
| protease | 0.07706 | 0.07706 | 0.07706 | 0.07706 | 0.07706 | 0.07706 |
| Cellulase | 0.00 | 0.001 | 0.003 | 0.00 | 0.00 | 0.00 |
| Nuclease[2] | 0.006 | 0.010 | 0.01 | 0.01 | 0.01 | 0.01 |
| MEA-Boric Acid Salt | 0.4 | | | 2.1 | 2.1 | |
| calcium/sodium formate | | | | 0.25 | 0.25 | |
| Sodium sulfate | | | | 0.19 | 0.19 | |
| Sodium/Calcium Chloride | 0.00 | 0.00 | 0.00 | 0.02 | 0.02 | |
| Ethoxylated polyethyleneimine | | 0.5 | 1.0 | 2.0 | 2.0 | 2.0 |
| Amphiphilic graft copolymer | 1.0 | 0.5 | 1.5 | | | |
| Ethoxylated-propoxylated polyethyleneimine[3] | | | 2.0 | 2.3 | 2.3 | |
| Zwitterionic polyamine | 1.0 | 0.5 | | | | |
| Polyglucans | | 3.0 | 1.0 | | | |
| SRN260 | | | 2.0 | 1.5 | 1.5 | 2.0 |
| DTPA | | | | | | |
| EDDS | 0.2 | | | | | |
| GLDA | 0.3 | 0.3 | 0.3 | 0.6 | 0.6 | 0.6 |
| MGDA | | | | | | |
| diethylene triamine penta(methyl phosphonic) acid (DTPMP) | | | | | | |
| Brightener 49 | 0.1 | 0.1 | 0.1 | 0.1 | 0.1 | 0.1 |
| ethanol | | 4.5 | 4.5 | 1.8 | 1.8 | 1.8 |
| propylene glycol | 3.0 | 4.4 | 4.4 | 2.6 | 2.6 | 2.6 |
| Sorbitol | | | | 0.1 | | |

TABLE 12-continued

| Additional Liquid Detergent Formulations | | | | | | |
|---|---|---|---|---|---|---|
| monoethanolamine | | 1.1 | 1.0 | | | |
| DETA | 0.1 | 0.1 | 0.1 | 0.1 | 0.1 | 0.1 |
| Antioxidant 1[4] | 0.1 | 0.05 | 0.03 | | | 0.1 |
| Antioxidant 2[5] | | | | 0.2 | 0.2 | |
| Hygiene agent[6] | 0.1 | | | | | |
| NaOH | 1.0 | 1.5 | 1.5 | | | |
| NaCS | | 1.3 | 9.5 | 0.5 | 0.5 | |
| Hydrogenated Castor Oil | 0.1 | 0.8 | 1.0 | 0.8 | 0.8 | 0.1 |
| aesthetic dye | 0.01 | 0.01 | 0.01 | 0.01 | 0.01 | 0.1 |
| Leuco dye | 0.1 | 0.1 | 0.04 | 0.1 | 0.1 | 0.1 |
| perfume | 1.0 | 1.2 | 0.8 | 0.5 | 0.5 | 1.0 |
| Perfume microcapsules | 1.00 | 0.7 | 0.7 | 1.5 | 1.5 | 0.7 |
| silicone antifoam[7] | 0.60 | 0.1 | 0.1 | 0.3 | 0.3 | 0.1 |
| Conditioning Agent | 0.0 | 0.08 | 0.1 | 0.25 | 0.0 | 0.0 |
| phenyloxyethanol | 0.0 | 2.0 | 2.0 | 0.1 | 0.1 | 0.05 |
| Hueing dye | 0.1 | 0.1 | 0.15 | 0.05 | 0.05 | 0.1 |
| water | Balance | balance | balance | balance | balance | balance |
| miscellaneous | pH about 2 | | | | | |

[1]Novel Peaked 1214-9 Nonionic ethoxylate commercially available from Sasol
[2]PE-20 commercially available from BASF
[3]Nuclease enzyme is as claimed in co-pending European application 19219568.3
[4]Antioxidant 1 is 3,5-bis(1,1-dimethylethyl)-4-hydroxybenzenepropanoic acid, methyl ester [6386-38-5]
[5]Antioxidant 2 is Tinogard TS commercially available from BASF
[6]Hygiene agent is Tinosan HP100 commercially available from BASF

TABLE 13

| Single Unit Dose (SUD) Compositions | | | | |
|---|---|---|---|---|
| Ingredients | Full article Composition ( wt %) | Bottom compartment Composition ( wt %) | Top compartment Composition 1 ( wt %) | Top compartment Composition 2 ( wt %) |
| Volume | 25.5 ml | 22.3 ml | 1.6 ml | 1.6 ml |
| Fatty alcohol ethoxylate non-ionic surfactant, $C_{12-14}$ average degree of ethoxylation of 7 | 3.5 | 3.7 | 2.6 | 1.6 |
| Lutensol XL100 | 0.4 | 0.5 | — | — |
| Linear $C_{11-14}$ alkylbenzene sulphonate | 24.2 | 24.9 | 18.9 | 19.4 |
| Branched Alkyl Sulfate (Inventive) | 6.1 | 6.3 | 4.8 | 4.8 |
| AE3S Ethoxylated alkyl sulphate with an average degree of ethoxylation of 3 | 6.1 | 6.3 | 4.8 | 4.8 |
| Citric acid | 0.7 | 0.7 | 0.5 | 0.5 |
| Palm Kernel Fatty acid | 5.2 | 5.4 | 4.1 | 4.1 |
| Nuclease enzyme* ( wt % active protein) | 0.009 | 0.011 | — | — |
| Protease enzyme ( wt % active protein) | 0.05 | 0.06 | — | — |
| Amylase enzyme ( wt % active protein) | 0.004 | 0.005 | — | — |
| Xyloglucanese enzyme ( wt % active protein) | 0.005 | — | 0.073 | — |
| Mannanase enzyme ( wt % active protein) | 0.003 | 0.003 | — | — |
| Lipase enzyme ( wt % active protein) | 0.012 | — | 0.187 | — |
| Ethoxylated polyethyleneimine | 1.5 | 1.6 | 1.2 | 1.2 |
| Amphiphilic graft copolymer | 2.0 | 2.3 | | |
| Zwitterionic polyamine | 1.8 | 1.9 | 1.4 | 1.4 |
| Anionic polyester terephthalate | 0.4 | — | — | 5.8 |
| Chelant** | 2.2 | 2.2 | 1.7 | 1.7 |
| Brightener 49 | 0.3 | 0.4 | 0.01 | 0.01 |
| Silicone anti-foam | 0.3 | 0.3 | — | — |
| Hueing dye | 0.04 | — | 0.69 | — |
| 1,2 PropaneDiol | 13.6 | 12.8 | 11.3 | 26.4 |
| Glycerine | 6.0 | 5.0 | 17.3 | 8.3 |
| DPG (DiPropyleneGlycol) | 0.8 | 0.8 | 0.6 | 0.6 |

TABLE 13-continued

| Single Unit Dose (SUD) Compositions | | | | |
|---|---|---|---|---|
| Ingredients | Full article Composition ( wt %) | Bottom compartment Composition ( wt %) | Top compartment Composition 1 ( wt %) | Top compartment Composition 2 ( wt %) |
| TPG (TriPropyleneGlycol) | 0.06 | 0.06 | | |
| Sorbitol | 0.6 | 0.05 | 8.8 | |
| Monoethanolamine | 10.0 | 10.4 | 7.9 | 8.0 |
| K2SO3 | 0.4 | 0.4 | 0.04 | 0.4 |
| MgCl2 | 0.3 | 0.3 | 0.2 | 0.2 |
| water | 10.9 | 10.9 | 11.8 | 9.9 |
| Hydrogenated castor oil | 0.1 | 0.1 | — | 0.1 |
| Perfume | 1.6 | 1.9 | — | — |
| Aesthetic dye & Minors (incl. preservative) | Balance to 100 | Balance to 100 | Balance to 100 | Balance to 100 |
| pH (10% product concentration in demineralized water at 20° C.) | 7.4 | 7.4 | 7.4 | 7.4 |

*Nuclease enzyme is as claimed in co-pending European application 19219568.3

**Chelant is HEDP, GLDA or DTPA

TABLE 14

| Solid free-flowing particulate laundry detergent composition examples: | |
|---|---|
| Ingredient | Amount (in wt %) |
| Branched Alkyl Sulfate (Inventive) | from 0.1 wt % to 15 wt % |
| Anionic detersive surfactant (such as alkyl benzene sulphonate, alkyl ethoxylated sulphate and mixtures thereof) | from 8 wt % to 15 wt % |
| Non-ionic detersive surfactant (such as alkyl ethoxylated alcohol) | from 0.1 wt % to 4 wt % |
| Cationic detersive surfactant (such as quaternary ammonium compounds) | from 0 wt % to 4 wt % |
| Other detersive surfactant (such as zwiterionic detersive surfactants, amphoteric surfactants and mixtures thereof) | from 0 wt % to 4 wt % |
| Carboxylate polymer (such as co-polymers of maleic acid and acrylic acid and/or carboxylate polymers comprising ether moieties and sulfonate moieties) | from 0.1 wt % to 4 wt % |
| Polyethylene glycol polymer (such as a polyethylene glycol polymer comprising polyvinyl acetate side chains) | from 0 wt % to 4 wt % |
| Polyester soil release polymer (such as Repel-o-tex and/or Texcare polymers) | from 0 wt % to 2 wt % |
| Cellulosic polymer (such as carboxymethyl cellulose, methyl cellulose and combinations thereof) | from 0.5 wt % to 2 wt % |
| Other polymer (such as care polymers) | from 0 wt % to 4 wt % |
| Zeolite builder and phosphate builder (such as zeolite 4A and/or sodium tripolyphosphate) | from 0 wt % to 4 wt % |
| Other co-builder (such as sodium citrate and/or citric acid) | from 0 wt % to 3 wt % |
| Carbonate salt (such as sodium carbonate and/or sodium bicarbonate) | from 0 wt % to 20 wt % |
| Silicate salt (such as sodium silicate) | from 0 wt % to 10 wt % |
| Filler (such as sodium sulphate and/or bio-fillers) | from 10 wt % to 70 wt % |
| Source of hydrogen peroxide (such as sodium percarbonate) | from 0 wt % to 20 wt % |
| Bleach activator (such as tetraacetylethylene diamine (TAED) and/or nonanoyloxybenzenesulphonate (NOBS)) | from 0 wt % to 8 wt % |
| Bleach catalyst (such as oxaziridinium-based bleach catalyst and/or transition metal bleach catalyst) | from 0 wt % to 0.1 wt % |
| Other bleach (such as reducing bleach and/or pre-formed peracid) | from 0 wt % to 10 wt % |
| Photobleach (such as zinc and/or aluminium sulphonated phthalocyanine) | from 0 wt % to 0.1 wt % |
| Chelant (such as ethylenediamine-N'N'-disuccinic acid (EDDS) and/or hydroxyethane diphosphonic acid (HEDP)) | from 0.2 wt % to 1 wt % |
| Hueing agent (such as direct violet 9, 66, 99, acid red 50, solvent violet 13 and any combination thereof) | from 0 wt % to 1 wt % |
| Brightener (C.I. fluorescent brightener 260 or C.I. fluorescent brightener 351) | from 0.1 wt % to 0.4 wt % |
| Protease (such as Savinase, Savinase Ultra, Purafect, FN3, FN4 and any combination thereof) | from 0.1 wt % to 0.4 wt % |
| Amylase (such as Termamyl, Termamyl ultra, Natalase, Optisize, Stainzyme, Stainzyme Plus and any combination thereof) | from 0 wt % to 0.2 wt % |

TABLE 14-continued

| Solid free-flowing particulate laundry detergent composition examples: | |
|---|---|
| Ingredient | Amount (in wt %) |
| Cellulase (such as Carezyme and/or Celluclean) | from 0 wt % to 0.2 wt % |
| Lipase (such as Lipex, Lipolex, Lipoclean and any combination thereof) | from 0 wt % to 1 wt % |
| Other enzyme (such as xyloglucanase, cutinase, pectate lyase, mannanase, bleaching enzyme) | from 0 wt % to 2 wt % |
| Fabric softener (such as montmorillonite clay and/or polydimethylsiloxane (PDMS)) | from 0 wt % to 15 wt % |
| Flocculant (such as polyethylene oxide) | from 0 wt % to 1 wt % |
| Suds suppressor (such as silicone and/or fatty acid) | from 0 wt % to 4 wt % |
| Perfume (such as perfume microcapsule, spray-on perfume, starch encapsulated perfume accords, perfume loaded zeolite, and any combination thereof) | from 0.1 wt % to 1 wt % |
| Aesthetics (such as coloured soap rings and/or coloured speckles/noodles) | from 0 wt % to 1 wt % |
| Miscellaneous | balance to 100 wt % |

TABLE 15

| Fiber (F) Compositions, mass % of Fibrous Water-soluble unit dose article | | | | | | | |
|---|---|---|---|---|---|---|---|
| Component | F1 | F2 | F3 | F4 | F5 | F6 | F7 |
| LAS | 48.5 | 43.1 | 59.2 | 21.0 | 47.2 | 51.8 | 42.8 |
| Branched Alkyl Sulfate (Inventive) | 0.0 | 21.6 | 0.0 | 42.0 | 23.6 | 12.9 | 21.4 |
| AES | 16.2 | 0.0 | 0.0 | 0.0 | 0.0 | 0.0 | 0.0 |
| PEG-PVAc | 0.00 | 0.0 | 5.9 | 3.2 | 0.0 | 0.0 | 0.0 |
| PVOH | 32.3 | 29.3 | 28.5 | 27.5 | 23.7 | 29.3 | 29.2 |
| PEO | 0.0 | 3.0 | 3.2 | 3.2 | 2.5 | 3.0 | 3.0 |
| Hue Dye | 0.0 | 0.0 | 0.0 | 0.0 | 0.0 | 0.0 | 0.6 |
| Moist + misc. | 3.0 | 3.0 | 3.2 | 3.1 | 3.0 | 3.0 | 3.0 |
| Total | 100 | 100 | 100 | 100 | 100 | 100 | 100 |

TABLE 16

| Particle (P) Compositions, mass %: in Fibrous Water-soluble unit dose article | | | | | | | |
|---|---|---|---|---|---|---|---|
| Component | P1 | P2 | P3 | P4 | P5 | P6 | P7 |
| LAS | 0.0 | 0.0 | 7.6 | 9.5 | 8.1 | 10.8 | 4.4 |
| Branched Alkyl Sulfate (Inventive Example) | 19.2 | 0.0 | 0.0 | 0.0 | 0.0 | 0.0 | 0.0 |
| AES | 4.8 | 45.0 | 26.4 | 21.6 | 24.6 | 21.6 | 26.3 |
| Sodium Carbonate | 18.0 | 35.0 | 19.2 | 15.3 | 15.1 | 10.0 | 14.2 |
| Zeolite-A | 54.2 | 0.0 | 24.4 | 32.0 | 49.1 | 51.8 | 49.9 |
| Chelant | 0.0 | 0.0 | 0.0 | 0.0 | 0.0 | 0.0 | 0.0 |
| PE20 | 0.0 | 0.0 | 10.4 | 3.7 | 0.0 | 3.5 | 0.0 |
| Trilon | 0.0 | 0.0 | 0.0 | 0.0 | 0.0 | 0.0 | 0.0 |
| AcuSol | 0.0 | 0.0 | 0.0. | 0.0 | 0.0 | 0.0 | 0.0 |
| Pluronic F38 | 0.0 | 0.0 | 0.0 | 0.0 | 0.0 | 0.0 | 1.8 |
| Disp. Polymer | 0.0 | 0.0 | 0.0 | 0.0 | 0.0 | 0.0 | 0.0 |
| PEG4k | 0.8 | 0.0 | 0.0 | 8.22 | 0.0 | 0.0 | 0.0 |
| Silica | 0.0 | 15.0 | 8.2 | 0.0 | 0.0 | 0.0 | 0.0 |
| Citrate | 0.0 | 0.0 | 0.0 | 0.0 | 0.0 | 0.0 | 0.0 |
| PVOH + PEO | 0.0 | 0.0 | 0.0 | 0.0 | 0.0 | 0.0 | 0.0 |
| Moist + misc. | 3.0 | 5.0 | 3.8 | 9.81 | 3.1 | 2.3 | 3.3 |
| Total | 100 | 100 | 100 | 100 | 100 | 100 | 100 |
| LAS:AES | 0:4.8 | 0:45 | 7.6:26.4 | 9.5:21.6 | 8.1:24.6 | 10.8:21.6 | 4.4:26.3 |

A. A detergent composition comprising from about 0.1% to about 99% by weight of the composition of a first surfactant, wherein said first surfactant consists essentially of a mixture of surfactant isomers of Formula I and surfactants of Formula II:

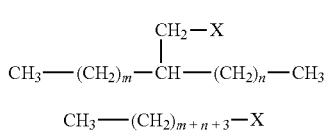

(I)

(II)

$6 \le m \le 11$;
$0 \le n \le 5$;

wherein from about 50% to about 100% by weight of the first surfactant are isomers having m+n=11; wherein between about 25% to about 50% of the mixture of surfactant isomers of Formula I have n=0; wherein from about 0.001% to about 25% by weight of the first surfactant are surfactants of Formula II; and wherein X is a hydrophilic moiety.

B. The detergent composition of claim 1, wherein the detergent composition further comprises from about 0.1% to about 99% by weight of the composition of a second surfactant, wherein said second surfactant consists essentially of a mixture of surfactant isomers of Formula III and surfactants of Formula IV:

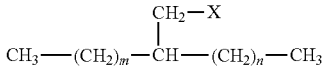

(III)

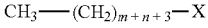

(IV)

$6 \leq m \leq 9$;
$0 \leq n \leq 5$;

wherein from about 50% to about 100% by weight of the second surfactant are isomers having m+n=9; wherein from about 0.001% to about 25% by weight of the second surfactant are surfactants of Formula IV; and wherein X is a hydrophilic moiety.

C. The detergent composition of any of the preceding paragraphs, wherein between about 15% to about 40% of the mixture of surfactant isomers of Formula I have n=1.

D. The detergent composition of any of the preceding paragraphs, wherein between about 60% to about 90% of the mixture of surfactant isomers of Formula I have n<3.

E. The detergent composition of any of the preceding paragraphs, wherein between about 90% to about 100% of the first surfactant are isomers having m+n=11.

F. The detergent composition of any of the preceding paragraphs, wherein from about 15% to about 40% by weight of the first surfactant mixture are isomers of Formula I with n=1, from about 5% to about 20% by weight of the first surfactant mixture are isomers of Formula I with n=2.

G. The detergent composition of any of the preceding paragraphs, wherein the first surfactant does not contain isomers of Formula I with n equal to or greater than 6.

H. The detergent composition of any of the preceding paragraphs, wherein up to about 30% of the mixture of surfactant isomers of Formula I have n>2.

I. The detergent composition of any of the preceding paragraphs, wherein the first surfactant mixture of surfactants comprises up to about 20% by weight of the Formula II isomer.

J. The detergent composition of any of the preceding paragraphs, wherein X is selected from the group consisting of wherein X is selected from the group consisting of sulfates, alkoxylated alkyl sulfates, sulfonates, amine oxides, polyalkoxylates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated/polyhydroxylated oxypropyl quats, imidazolines, 2-ylsuccinates, sulfonated alkyl esters, sulfonated fatty acids, and mixtures thereof.

K. The detergent composition of any of the preceding paragraphs further comprising an adjunct cleaning additive selected from the group consisting of a builder, an organic polymeric compound, an enzyme, an enzyme stabilizer, one or more solvents, a bleach system, a brightener, a hueing agent, a chelating agent, a suds suppressor, a conditioning agent, a humectant, a perfume, a filler or carrier, an alkalinity system, a pH control system, and a buffer, and mixtures thereof.

L. The detergent composition of any of paragraphs B to K, wherein the detergent composition further comprises from about 0.1% to about 99% by weight of the composition of a second surfactant, wherein said second surfactant consists essentially of a mixture of surfactant isomers of Formula III and surfactants of Formula IV.

M. The detergent composition of any of paragraphs B to L, wherein between about 25% to about 50% of the mixture of surfactant isomers of Formula III have n=0.

N. The detergent composition of any of paragraphs B to M, wherein between about 15% to about 40% of the mixture of surfactant isomers of Formula III have n=1.

O. The detergent composition of any of paragraphs B to N, wherein between about 50% to about 90% of the mixture of surfactant isomers of Formula III have n<3.

P. The detergent composition of any of paragraphs B to O, wherein between about 90% to about 100% of the second surfactant comprises isomers having m+n=9.

Q. The detergent composition of any of paragraphs B to P, wherein from about 25% to about 50% by weight of the second surfactant mixture are isomers of Formula III with n=0, from about 15% to about 40% by weight of the second surfactant mixture are isomers of Formula III with n=1, and from about 5% to about 20% by weight of the second surfactant mixture are isomers of Formula III with n=2.

R. The detergent composition of any of paragraphs B to Q, wherein up to about 35% of the mixture of surfactant isomers of Formula III have n>2.

S. The detergent composition of any of paragraphs B to R, wherein the second surfactant mixture of surfactants comprises up to about 20% by weight of the Formula IV isomer.

T. The detergent composition of any of paragraphs B to S, wherein the composition comprises a surfactant mixture comprising between 30% to 99% of the first surfactant and between about 0.5% to about 20% of the second surfactant.

U. The detergent composition of any of paragraphs B to T, wherein the composition comprises a surfactant mixture comprising between 60% and 99% of the first surfactant and between 0.5% and 10% of the second surfactant.

V. The detergent composition of any of paragraphs B to U, wherein the ratio of the second surfactant to the first surfactant is between 0.5:10 to 4:10.

W. The detergent composition of any of paragraphs B to V, wherein the detergent composition further comprises a third surfactant selected from the group consisting of an anionic surfactant, a cationic surfactant, a nonionic surfactant, an amphoteric surfactant, a zwitterionic surfactant, or mixtures thereof; or wherein said detergent composition comprises an anionic surfactant selected from alkyl benzene sulfonates, alkoxylated alkyl sulfates, alkyl sulfates, and mixtures thereof.

X. The detergent composition of any of the preceding paragraphs, wherein said detergent composition is a form selected from the group consisting of a granular detergent, a bar-form detergent, a liquid laundry detergent, a gel detergent, a single-phase or multi-phase unit dose detergent, a detergent contained in a single-phase or multi-phase or multi-compartment water soluble pouch, a multi-compartment non-dissolvable package, a liquid hand dishwashing composition, a laundry pretreat product, a detergent contained on or in a porous substrate or nonwoven sheet, an automatic dish-washing detergent, a hard surface cleaner, a fabric softener composition, and mixtures thereof.

Y. The detergent composition of any of the preceding paragraphs, wherein said detergent composition is in the form of a fibrous product, wherein the detergent composition is incorporated in a fiber, in a particle incorporated in the fibrous product or a combination thereof.

Z. The detergent composition of any of the preceding paragraphs, wherein the detergent composition comprises from about 0.01% to about 5% of a structurant, wherein the structurant is selected from the group consisting of diglycerides and triglycerides, ethylene glycol distearate, microcrystalline cellulose, cellulose-based materials, microfiber cellulose, hydrophobically modified alkali-swellable emulsions, biopolymers, xanthan gum, gellan gum, hydrogenated castor oil, derivatives of hydrogenated castor oil derivatives and mixtures thereof.

AA. The detergent composition of any of the preceding paragraphs, wherein from about 0.1% to about 100% of the carbon content of the first surfactant, the second surfactant, or combinations thereof are derived from renewable sources.

BB. The detergent composition of any of the preceding paragraphs, wherein X has been neutralized with sodium hydroxide, potassium hydroxide, magnesium hydroxide, lithium hydroxide, calcium hydroxide, ammonium hydroxide, monoethanolamine, diethanolamine, triethanolamine, monoisopropanolamine, diamine, polyamine, primary amine, secondary amine, tertiary amine, amine containing surfactant, or a combination thereof.

CC. A method of pretreating or treating a soiled fabric comprising contacting the soiled fabric with the detergent composition according to any of the preceding paragraphs.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm.

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent composition comprising from about 0.1% to about 99% by weight of the composition of a first surfactant, wherein said first surfactant consists essentially of a mixture of surfactant isomers of Formula I and surfactants of Formula II:

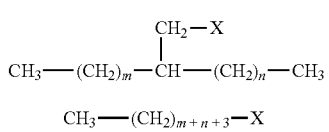

(I)

(II)

$6 \leq m \leq 11$;
$0 \leq n \leq 5$;

wherein from about 90% to about 100% by weight of the first surfactant are isomers having m+n=11; wherein between about 25% to about 50% of the mixture of surfactant isomers of Formula I have n=0; wherein from about 0.001% to about 25% by weight of the first surfactant are surfactants of Formula II; wherein X is a hydrophilic moiety, wherein the first surfactant does not contain isomers of Formula I with n equal to or greater than 6.

2. The detergent composition of claim 1, wherein between about 15% to about 40% of the mixture of surfactant isomers of Formula I have n=1.

3. The detergent composition of claim 1, between about 60% to about 90% of the mixture of surfactant isomers of Formula I have n<3.

4. The detergent composition of claim 1 wherein from about 15% to about 40% by weight of the first surfactant mixture are isomers of Formula I with n=1, from about 5% to about 20% by weight of the first surfactant mixture are isomers of Formula I with n=2.

5. The detergent composition of claim 1, wherein up to about 30% of the mixture of surfactant isomers of Formula I have n>2.

6. The detergent composition of claim 1, wherein the first surfactant mixture of surfactants comprises up to about 20% by weight of the Formula II isomer.

7. The detergent composition of claim 1, wherein X is selected from the group consisting of sulfates, alkoxylated alkyl sulfates, sulfonates, amine oxides, polyalkoxylates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated/polyhydroxylated oxypropyl quats, imidazolines, 2-yl-succinates, sulfonated alkyl esters, sulfonated fatty acids, and mixtures thereof.

8. The detergent composition of claim 1, wherein the detergent composition further comprises from about 0.1% to about 99% by weight of the composition of a second surfactant, wherein said second surfactant consists essentially of a mixture of surfactant isomers of Formula III and surfactants of Formula IV:

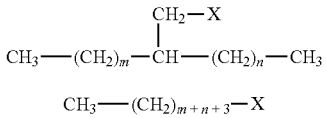

(III)

(IV)

$6 \leq m \leq 9$;
$0 \leq n \leq 5$;

wherein from about 50% to about 100% by weight of the second surfactant are isomers having m+n=9; wherein from about 0.001% to about 25% by weight of the second surfactant are surfactants of Formula IV; and wherein X is a hydrophilic moiety.

9. The detergent composition of claim 8, wherein between about 25% to about 50% of the mixture of surfactant isomers of Formula III have n=0.

10. The detergent composition of claim 8, wherein between about 15% to about 40% of the mixture of surfactant isomers of Formula III have n=1.

11. The detergent composition of claim 8, wherein between about 50% to about 90% of the mixture of surfactant isomers of Formula III have n<3.

12. The detergent composition of claim 8, wherein between about 90% to about 100% of the second surfactant comprises isomers having m+n=9.

13. The detergent composition of claim 8, wherein from about 25% to about 50% by weight of the second surfactant mixture are isomers of Formula III with n=0, from about 15% to about 40% by weight of the second surfactant mixture are isomers of Formula III with n=1, and from about 5% to about 20% by weight of the second surfactant mixture are isomers of Formula III with n=2.

14. The detergent composition of claim 8, wherein up to about 35% of the mixture of surfactant isomers of Formula III have n>2.

15. The detergent composition of claim 8, wherein the second surfactant mixture of surfactants comprises up to about 20% by weight of the Formula IV isomer.

16. The detergent composition of claim 8, wherein X is selected from the group consisting of sulfates, alkoxylated alkyl sulfates, sulfonates, amine oxides, polyalkoxylates, polyhydroxy moieties, phosphate esters, glycerol sulfonates, polygluconates, polyphosphate esters, phosphonates, sulfosuccinates, sulfosuccaminates, polyalkoxylated carboxylates, glucamides, taurinates, sarcosinates, glycinates, isethionates, dialkanolamides, monoalkanolamides, monoalkanolamide sulfates, diglycolamides, diglycolamide sulfates, glycerol esters, glycerol ester sulfates, glycerol ethers, glycerol ether sulfates, polyglycerol ethers, polyglycerol ether sulfates, sorbitan esters, polyalkoxylated sorbitan esters, ammonioalkanesulfonates, amidopropyl betaines, alkylated quats, alkyated/polyhydroxyalkylated quats, alkylated/polyhydroxylated oxypropyl quats, imidazolines, 2-yl-succinates, sulfonated alkyl esters, sulfonated fatty acids, and mixtures thereof.

17. The detergent composition of claim 8, wherein the detergent composition comprises a surfactant system comprising between 30% to 99% of the first surfactant and between about 0.5% to about 40% of the second surfactant.

18. The detergent composition of claim 8, wherein the composition comprises a surfactant system comprising between 30% to 99% of the first surfactant and between 0.5% to 12.5% of the second surfactant.

19. The detergent composition of claim 1, wherein said detergent composition is a form selected from the group consisting of a granular detergent, a bar-form detergent, a liquid laundry detergent, a gel detergent, a single-phase or multi-phase unit dose detergent, a detergent contained in a single-phase or multi-phase or multi-compartment water soluble pouch, a multi-compartment non-dissolvable package, a liquid hand dishwashing composition, a laundry pretreat product, a detergent contained on or in a porous substrate or nonwoven sheet, an automatic dish-washing detergent, a hard surface cleaner, a fabric softener composition, and mixtures thereof.

20. The detergent composition of claim 1, wherein said detergent composition is in the form of a fibrous product, wherein the detergent composition is incorporated in a fiber, in a particle incorporated in the fibrous product, or a combination thereof.

21. The detergent composition of claim 1, wherein the detergent composition comprises from about 0.01% to about 5% of a structurant, wherein the structurant is selected from the group consisting of diglycerides and triglycerides, ethylene glycol distearate, microcrystalline cellulose, cellulose-based materials, microfiber cellulose, hydrophobically modified alkali-swellable emulsions, biopolymers, xanthan gum, gellan gum, hydrogenated castor oil, derivatives of hydrogenated castor oil derivatives and mixtures thereof.

22. The detergent composition of claim 1, wherein X has been neutralized with sodium hydroxide, potassium hydroxide, magnesium hydroxide, lithium hydroxide, calcium hydroxide, ammonium hydroxide, monoethanolamine, diethanolamine, triethanolamine, monoisopropanolamine, diamine, polyamine, primary amine, secondary amine, tertiary amine, amine containing surfactant, or a combination thereof.

23. The detergent composition of claim 1, wherein the first surfactant has a 2-alkyl branch distribution of 2-methyl of about 40%.

* * * * *